US008147160B2

(12) United States Patent
To et al.

(10) Patent No.: US 8,147,160 B2
(45) **Date of Patent: *Apr. 3, 2012**

(54) RING BINDER MECHANISM WITH POLYMERIC HOUSING AND ACTUATOR

(75) Inventors: Chun Yuen To, Hong Kong (CN); Ho Ping Cheng, Hong Kong (CN)

(73) Assignee: World Wide Stationery Mfg. Co., Ltd., Kwai Chung, N.T. (HK)

( * ) Notice: Subject to any disclaimer, the term of this patent is extended or adjusted under 35 U.S.C. 154(b) by 697 days.

This patent is subject to a terminal disclaimer.

(21) Appl. No.: 12/236,296

(22) Filed: Sep. 23, 2008

(65) Prior Publication Data

US 2009/0110470 A1 Apr. 30, 2009

Related U.S. Application Data

(63) Continuation-in-part of application No. 11/932,150, filed on Oct. 31, 2007, now Pat. No. 7,819,602.

(51) Int. Cl.
*B42F 13/20* (2006.01)

(52) U.S. Cl. ..... 402/38

(58) Field of Classification Search ..... 402/19, 402/26, 37, 29, 70, 73

See application file for complete search history.

(56) References Cited

U.S. PATENT DOCUMENTS

| | | | |
|---|---|---|---|
| 566,717 | A | 8/1896 | Krah |
| 651,254 | A | 6/1900 | Krah |
| 683,019 | A | 9/1901 | Buchanan |
| 790,382 | A | 5/1905 | McBride |
| 857,377 | A | 6/1907 | Baker |
| 974,831 | A | 11/1910 | Scherzinger |
| 1,163,179 | A | 12/1915 | Schade, Jr |
| 1,398,034 | A | 11/1921 | Mero |
| 1,398,388 | A | 11/1921 | Murphy |
| 1,733,548 | A | 10/1929 | Martin |
| 1,733,894 | A | 10/1929 | Martin |
| 1,787,957 | A | 1/1931 | Schade |

(Continued)

FOREIGN PATENT DOCUMENTS

BE 824649 A1 5/1975

(Continued)

OTHER PUBLICATIONS

Cyber Comfort ad sheet, Apr. 2003, 2 pgs, World Wide Stationery Mfg. Co., Ltd., Hong Kong.

Office action dated Feb. 1, 2010 from U.S. Appl. No. 11/932,150, 13 pages.

Response filed May 3, 2010 to Office action issued Feb. 1, 2010 in U.S. Appl. No. 11/932,150, 22 pages.

*Primary Examiner* — Dana Ross
*Assistant Examiner* — Matthew G Katcoff
(74) *Attorney, Agent, or Firm* — Senniger Powers LLP

(57) ABSTRACT

A ring binder mechanism includes a housing and a ring support supported by the housing for movement relative thereto. Each ring of a plurality of rings includes first and second ring members. The first ring member is mounted on the ring support for movement with the ring support relative to the housing between a closed position and an opened position. An actuator is mounted for pivotal movement relative to the housing for moving the rings from their closed position to their opened position. The actuator includes a lower arm having a contact surface engageable with a lower surface of the ring support when the rings are in their opened position and out of engagement with the ring support when the rings are in their closed position. The contact surface defines an angle between its outer surface and a horizontal plane between about 16 degrees and about 55 degrees.

22 Claims, 54 Drawing Sheets

U.S. PATENT DOCUMENTS 1,953,981 A 4/1934 Trussell
1,991,362 A 2/1935 Krag
1,996,463 A 4/1935 Dawson et al.
2,004,570 A 6/1935 Dawson
2,013,416 A 9/1935 McClure
2,024,461 A 12/1935 Lotter
2,075,766 A 3/1937 Rand
2,089,211 A 8/1937 Krag
2,096,944 A 10/1937 Unger et al.
2,103,307 A 12/1937 Unger
2,105,235 A 1/1938 Schade
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,121 A 4/1941 St. Louis et al.
2,252,422 A 8/1941 Unger
2,260,929 A 10/1941 Bloore
2,288,189 A 6/1942 Guinane
2,304,716 A 12/1942 Supin
2,311,492 A 2/1943 Unger
2,322,595 A 6/1943 Schade
2,421,799 A 6/1947 Martin
2,528,866 A 11/1950 Dawson, Jr.
2,612,169 A 9/1952 Segal
2,865,377 A 12/1958 Schroer et al.
2,871,711 A 2/1959 Stark
2,891,553 A 6/1959 Acton
2,950,719 A 8/1960 Lyon
3,077,888 A 2/1963 Thieme
3,098,489 A 7/1963 Vernon
3,098,490 A 7/1963 Wance
3,101,719 A 8/1963 Vernon
3,104,667 A 9/1963 Mintz
3,149,636 A 9/1964 Rankin
3,190,293 A 6/1965 Schneider et al.
3,205,894 A 9/1965 Rankin
3,205,895 A 9/1965 Johnson
3,255,759 A 6/1966 Dennis
3,348,550 A 10/1967 Wolf et al.
3,718,402 A 2/1973 Schade
3,728,036 A 4/1973 Cott
3,748,051 A 7/1973 Frank
3,884,586 A 5/1975 Michaelis et al.
3,954,343 A 5/1976 Thomsen
3,993,374 A 11/1976 Schudy et al.
4,127,340 A 11/1978 Almgren
4,130,368 A 12/1978 Jacoby et al.
4,352,582 A 10/1982 Eliasson
4,522,526 A 6/1985 Lozfau et al.
4,566,817 A 1/1986 Barrett, Jr.
4,571,108 A 2/1986 Vogl
4,696,595 A 9/1987 Pinkney
4,798,491 A 1/1989 Lassle
4,813,803 A 3/1989 Gross
4,815,882 A 3/1989 Ohminato
4,886,390 A 12/1989 Silence et al.
4,919,557 A 4/1990 Podosek
5,067,840 A 11/1991 Cooper et al.
5,116,157 A 5/1992 Gillum et al.
5,135,323 A 8/1992 Pinheiro
5,180,247 A 1/1993 Yu
5,255,991 A 10/1993 Sparkes
5,286,128 A 2/1994 Gillum
5,346,325 A 9/1994 Yamanoi
5,354,142 A 10/1994 Yu
5,368,407 A 11/1994 Law
5,378,073 A 1/1995 Law
5,393,155 A 2/1995 Ng
5,393,156 A 2/1995 Mullin et al.
5,476,335 A 12/1995 Whaley
5,577,852 A 11/1996 To
5,660,490 A 8/1997 Warrington
5,692,847 A 12/1997 Zane et al.
5,692,848 A 12/1997 Wada
5,718,529 A 2/1998 Chan
5,782,569 A 7/1998 Mullin et al.
5,788,392 A 8/1998 Cheung
5,807,006 A 9/1998 Cheung
5,810,499 A 9/1998 Law
5,816,729 A 10/1998 Whaley
5,868,513 A 2/1999 Law
5,879,097 A 3/1999 Cheng
5,895,164 A 4/1999 Wu
5,904,435 A 5/1999 Tung
5,957,611 A 9/1999 Whaley
5,975,785 A 11/1999 Chan
6,036,394 A 3/2000 Cheng
6,146,042 A 11/2000 To et al.
6,206,601 B1 3/2001 Ko
6,217,247 B1 4/2001 Ng
6,270,279 B1 8/2001 Whaley
6,276,862 B1 8/2001 Snyder
6,293,722 B1 9/2001 Holbrook et al.
6,364,558 B1 4/2002 To
6,467,984 B1 10/2002 To
6,474,897 B1 11/2002 To
6,533,486 B1 3/2003 To
6,536,980 B2 3/2003 To
6,749,357 B2 6/2004 Cheng
6,840,695 B2 1/2005 Horn
7,223,040 B2 5/2007 Koike et al.
7,270,496 B2 9/2007 Morgan et al.
7,275,886 B2 10/2007 Cheng
7,296,946 B2 11/2007 Cheng et al.
7,331,732 B2 2/2008 Kaneda
7,404,685 B2 7/2008 Cheng
7,478,963 B2 1/2009 Tanaka et al.
7,534,064 B2 5/2009 Cheng
7,549,817 B2 6/2009 Cheng et al.
7,648,302 B2 1/2010 Zhang et al.
7,665,926 B2 2/2010 Cheng
7,674,062 B2 3/2010 Horn
7,819,602 B2 10/2010 To et al.
7,828,491 B2 11/2010 Cheng
2002/0076262 A1 6/2002 To
2005/0201817 A1 9/2005 Cheng
2005/0201818 A1 9/2005 Cheng
2006/0008318 A1* 1/2006 Ng ..... 402/19
2006/0104708 A1 5/2006 Kaneda
2006/0153629 A1* 7/2006 Cheng ..... 402/38
2006/0216107 A1* 9/2006 Lin ..... 402/38
2006/0228164 A1* 10/2006 Horn ..... 402/31
2007/0086836 A1 4/2007 Cheng
2007/0134054 A1 6/2007 Li
2008/0008519 A1 1/2008 To
2008/0085145 A1 4/2008 To et al.
2008/0199246 A1 8/2008 To et al.
2009/0035053 A1 2/2009 Pi et al.
2009/0060630 A1 3/2009 To et al.
2009/0060631 A1* 3/2009 To et al. ..... 402/38

FOREIGN PATENT DOCUMENTS

CA 2331946 A1 9/2001
CN 1836916 A 9/2006
EP 1065072 A2 1/2001
FR 1336765 A 9/1963
FR 1346864 A 12/1963
FR 1385285 A 1/1965
FR 2221924 10/1974
FR 2238332 A5 2/1975
GB 868724 A 5/1961
GB 906279 A 9/1962
GB 952536 A 3/1964
GB 2292343 A 2/1996
GB 2387815 A 10/2003
JP 5979379 U 5/1984
JP 6118880 U 2/1986
JP 1299095 A 12/1989
JP 04120085 U 10/1992
JP 06171287 A 6/1994
JP 10217662 A 8/1998
JP 10329470 A 12/1998

* cited by examiner

RING BINDER MECHANISM WITH POLYMERIC HOUSING AND ACTUATOR

CROSS REFERENCE TO RELATED APPLICATION

This application is a continuation-in-part of U.S. patent application Ser. No. 11/932,150 filed Oct. 31, 2007, which is hereby incorporated by reference in its entirety.

FIELD

The field of this invention relates to ring binder mechanisms for retaining loose-leaf pages, and in particular to a ring binder mechanism having a housing constructed at least in part from a polymeric material and an actuator.

BACKGROUND

Typical ring binder mechanisms have a plurality of rings for retaining loose-leaf pages, such as hole-punched pages, in a file or notebook. The rings can be selectively opened to add or remove pages from the ring binder mechanism or closed to retain the pages while allowing the pages to be moved along the rings. Each of the rings includes paired ring members mounted on adjacent hinge plates that are joined together about a pivot axis. A housing, which is typically metal and elongate, supports the hinge plates within the housing for pivotal movement relative to the housing about the pivot axis. Often, the housing is generally arch-shaped (e.g., U-shaped or C-shaped) in cross-section, with bent-under rims that hold the hinge plates within the housing.

The housing of the ring binder mechanism typically has an exposed metal outer surface. This exposed surface often contains nickel plating, to which some people may be sensitive. Additionally, it is difficult and costly to print on a metal surface particularly where the metal surface is nickel-plated. The process of nickel plating can also present some environmental and work hazard issues. Accordingly, it is known in some instances to replace the metal housing with a housing constructed from a polymeric material.

The housing, in an undeformed state, is slightly narrower than the joined hinge plates when the hinge plates are in a coplanar position. As the hinge plates pivot through this coplanar position, they deform the resilient housing laterally outwardly and cause a spring force in the housing to urge the hinge plates to pivot away from the coplanar position, either upward to open the rings or downward to close the rings. When the rings are closed, the spring force of the housing resists hinge plate movement and thereby holds the rings together. Similarly, when the rings are open, the spring force of the housing holds them apart. Typically, an operator can overcome the spring force of the housing by manually pulling the ring members of the rings apart or pushing them together.

Levers may be provided on one or both ends of the housing for pivoting the hinge plates and thereby moving the rings between their opened and closed positions. As illustrated in FIG. 1A, typical levers include an upper arm disposed adjacent the upper surface of the hinge plates and a lower arm disposed adjacent the lower surface of the hinge plates. As the lever is pivoted away from the housing (FIG. 1B), the lower arm contacts the lower surface of the hinge plates and drives the hinge plates upward through the coplanar position thereby opening the rings. To close the rings, the lever is pivot in the opposite direction (i.e., toward the housing) so that the upper arm contacts the upper surface of the hinge plates and drives the hinge plates downward through the coplanar position thereby closing the rings.

As illustrated in FIG. 1C, some prior art levers have been known to disengage during pivotal rotation of the lever to open the rings. As mentioned above, to open the rings, the lever is rotated away from the housing so that the lower arm of the lever contacts the hinge plates and drives them upward. In some prior art levers, if the user rotates the lever too far, the lower arm of the lever will rotate beyond the end of the hinge plate and disengage from the hinge plate. If this occurs, the lever can no longer be used to open or close the rings. Disengagement of the lever from the hinge plates is more likely to occur when the housing is constructed from a polymeric material than when it is constructed from a metal material because the polymeric housing is more flexible. The polymeric housing provides less resistance to the lever disengaging from the hinge plates.

SUMMARY

In one aspect, a ring binder mechanism for holding loose-leaf pages generally comprises a housing and a ring support supported by the housing for movement relative to the housing. The ring support has an upper surface and a lower surface. The mechanism also has a plurality of rings for holding the loose-leaf pages. Each ring includes a first ring member and a second ring member. The first ring member is mounted on the ring support for movement with the ring support relative to the housing between a closed position and an opened position. In the closed position, the first and second ring members cooperatively form a substantially continuous, closed loop for allowing loose-leaf pages retained by the rings to be moved along the rings from one ring member to the other. In the opened position, the first and second ring members form a discontinuous, open loop for adding or removing loose-leaf pages from the rings. An actuator is mounted on the housing for pivotal movement relative to the housing for moving the rings from their closed position to their opened position. The actuator includes a lower arm having a contact surface engageable with the lower surface of the ring support when the rings are in their opened position and out of engagement with the lower surface of the ring support when the rings are in their closed position. The contact surface of the lower arm defines an angle between its outer surface and a horizontal plane between about 16 degrees and about 55 degrees.

In another aspect, a ring binder mechanism for holding loose-leaf pages generally comprises a housing and a ring support supported by the housing for movement relative to the housing. The ring support has an upper surface and a lower surface. The mechanism includes a plurality of rings for holding the loose-leaf pages. Each ring includes a first ring member and a second ring member. The first ring member is mounted on the ring support for movement with the ring support relative to the housing between a closed position and an opened position. In the closed position, the first and second ring members cooperatively form a substantially continuous, closed loop for allowing loose-leaf pages retained by the rings to be moved along the rings from one ring member to the other. In the opened position, the first and second ring members form a discontinuous, open loop for adding or removing loose-leaf pages from the rings. An actuator is mounted on the housing for pivotal movement relative to the housing. The actuator includes a lower arm engageable with the lower surface of the ring support for moving the rings from their closed position to their opened position during pivotal movement of the actuator and an upper arm engageable with upper surface of the ring support for moving the rings from their opened position to their closed position. The lower arm of the actuator has a length and the upper arm of the actuator has a length. The length of the lower arm is greater than the length of the upper arm.

In yet another aspect, a ring binder mechanism for holding loose-leaf pages generally comprises a housing having longitudinal ends and a stop located adjacent at least one of its ends, and a ring support supported by the housing for movement relative to the housing. The ring support has an upper surface and a lower surface. The mechanism has a plurality of rings for holding the loose-leaf pages. Each ring includes a first ring member and a second ring member. The first ring member is mounted on the ring support for movement with the ring support relative to the housing between a closed position and an opened position. In the closed position, the first and second ring members cooperatively form a substantially continuous, closed loop for allowing loose-leaf pages retained by the rings to be moved along the rings from one ring member to the other. In the opened position, the first and second ring members form a discontinuous, open loop for adding or removing loose-leaf pages from the rings. An actuator is mounted on the housing for pivotal movement relative to the housing. The actuator is engageable with the ring support for moving the rings from their closed position to their opened position during pivotal movement of the actuator. The actuator has an engagement surface positioned and arranged to engage the stop during pivotal movement of the actuator to inhibit pivoting movement of the actuator relative to the housing in the direction that opens the rings.

In still a further aspect, a ring binder mechanism for holding loose-leaf pages generally comprises an elongate housing constructed of a polymeric material resiliently deformable for applying a spring force. The housing has longitudinal ends. A ring support is supported by the housing for movement relative to the housing. The ring support has an upper surface and a lower surface. The mechanism includes a plurality of rings for holding the loose-leaf pages. Each ring includes a first ring member and a second ring member. The first ring member is mounted on the ring support for movement with the ring support relative to the housing between a closed position and an opened position. In the closed position, the first and second ring members cooperatively form a substantially continuous, closed loop for allowing loose-leaf pages retained by the rings to be moved along the rings from one ring member to the other. In the opened position, the first and second ring members form a discontinuous, open loop for adding or removing loose-leaf pages from the rings. The housing spring force biases the ring support toward the opened position of the rings when the rings are proximate their opened position and biases the ring support toward the closed position of the rings when the rings are proximate their closed position. The housing spring force is the only spring force applied to the ring supports. At least one actuator is mounted on the housing for pivotal movement relative to the housing. The actuator is engageable with the ring support for moving the rings from their closed position to their opened position during pivotal movement of the actuator.

Other features will be in part apparent and in part pointed out hereinafter.

BRIEF DESCRIPTION OF THE DRAWINGS

Corresponding reference numbers indicate corresponding parts throughout the views of the drawings.

DETAILED DESCRIPTION OF THE DRAWINGS

Figure 1A:
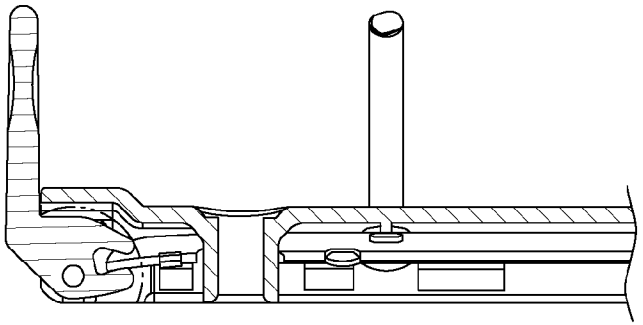
FIG. 1A PRIOR ART
FIG. 1A is a fragmentary section of a prior art ring binder mechanism having a housing and a lever in an upright position adjacent an end of the housing.
Figure 1B:
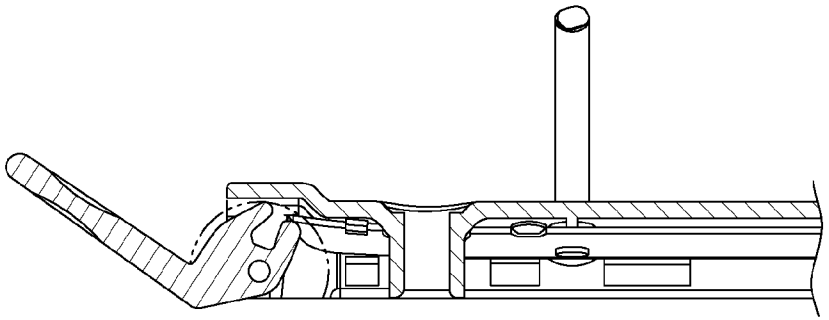
FIG. 1B PRIOR ART
FIG. 1B is a fragmentary section of the prior art ring binder mechanism of FIG. 1A with the lever pivoted away the housing.
Figure 1C:
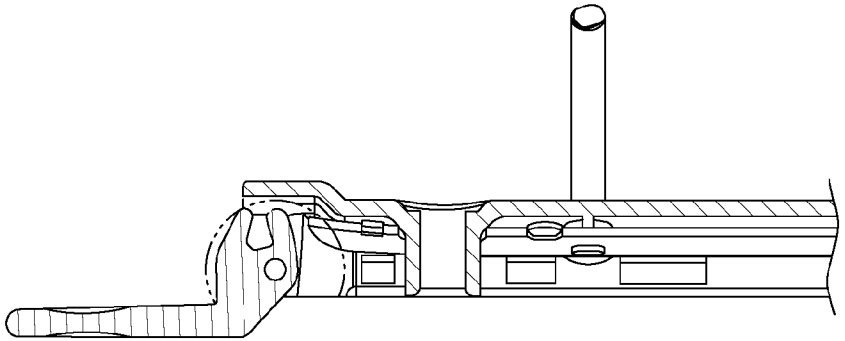
FIG. 1C PRIOR ART
FIG. 1C is a fragmentary section of the prior ring binder mechanism showing the lever in a disengaged position.
Figure 2:
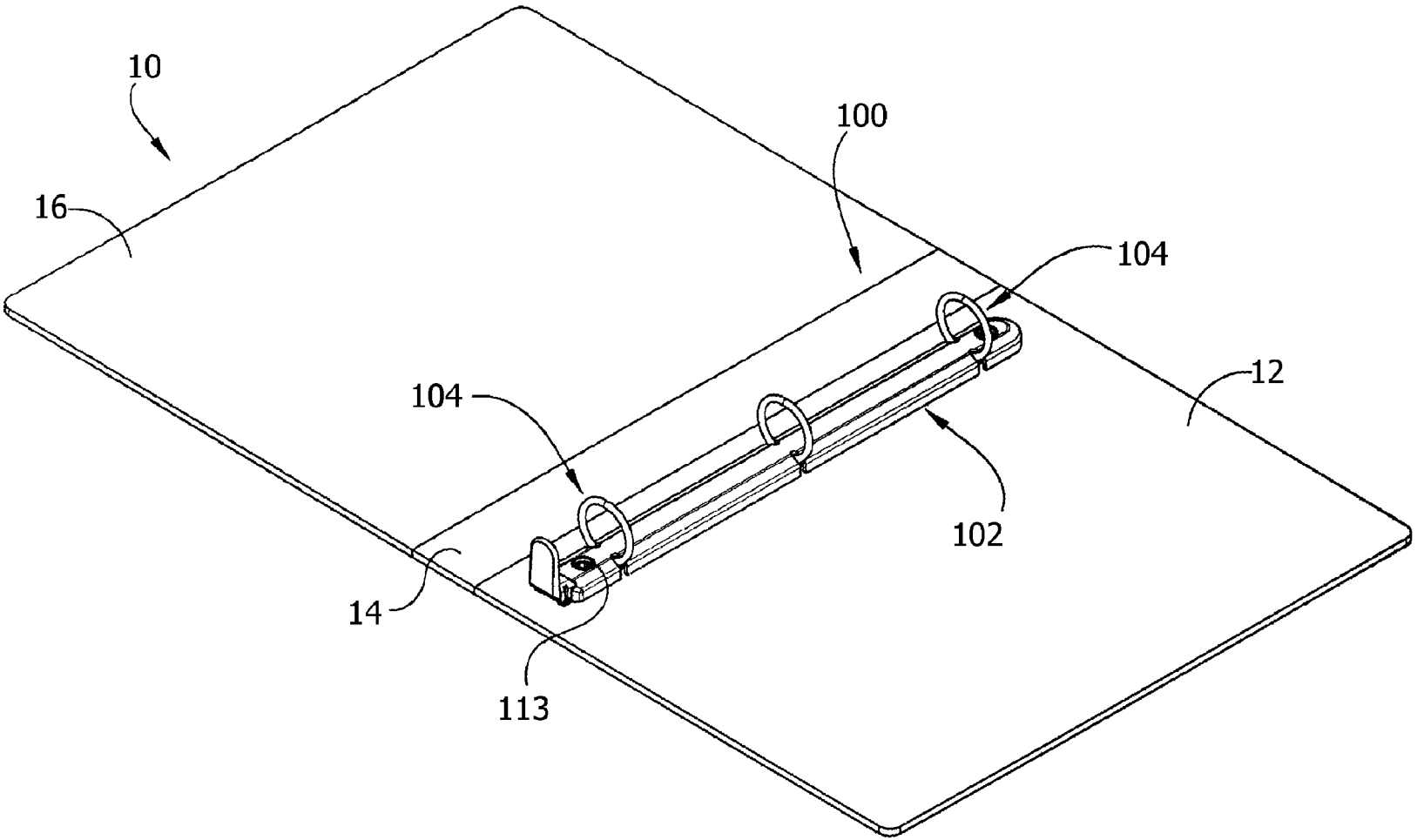
FIG. 2 is a perspective of one embodiment of a ring binder mechanism of the present invention secured to a notebook.
Figure 3:
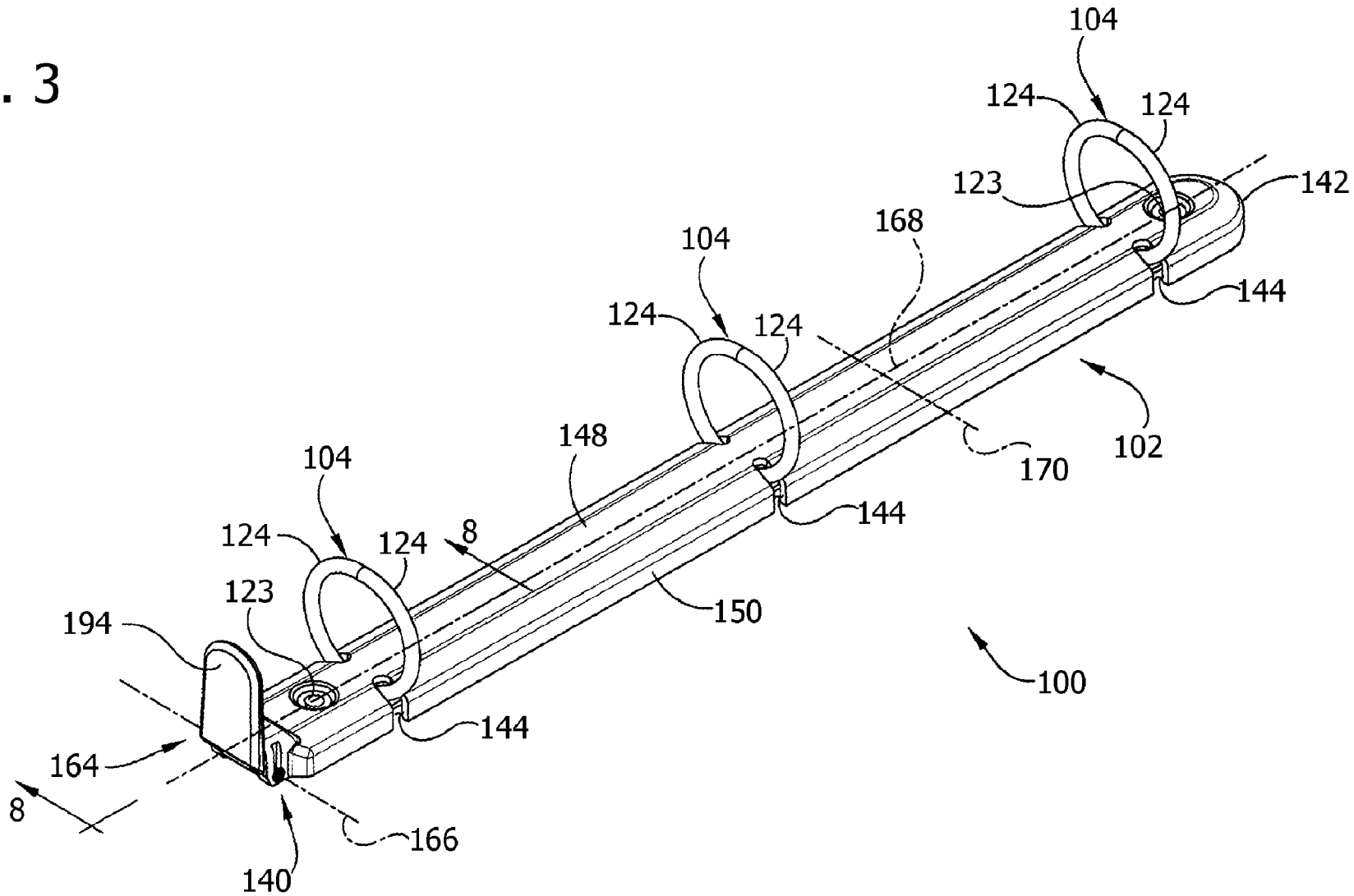
FIG. 3 is an enlarged perspective of the ring binder mechanism.
Figure 4:
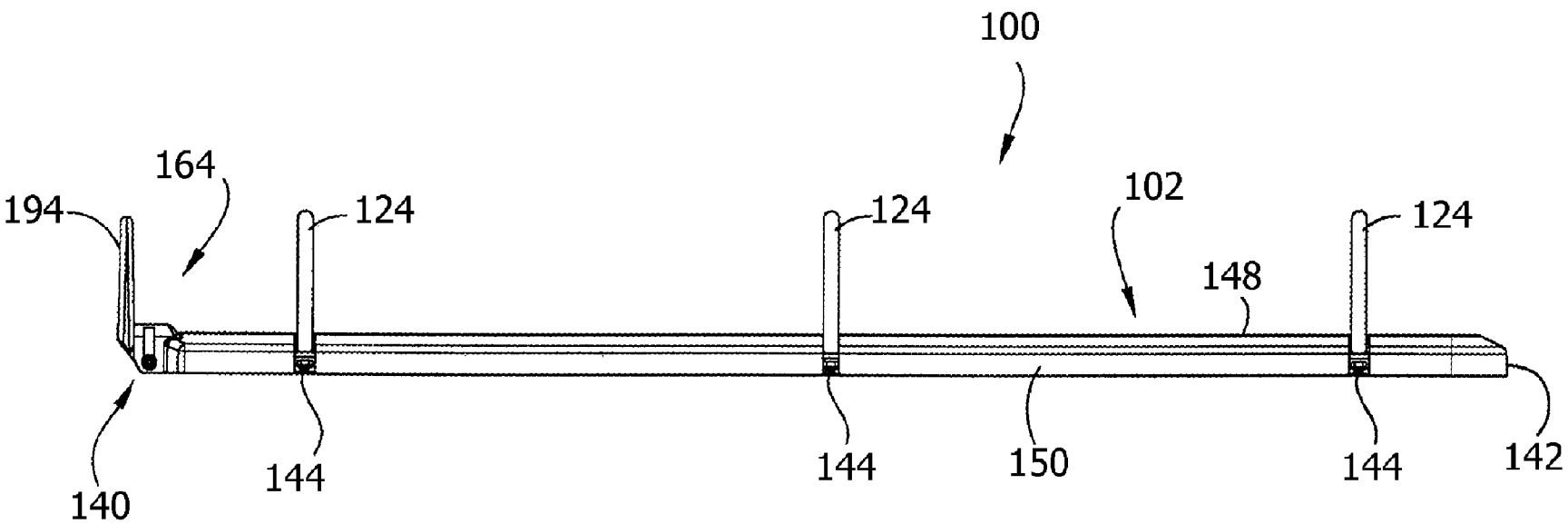
FIG. 4 is a side elevation of the ring binder mechanism.

Referring to the drawings, first to FIGS. 2-11 in particular, one embodiment of a ring binder mechanism is generally indicated at 100. This embodiment of the mechanism 100 includes a housing, designated generally at 102, supporting a pair of hinge plates 128 (broadly, "a ring support") and three rings, each of which is designated generally at 104. In FIG. 2, the mechanism 100 is shown mounted on a notebook designated generally at 10. Specifically, the mechanism 100 is shown mounted on the back cover 12 of the notebook 10 by means of rivets 113 generally adjacent to and aligned with the spine 14 of the notebook 10 securing the housing 102 to the notebook. The rivets 113 extend through attachment holes 123 at opposite ends of the housing 102. The front cover 16 of the notebook 10 is hingedly connected to the spine 14 and moves to selectively cover or expose loose-leaf pages (not shown) retained by the mechanism 100 in the notebook 10. Ring binder mechanisms mounted on notebooks in other ways (e.g., on the spine) or on surfaces other than a notebook (e.g., a file) do not depart from the scope of this invention. Ring binder mechanisms can also be in an unmounted state within the scope of the invention.

The housing 102 has an elongate shape comprising a central portion 148 and lateral sides 150 extending downward in generally vertical planes along either side of the central portion generally between opposite longitudinal ends 140, 142 spaced the length of the housing from one another. The arrangement of the central portion 148 and lateral sides 150 results in the housing having a generally concave cross-sectional configuration between the ends 140, 142. The housing 102 is constructed of a resilient polymeric material, such as Acrylonitrile butadiene styrene (ABS). For example, the housing can be made from materials and have characteristics described in co-pending U.S. application Ser. No. 11/852,006 and co-pending U.S. application Ser. No. 11/848,959, the contents of which are each hereby incorporated by reference. The entire housing 102 is molded as a single unitary piece as is the case for the embodiment illustrated in the drawings. However, the housing can include non-unitary features and can be manufactured in different ways, including by being constructed in multiple pieces that are later joined together to make the housing, without departing from the scope of the invention. The housing can also be made from non-polymeric (e.g., metallic) materials within the scope of the invention.

Figure 5:
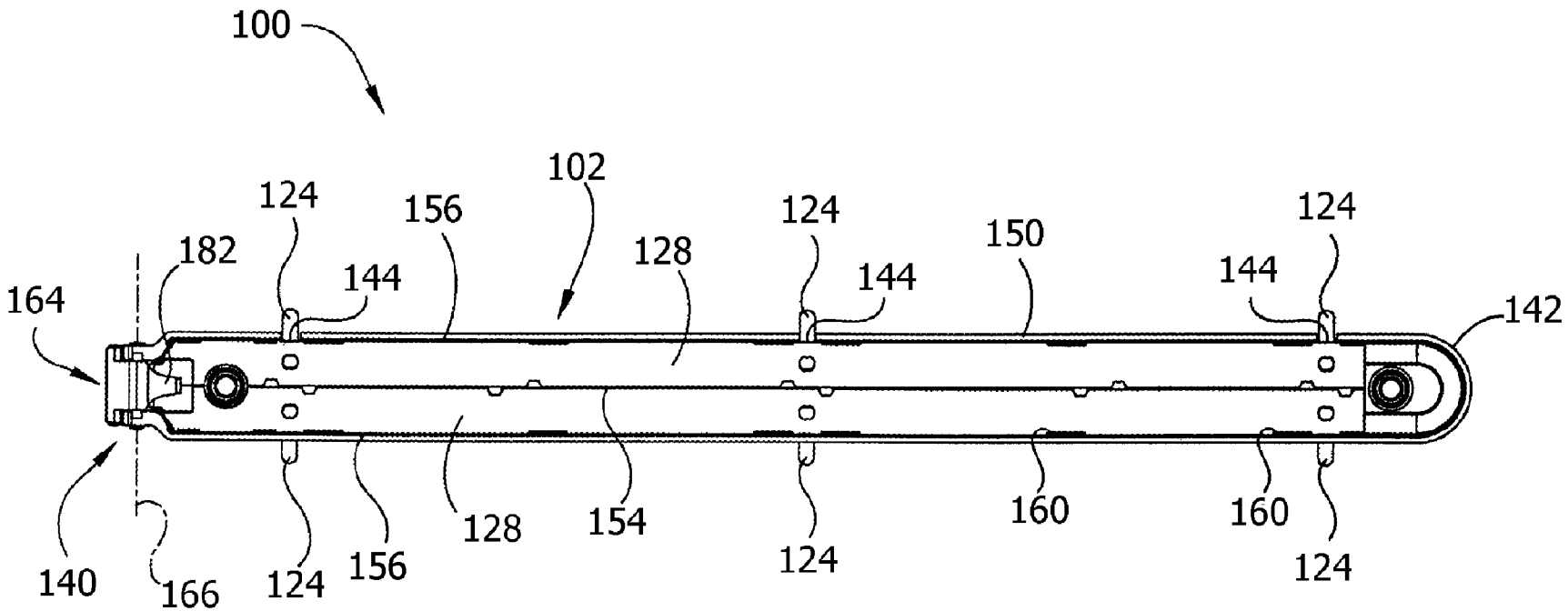
FIG. 5 is a bottom plan of the ring binder mechanism.
Figure 6:
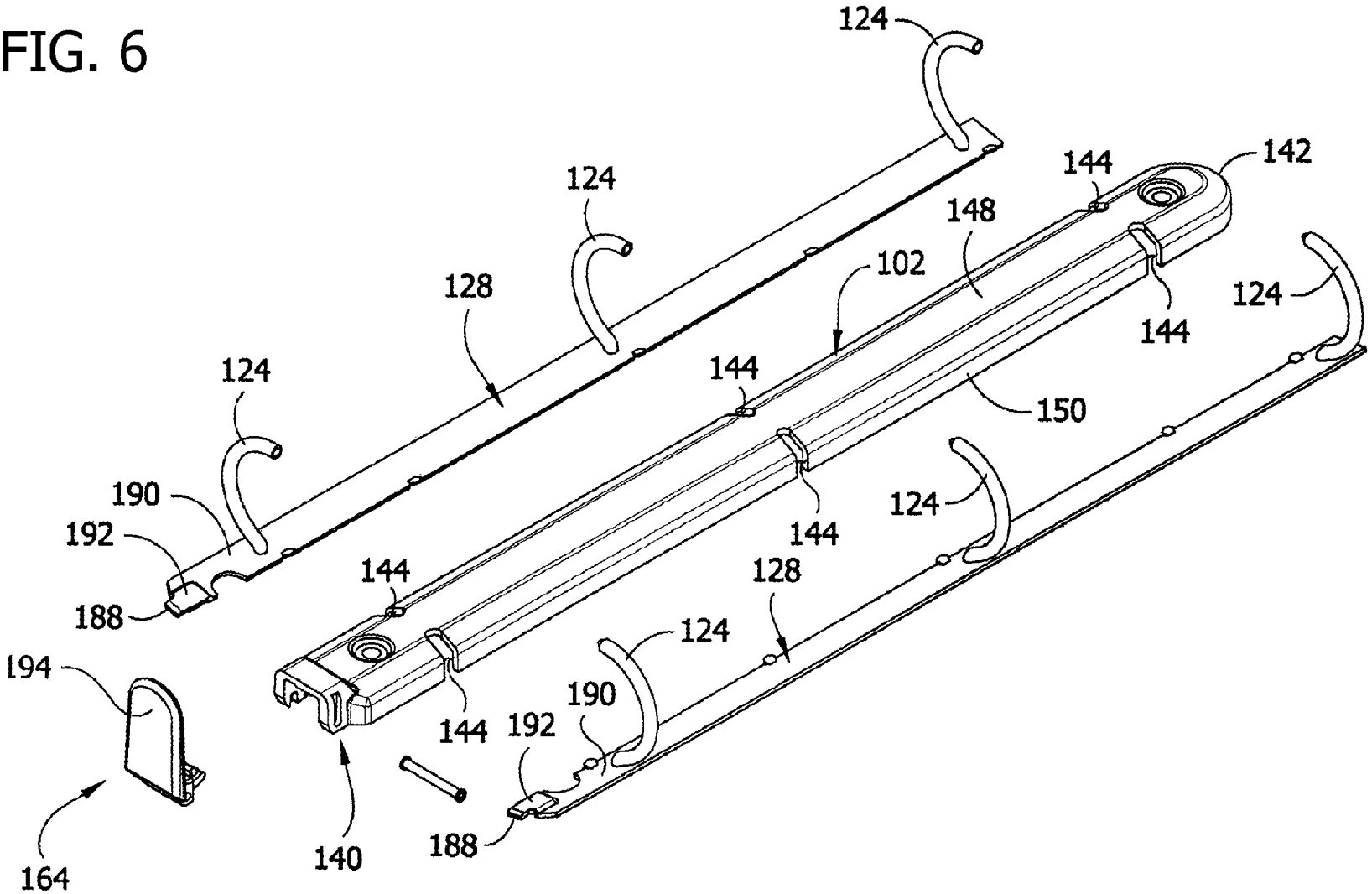
FIG. 6 is an exploded perspective of the ring binder mechanism.

The lateral sides 150 of the housing 102 in its undeformed state are spaced apart by a distance that is slightly less than the distance between the outer margins 156 of the interconnected hinge plates 128 when they are pivoted on the central hinge 154 to be coplanar with one another. The housing 102 is deformed from a fully relaxed or undeformed state even in the open and closed position so the housing continuously applies a spring force to the hinge plates 128 for holding them in the open and closed position, respectively. Other constructions for biasing the hinge plates 128 may be used within the scope of the present invention. The hinge plates 128 are supported by the housing 102 in a suitable manner such as by a plurality of hinge plate supports 160 projecting inwardly from the lateral sides 150 of the housing 102, as shown in FIG. 5. The hinge plate supports 160 are molded as one piece with the lateral sides 150 of the housing 102. The hinge plate supports 160 are engageable with the lateral edge margins 156 of the interconnected hinge plates 128 to retain the hinge plates in the housing 102 during operation of the ring binder mechanism 100.

The hinge plates 128 in this embodiment are generally mirror images of one another. The hinge plates 128 are each generally elongate, flat, and rectangular in shape, and are each somewhat shorter in length than the housing 102, as shown in FIG. 5. The hinge plates 128 are interconnected in side-by-side arrangement along their inner longitudinal margins, forming a central hinge 154 having a pivot axis for pivoting movement of the hinge plates relative to one another. This is may done in a conventional manner known in the art. The interconnected hinge plate 128 are disposed between the lateral sides 10 of the housing 102 such that the outer edge margins 156 of the hinge plates engage the lateral sides above the hinge plate supports 160, which retain the interconnected hinge plates 128 in the housing. As will be described, pivoting movement of the hinge plates 128 in the housing 102 is accompanied by movement of the central hinge 154 upward and downward relative to the housing as well as pivoting movement of outer edge margins 156 of the hinge plates relative to lateral sides 150 of the housing.

The rings 104 retain loose-leaf pages (not shown) on the ring binder mechanism 100 in the notebook 10. The three rings 104 of the ring binder mechanism 100 are substantially similar and are each generally circular in shape. The rings 104 each include two generally semi-circular ring members 124 formed from a conventional, cylindrical rod of a suitable material (e.g., steel). The ring members 124 include free ends 126 that are formed to secure the ring members against misalignment when they are closed together. The rings could be D-shaped as is known in the art, or shaped otherwise within the scope of this invention. Ring binder mechanisms with ring members formed of different material or having different cross-sectional shapes, for example, oval shapes, do not depart from the scope of this invention. Likewise the number of rings supported by the housing can vary within the scope of the invention.

One ring member 124 of each ring 104 is mounted on one of the interconnected hinge plates 128, while the other ring member of that ring is mounted on the opposite hinge plate. The ring members 124 extend through the openings 144 (e.g., slots, holes, or the like) in the housing 102 and are arranged so their free ends 126 face toward one another above the housing 102. The ring members 124 are moveable between an open position (FIG. 11) in which loose-leaf pages can be added to and/or removed front the ring binder mechanism 100 and a closed position (FIGS. 2 and 3) in which the free ends 126 of corresponding ring members 124 are joined to retain any loose-leaf pages then on the rings 104 in the binder mechanism.

In the illustrated embodiment, the ring members 124 are rigidly connected to the hinge plates 128 as is known in the art so the ring members move with the hinge plates when they pivot. Although in the illustrated ring binder mechanism 100 both ring members 124 of each ring 104 are each mounted on one of the two hinge plates 128 and move with the pivoting movement of the hinge plates 128, a mechanism in which each ring has one movable ring member and one fixed ring member does not depart from the scope of this invention (e.g., a mechanism in which only one of the ring members of each ring is mounted on a hinge plate with the other ring member mounted, for example, on the housing).

The ring binder mechanism 100 includes an actuator 164 operable to move the rings 104 from their closed position to their open position and from their open position back to their closed position. In this embodiment the actuator 164 is mounted at one end 140 of the housing 102 for pivotal movement of the actuator relative to the housing on a pivot axis 166. The pivot axis 166 is substantially perpendicular to a longitudinal axis 168 of the housing 102 and substantially parallel to a lateral axis 170 of the housing (e.g., an axis that is orthogonal to the longitudinal axis and oriented so it extends through each of the lateral sides 150 of the housing).

Figure 8:
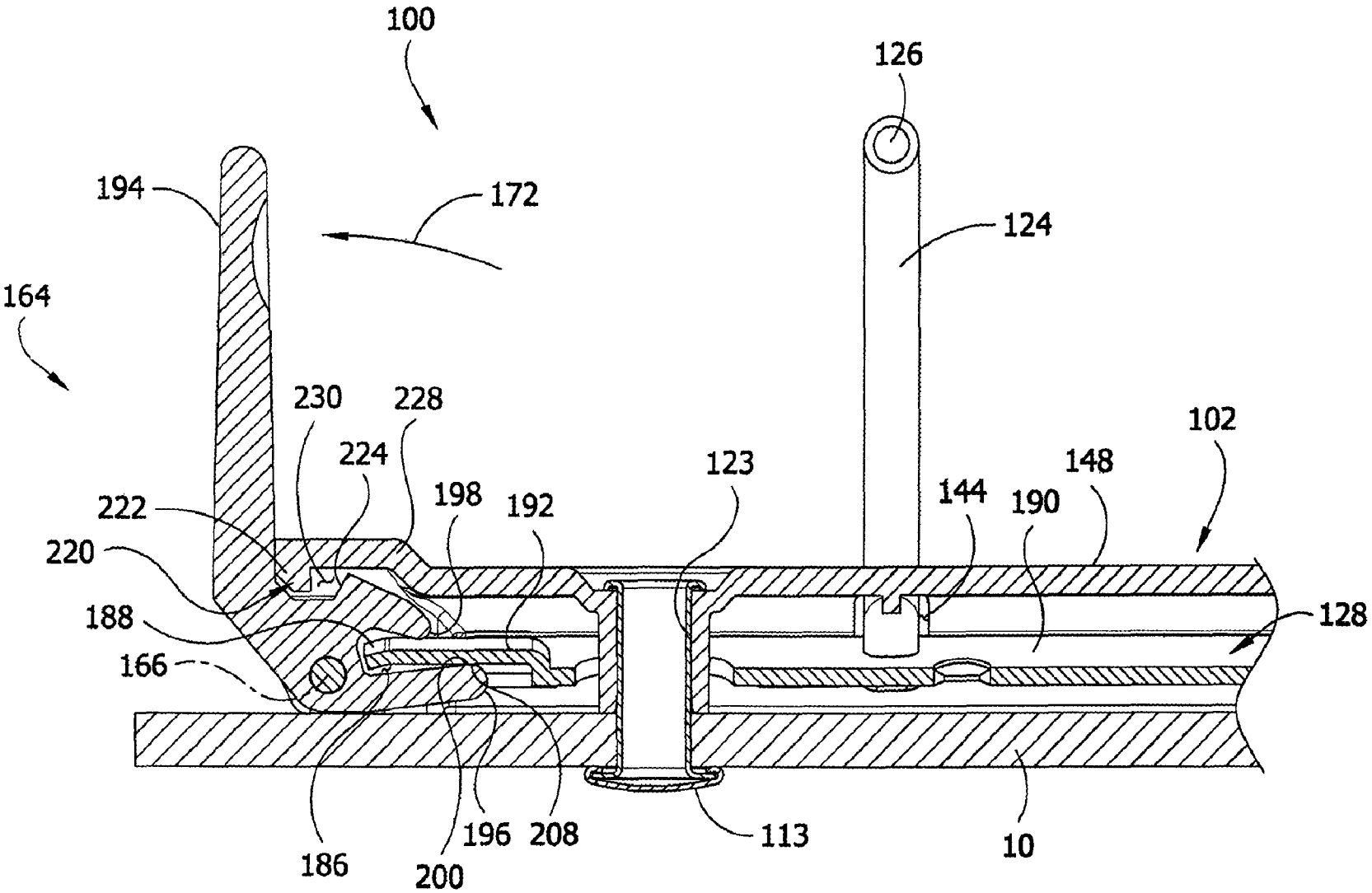
FIG. 8 is a fragmentary section of the ring binder mechanism taken in a plane including line 8-8 on FIG. 3.
Figure 8A:
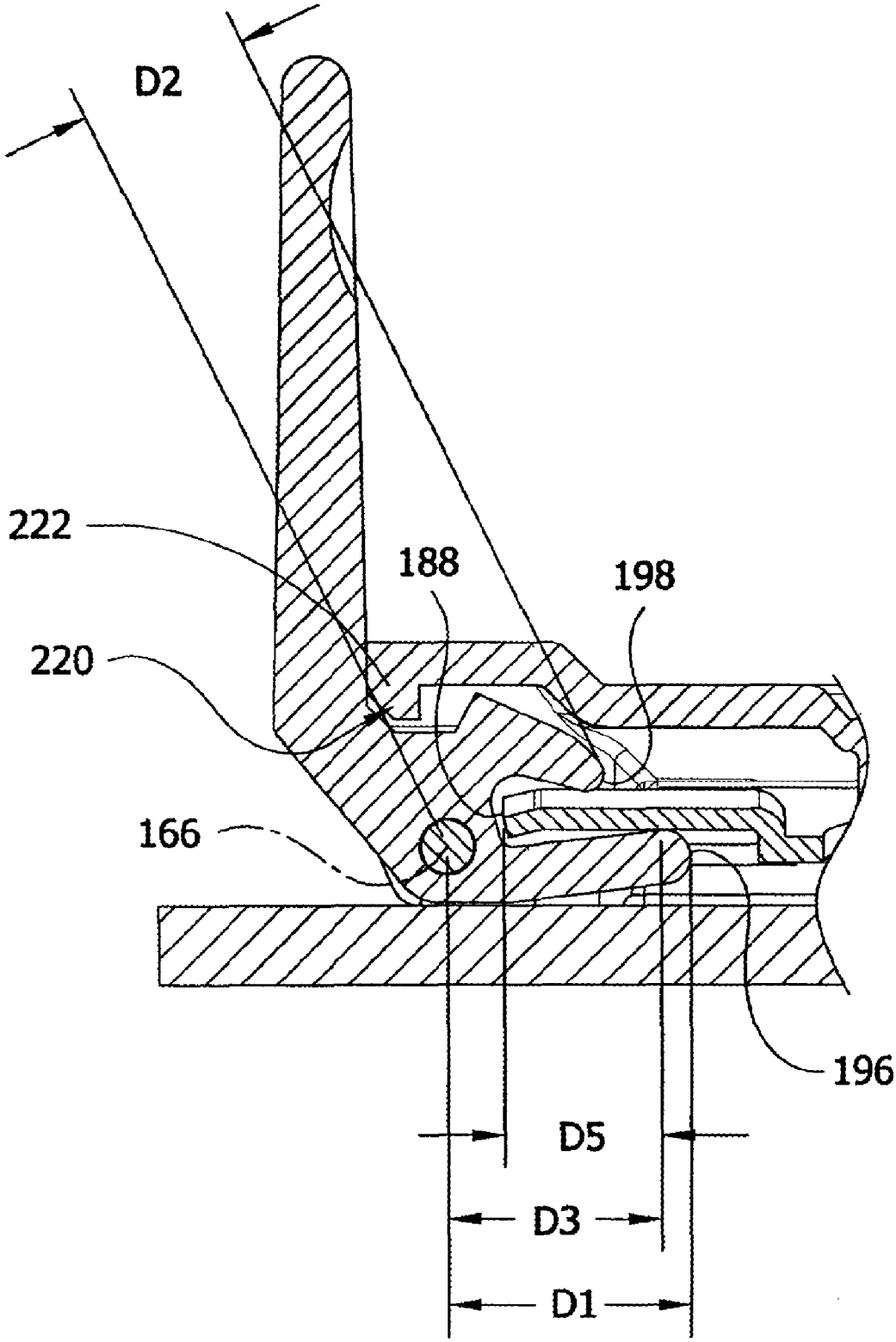
FIGS. 8A and 8B are the section of FIG. 8 but illustrating different spacings of components and surfaces of the ring binder mechanism.
Figure 8B:
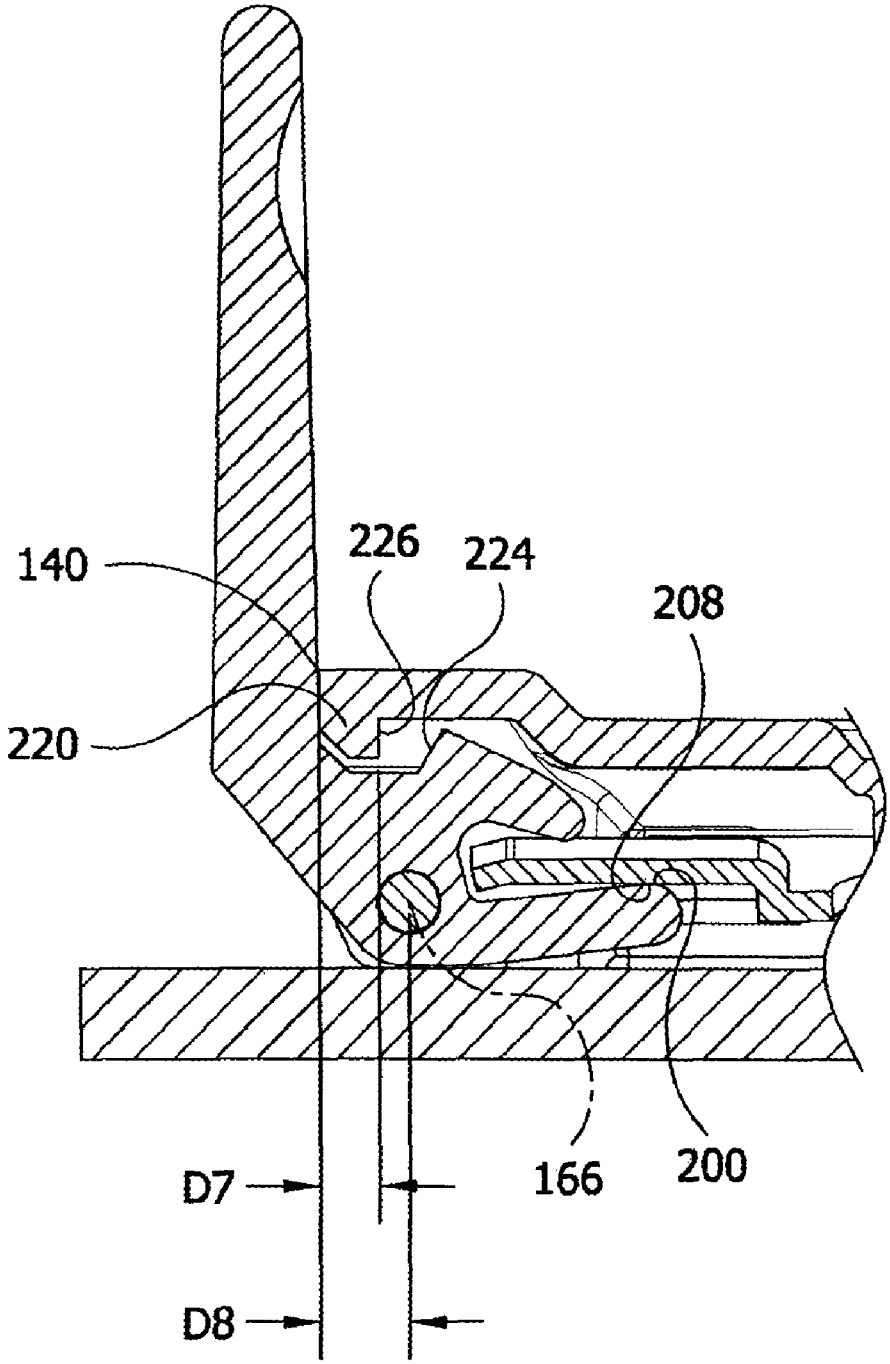

The actuator 164 is positioned and arranged so pivoting movement of the actuator on the pivot axis 166 in the direction of the arrow 172 shown on FIG. 8 when the rings 104 are closed causes the actuator to engage the hinge plates 128 and move the central hinge 154 upward in the housing 102, thereby pivoting the hinge plates and causing the rings to move from their closed position to their open position. In the embodiment shown in the drawings, the actuator 164 is also positioned and arranged so that pivoting movement of the actuator on the pivot axis in the reverse direction (indicated by the arrow 174 on FIG. 10) when the rings 104 are open causes the actuator to engage the hinge plates 128 and move the central hinge 154 downward in the housing 102, thereby pivoting the hinge plates and causing the rings to move from their open position to their closed position.

Referring to FIGS. 6-9, the actuator 164 in this embodiment of the ring mechanism has a yoke portion 180 including a lower arm 182 and an upper arm 184. The lower arm 182 of the yoke portion 180 extends from the pivot axis 166 between the lateral sides 150 of the housing 102 to a location adjacent the hinge plates 128 and on a side of the hinge plates opposite the central portion 148 of the housing for engaging the hinge plates during pivoting movement of the actuator to open the rings 104. The upper arm 184 of the yoke portion 180 extends from the pivot axis 166 between the lateral sides 150 of the housing 102 to a location adjacent the hinge plates 128 on a side of the hinge plates opposite the lower arm 182.

In this embodiment, the upper and lower arms 182, 184 together define a notch 186. The ends 188 of the hinge plates 128 are received in the notch 186. As illustrated in FIGS. 5 and 7-9, each of the hinge plates 128 in this embodiment includes a main body 190 and a finger 192 extending from the main body into the notch 186 and defining the end 188 of the respective hinge plate. The fingers 192 are narrower in width than the main body 190 of the hinge plates 128. Further, the end 188 of each of the fingers 192 is offset upward from the main body 190 of the respective hinge plate. This offset facilitates alignment of the ends 188 of the fingers 192 with the notch 186. The offset also facilitates lowering the elevation of the main bodies 190 of the hinge plates in the housing 102 so the central portion 148 of the housing can be spaced closer to the notebook 10 when it is secured thereto, allowing the housing to have a lower profile. However it is to be understood that the fingers 192 may be omitted without departing from the scope of the present invention. The actuator 164 also includes a lever arm 194 extending from the pivot axis 166 to a location exterior of the housing 102 for use in gripping and pivoting of the actuator by a user. The yoke portion 180 of the actuator 164 comprises a unitary body forming the upper and lower arms 182, 184. The unitary body also includes at least a portion of the lever arm 194, which may also include an elastomeric cover or grip portion (not shown) within the scope of the invention.

Figure 10:
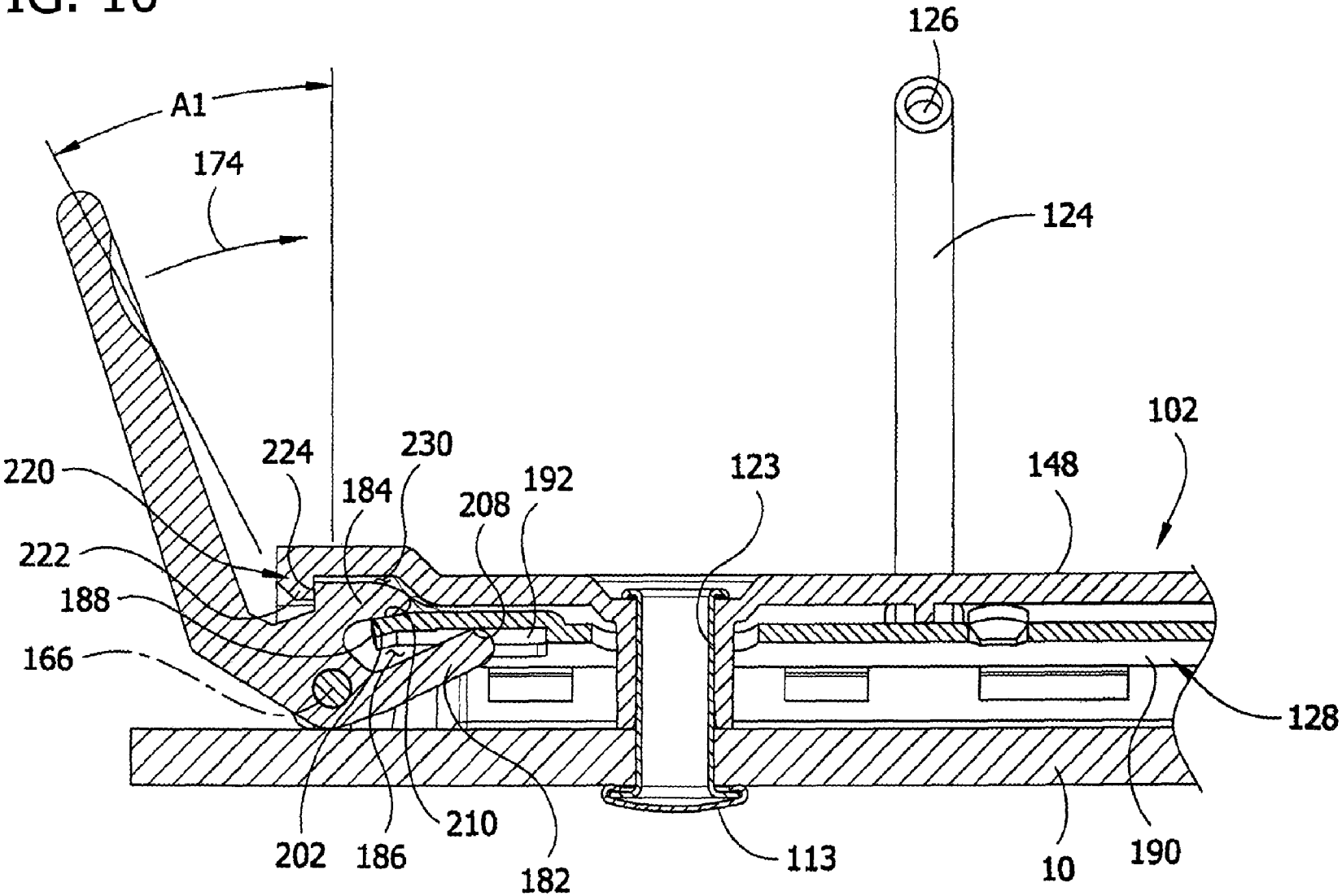
FIGS. 10 and 10A are fragmentary sections of the ring binder mechanism similar to FIGS. 8-8B showing the actuator in a terminal position after it has been used to open the rings of the ring binder.
Figure 10A:
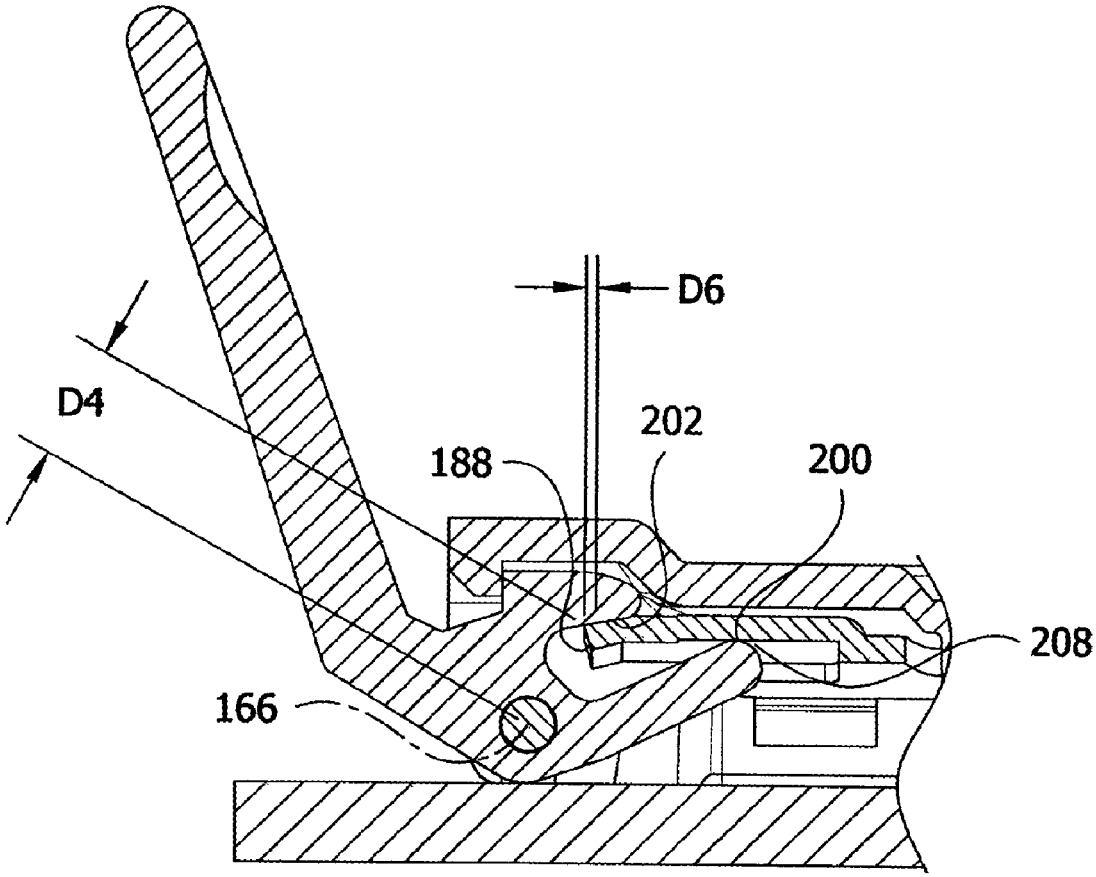
Figure 11:
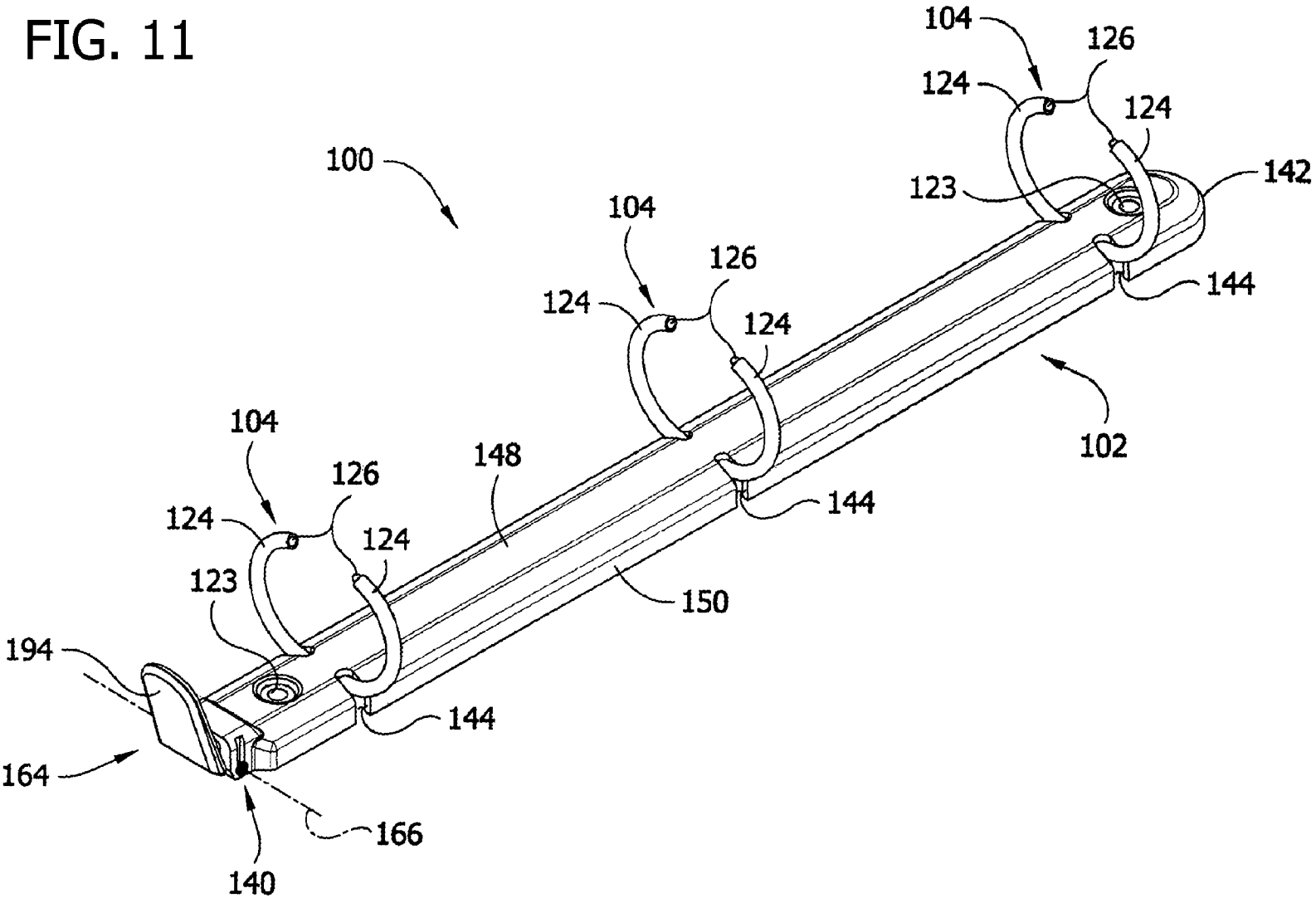
FIG. 11 is a perspective of the ring binder mechanism with the actuator in its terminal position and the rings in their opened position.

The actuator 164 is positioned and arranged so that the actuator can open the rings 104 upon pivoting movement of the actuator through a relatively small angle A1 (FIG. 10). For example, in one embodiment the actuator 164 is operable to move the rings 104 from their closed position to their open position upon pivoting movement of the actuator through an angle A1 in the range of about 16 degrees to about 24 degrees. In another embodiment, the actuator 164 is operable to move the rings 104 from their closed position to their open position upon pivoting movement of the actuator through an angle A1 that is no more than about 24 degrees. Because the actuator 164 is operable to open the rings 104 upon pivoting movement through a relatively small angle A1, the actuator is more responsive to users' efforts to open the rings. This embodiment of the actuator 164 also reduces the amount of play in the actuator perceived by the user.

Figure 7:
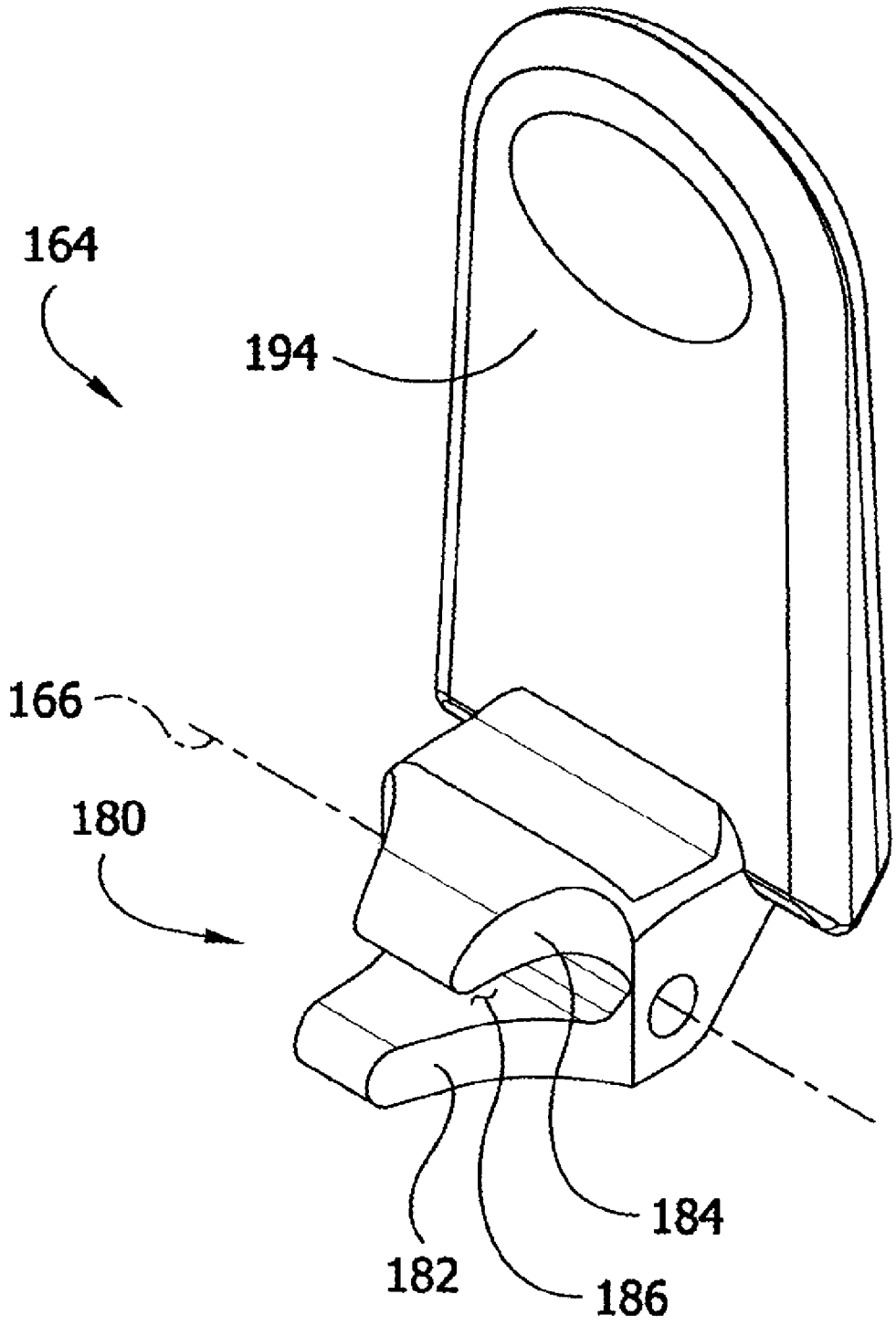
FIG. 7 is an enlarged perspective of an actuator of the ring binder mechanism.
Figure 9:
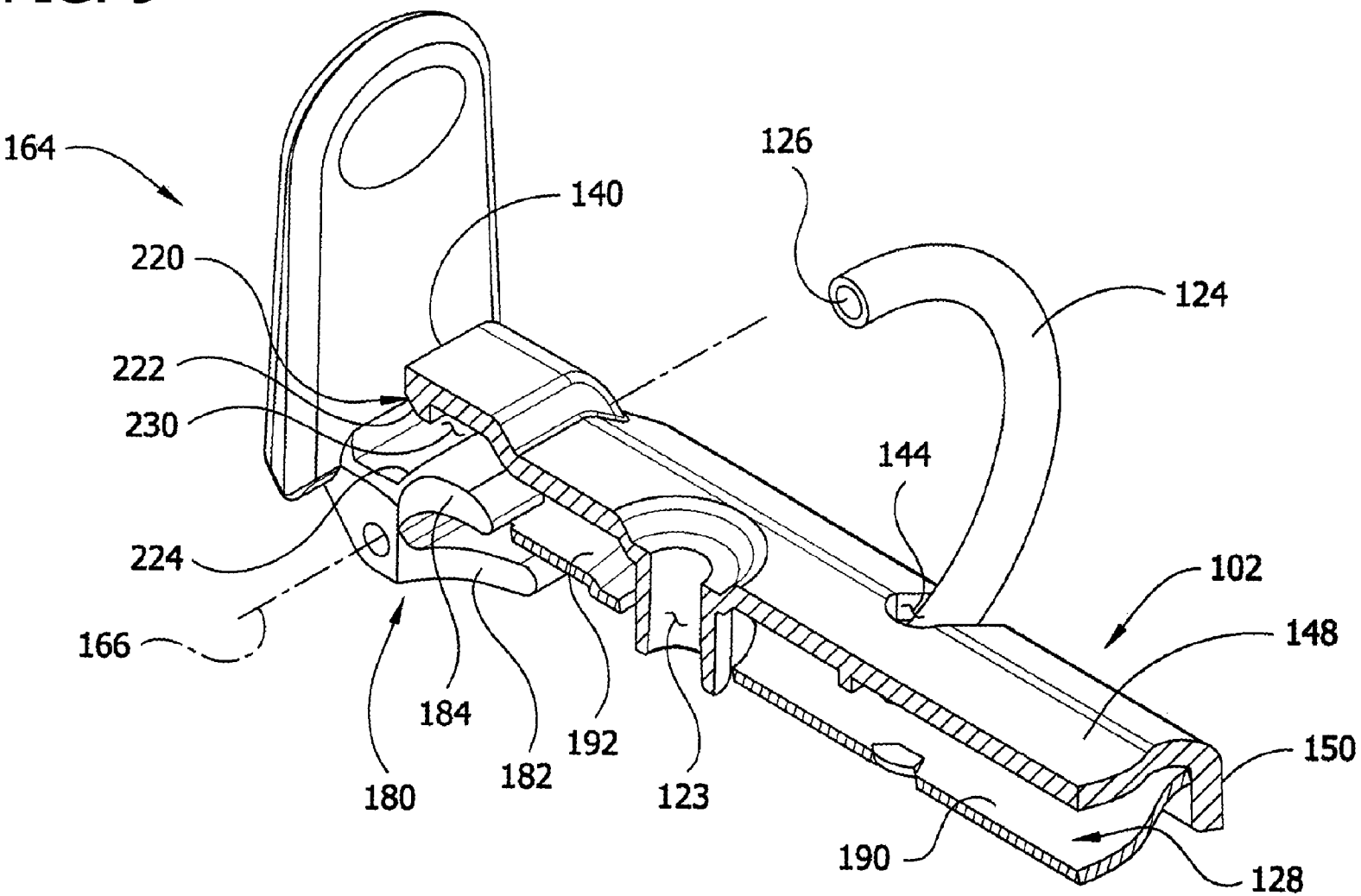
FIG. 9 is a perspective of a portion of the ring binder mechanism with the housing and one hinge plate being partially broken away and one hinge plate removed.

In the illustrated embodiment, the lower arm 182 of the actuator 164 is relatively long (in comparison to the upper arm 184), which facilitates opening of the rings 104 upon movement of the actuator through the relatively smaller angle A1. As illustrated in FIGS. 7-9, for example, the distal end 196 of the lower arm 182 of the illustrated embodiment is spaced a relatively longer distance D1 from the pivot axis 166 and the distal end 198 of the upper arm 184 is spaced a relatively shorter distance D2 from the pivot axis. In one embodiment of the invention, the distal end 196 of the lower arm 182 is spaced from the pivot axis 166 a distance D1 of at least about 6.5 mm. In another embodiment, the distal end 196 of the lower arm 182 is spaced from the pivot axis 166 a distance D1 in the range of about 6.5 mm to about 10.5 mm.

As illustrated in FIGS. 8-8B and 10-10A, the lower arm 182 has a contact surface 200 that contacts the lower surfaces of hinge plates 128 during pivoting movement of the actuator 164 to open the rings 104. Likewise, in the illustrated embodiment, the upper arm 184 has a contact surface 202 that contacts the upper surfaces of the hinge plates 128 during pivoting movement of the actuator 164 to close the rings. It will appreciated that different parts of the arms 182, 184 of the actuator 164 will contact that hinge plates 128 at various intermediate positions of the actuator and hinge plates between the open and closed position. As used herein, the phrase "contact surface" used in reference to interactions between the actuator 164 and hinge plates 128 includes all parts of one of the actuator and hinge plates that contact the respective other of the hinge plates and actuator anytime during pivoting movement of the actuator to open or close the rings 104.

In one embodiment of the invention, the nearest edge of the contact surface 200 on the lower arm 182 is spaced distance D3 from the pivot axis 166 and the nearest edge of the contact surface 202 on the upper arm 184 is spaced a distance D4 from the pivot axis that is shorter than D3. In one embodiment, for example, the distance D3 between the contact surface 200 on the lower arm 182 and the pivot axis 166 is at least about 6 mm. In another embodiment, the distance D3 between the contact surface 200 on the lower arm 182 and the pivot axis is between about 6 mm and about 9 mm. The fingers 192 of the hinge plates 128 have contact surfaces 208, 210 on their lower and upper surfaces that contact the upper and lower arms 182, 184 of the actuator, respectively. In one embodiment of the invention, the nearest edge of the contact surface 208 on lower side of the hinge plates 128 is spaced from the ends 188 of the hinge plates a distance D5 and the nearest edge of the contact surface 210 on the upper side of the hinge plates is spaced a distance D6 from the ends 188 of the hinge plates that is shorter than D5. For example, the distance 05 in one embodiment is at least about 0.5 mm longer than the distance D6. In another embodiment, the distance 05 is longer than the distance D6 by an amount in the range of about 0.5 mm to about 1.0 mm. In one embodiment, the distance D5 may range from about 4 mm to about 7 mm. In another embodiment the distance D6 may range from about 3.3 mm to about 6.3 mm. However, other distances may be used within the scope of the invention, and in particular the distance D6 may be zero.

The housing 102 is configured to define a stop 220 that limits pivoting movement of the actuator 164 after the rings 104 have been opened. As illustrated in FIGS. 7 and 7A, for example, the stop 220 of the illustrated embodiment includes a projection 222 (e.g., barb) extending down from the central portion 148 of the housing 102. The stop 220 is integrally formed (e.g., molded) with the rest of the housing 102. However, the stop 220 can be made separate from the other parts of the housing and later secured to the housing within the scope of the invention. As illustrated in FIG. 8, the stop 220 has an engagement surface 226 spaced a distance D7 from the adjacent end 140 of the housing 102 that is less than a distance D8 between the pivot axis 166 and the adjacent end of the housing. The stop 220 is positioned and arranged relative to the actuator 164 so that a surface 224 of the actuator (e.g., a surface on the upper arm 184) engages the stop after the actuator has pivoted relative to the housing 102 in the direction of the arrow 172 that causes the rings 104 to open to a terminal position (FIG. 10). The surface 224 projects out from the actuator 164 so that it is able to engage the general vertical surface of the stop 220 generally flush in the open position. Further, the engagement between the actuator 164 and the stop 220 limits pivoting movement of the actuator relative to the housing 102 in the direction 172 that opens the rings 104 beyond the terminal position.

In the illustrated embodiment, a raised portion 228 of the housing 102 defines a recess 230 at one end 140 in the central portion 148 thereof adjacent the stop 220. The recess 230 provides clearance for the upper arm 184 as the actuator 164 approaches the terminal position during pivoting of the actuator during opening of the rings 104. The presence of the recess 230 at the end 140 of the housing 102 provides the clearance required for pivoting movement of the actuator 164 without increasing the overall profile of the housing. Further, the presence of the recess 230 adjacent the stop 220 allows the stop to have a larger contact surface 226 for engaging the actuator.

When the mechanism 100 is at rest, the ring members 124 and hinge plates 128 are normally at their closed position.

When a user wants to open the rings 104, he or she can grasp the lever arm 194 and use it to pivot the actuator 164 in the direction 172 shown in FIG. 8. This causes the contact surface 200 on the lower arm 182 of the yoke portion 180 of the actuator 164 to engage the contact surface 208 on the lower side of the hinge plates 128. As the user continues to pivot the actuator 164 in this direction 172, the lower arm 182 pushes the central hinge 154 of the hinge plates 128 upward in the housing 102, thereby causing the hinge plates to pivot relative to one another and the housing. The ring members 124 pivot with the hinge plates 128, thereby moving from their closed position to their open position. In one embodiment, the opening movement of the rings 104 is completed upon pivoting movement of the actuator 164 through a relative small angle A1 (e.g., an angle in the range of about 16 to about 24 degrees). In another embodiment, the opening movement of the rings 104 is completed upon pivoting movement of the actuator 164 through an angle A1 (FIG. 10) of no more than about 24 degrees.

As the actuator 164 is pivoted to open the rings 104, the yoke portion 180 (and in particular the upper arm 184 of the yoke portion) is received in the recess 230 defined in the central portion 148 of the housing 102. As the pivoting movement of the actuator 164 that is required to open the rings 104 nears completion, the yoke portion 180 of the actuator (and in particular the upper arm 184) approaches the stop 220. The actuator 164 engages the stop 220 when it arrives at its terminal position. It is possible for a user to perceive engagement of the actuator 164 with the stop 220 as a tactile sensation providing feedback indicating that further movement of the actuator is not required to open the rings 104. Moreover, the stop 220 limits further pivoting movement of the actuator 164 in the opening direction 172 beyond the terminal position, thereby facilitating the retaining of the actuator on the housing 102.

When the user wants to close the rings 104, he or she can grasp the lever arm 194 and use it to pivot the actuator 164 in direction of the arrow 174 (FIG. 10). This causes the contact surface 202 on the upper arm 184 of the actuator 164 to engage the contact surface 210 on the upper side of the hinge plates 128. As the user continues to pivot the actuator 164 in the direction of the arrow 174, the upper arm 184 pushes the central hinge 154 of the hinge plates 128 down in the housing 102, causing the hinge plates to pivot relative to one another and the housing. The ring members 124 pivot with the hinge plates 128 to their closed position.

Figure 12:
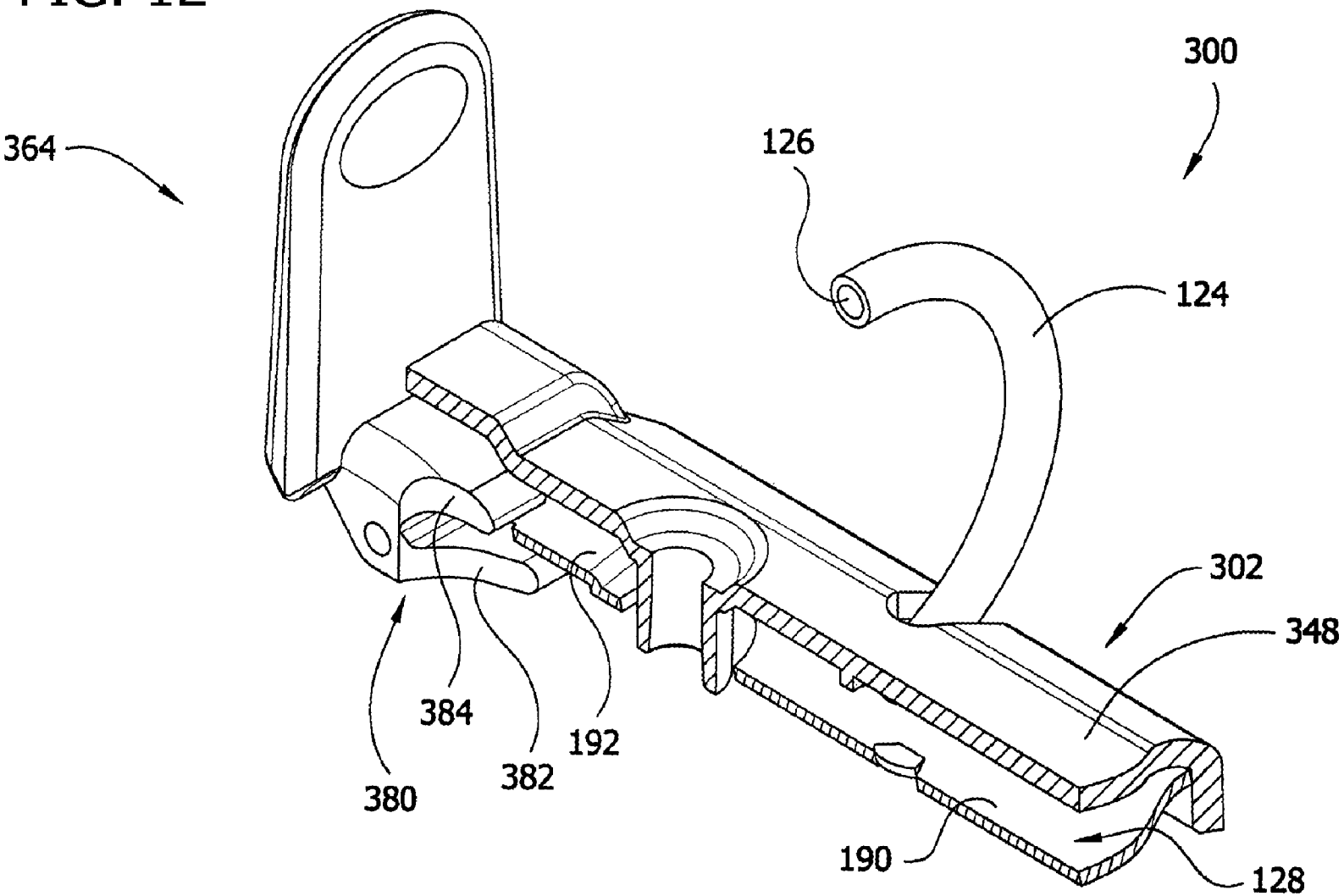
FIG. 12 is a perspective similar to FIG. 9 showing a second embodiment of a ring binder mechanism.
Figure 13:
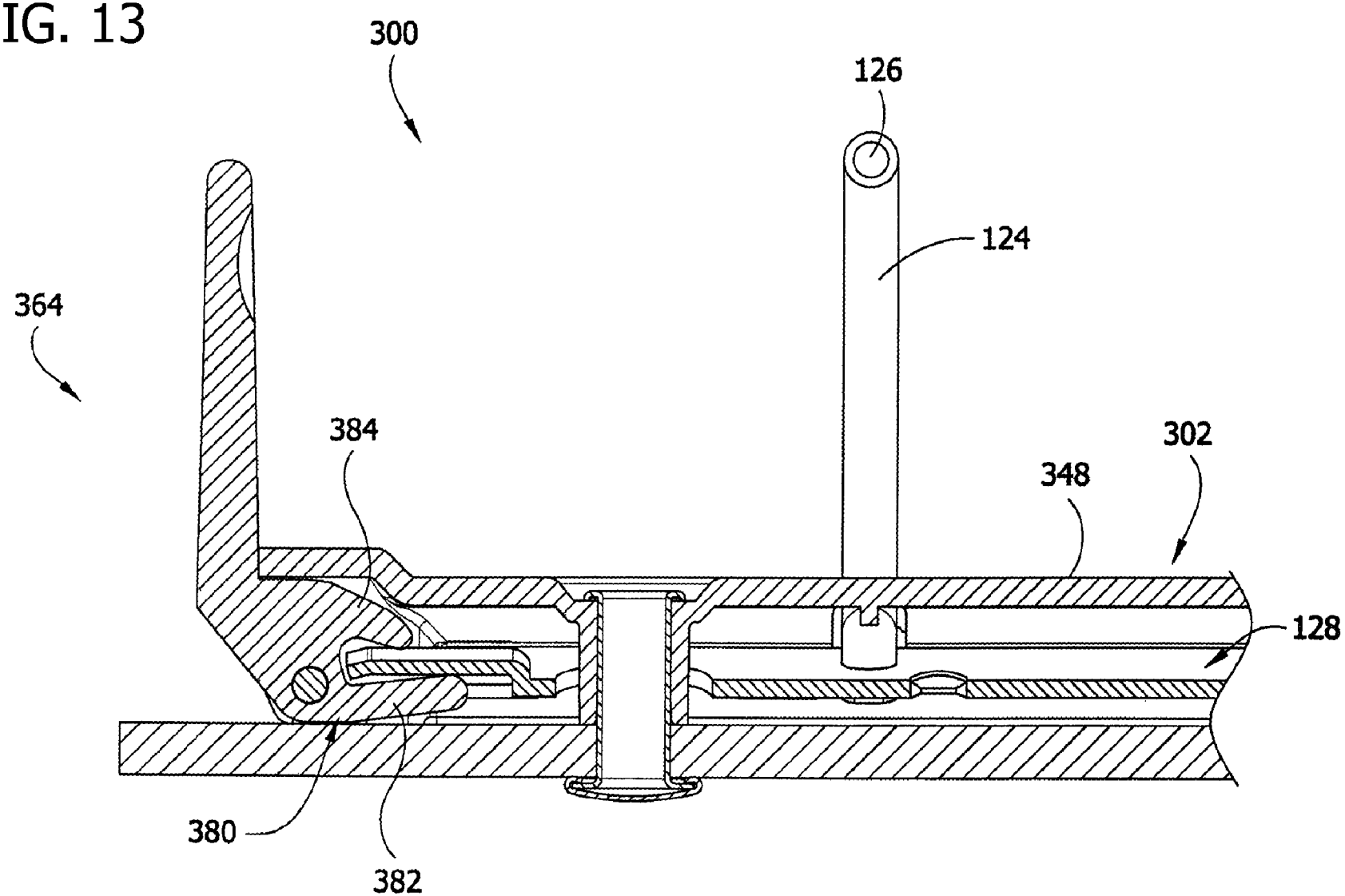
FIG. 13 is a fragmentary section similar to FIG. 8 but illustrating the second embodiment.
Figure 14:
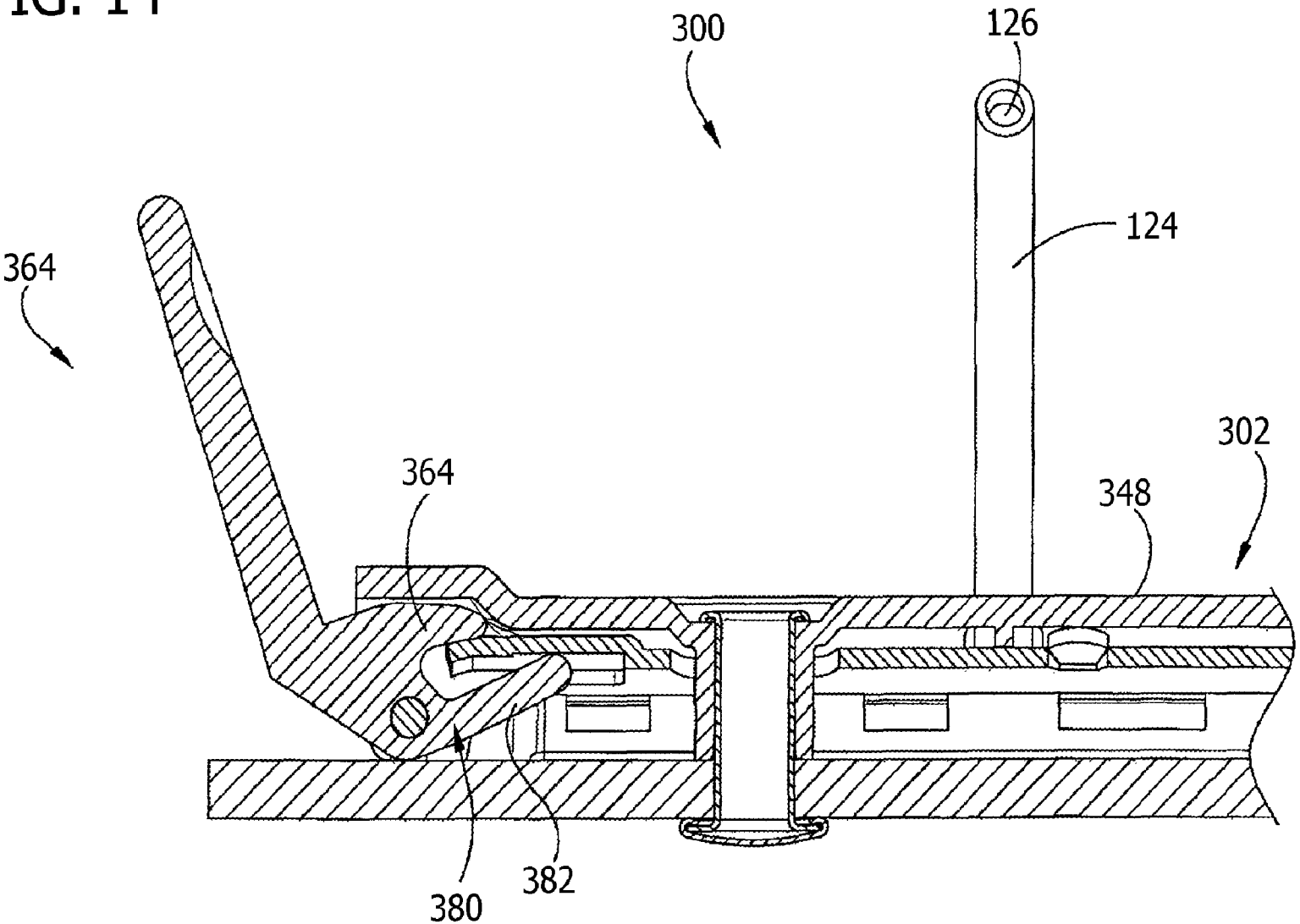
FIG. 14 is a fragmentary section similar to FIG. 10 but showing the second embodiment with the actuator in its terminal position after it has been used to open the rings.

FIGS. 12-14 illustrate a second embodiment of a ring binder mechanism of the present invention, generally designated 300. Except as noted this embodiment of the ring binder mechanism 300 is constructed and operated in substantially the same way as the ring binder mechanism 100 described above. As best illustrated in FIG. 13, the housing 302 in this embodiment does not define a stop. Further, the upper arm 384 of the yoke portion 380 lacks a surface adapted to engage a stop. On the other hand, the lower arm 382 of the yoke portion 380 of the actuator 364 is relatively longer, as described above. Further, the actuator 364 and hinge plates 128 have contact surfaces 200, 202, 208, 210 that are spaced and arranged as described above. Moreover, the actuator 364 is operable to open the rings 104 upon movement of the actuator through the relatively small angle A1 (e.g., in the range of about 16 to about 24 degrees) as described above. After the user has pivoted the actuator 364 to its terminal position (FIG. 14), further pivoting movement of the actuator 364 in the opening direction is prevented by engagement of the actuator and/or hinge plates 128 with the housing 102 (e.g., the central portion 148 thereof).

Figure 15:
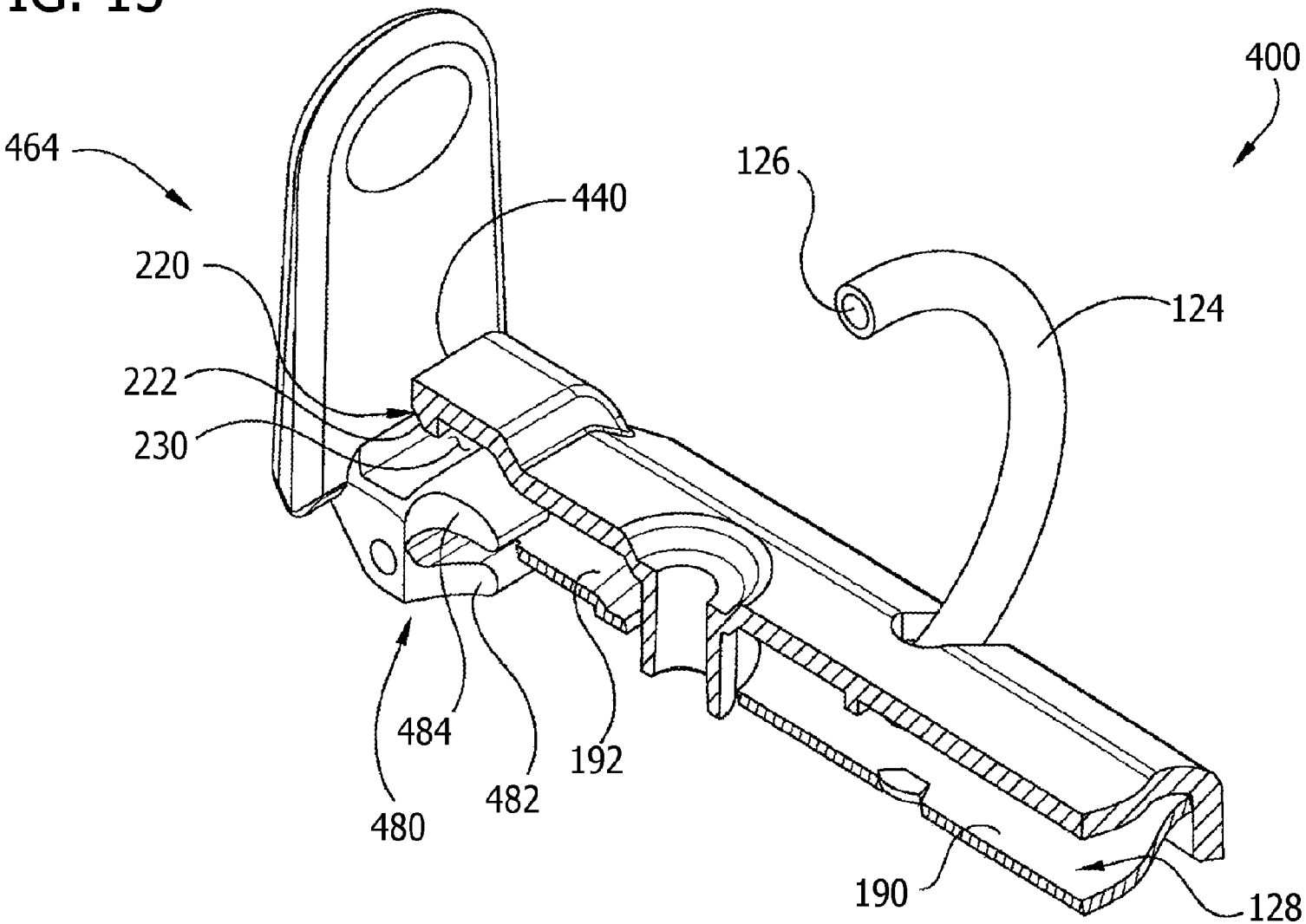
FIG. 15 is a perspective similar to FIGS. 9 and 12 but illustrating a third embodiment.
Figure 16:
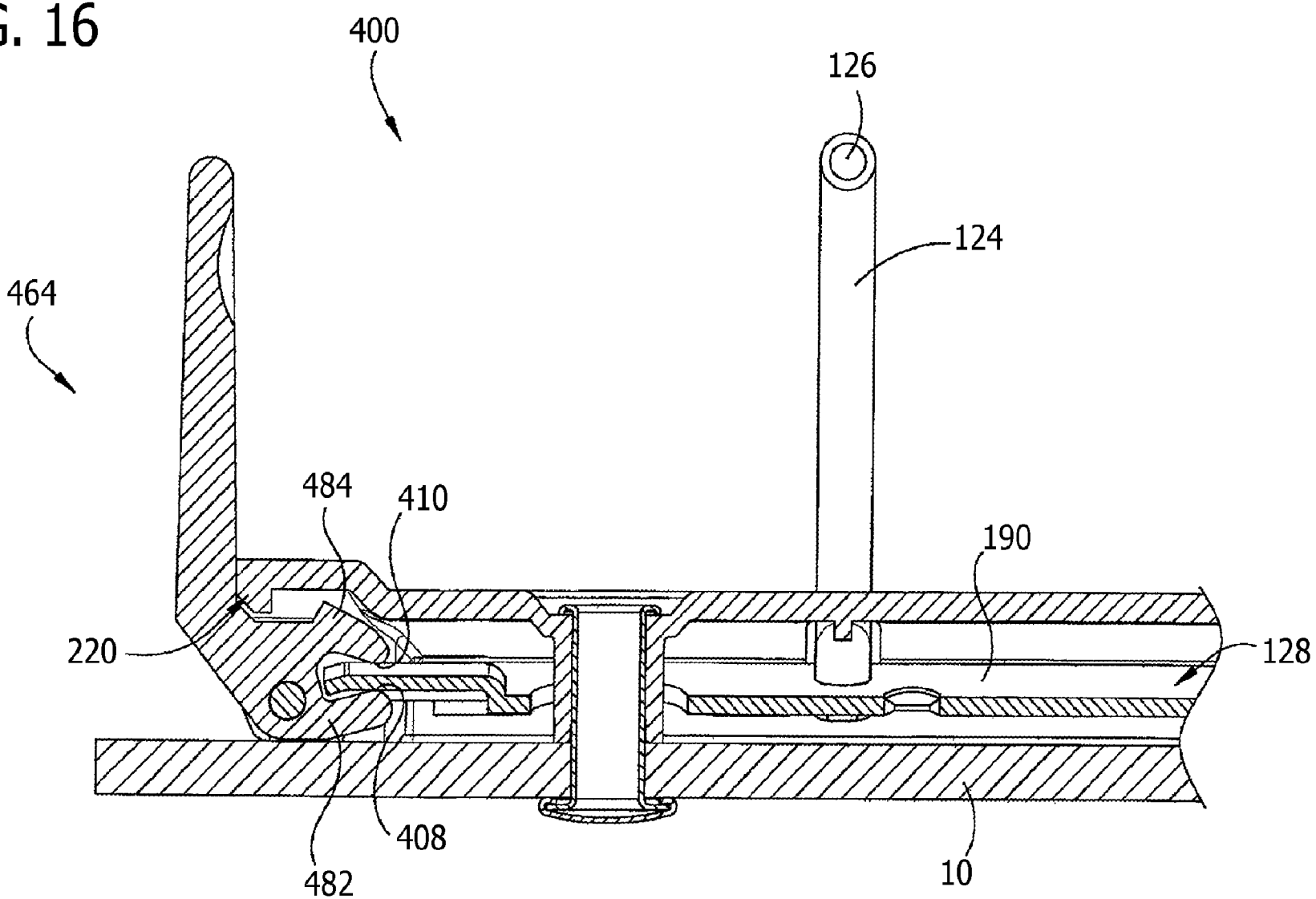
FIG. 16 is a fragmentary section similar to FIGS. 10 and 13 but showing the third embodiment.
Figure 17:
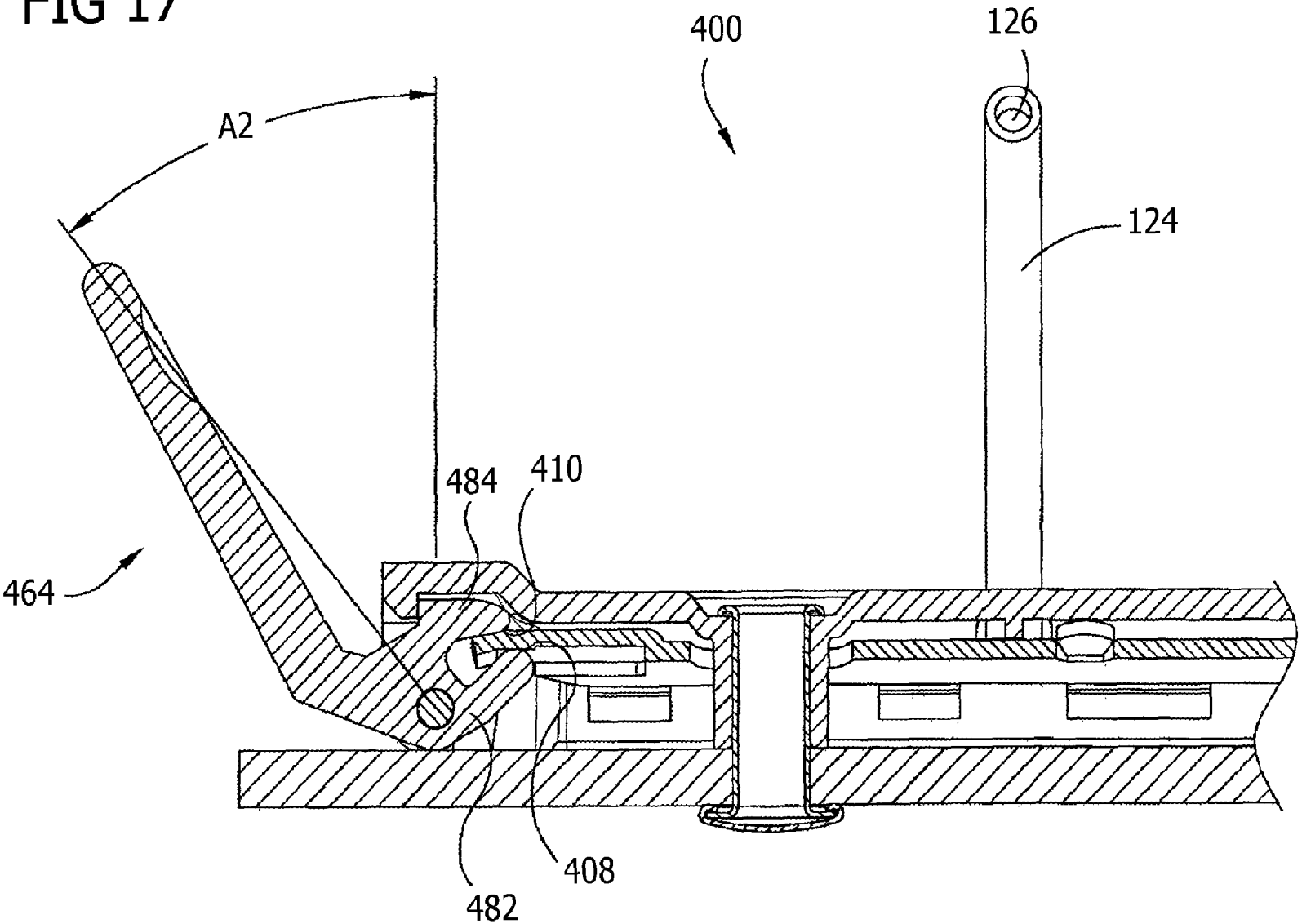
FIG. 17 is a cross section of the third embodiment similar to FIGS. 11 and 14 showing the actuator in its terminal position after it has been used to open the rings.

FIGS. 15-17 illustrate a third embodiment of a ring binder mechanism of the present invention, generally designated 400. Except as noted, this embodiment of the ring binder mechanism 400 is constructed and operated in substantially the same way as the ring binder mechanism 100 described above. As best illustrated in FIG. 16, the lower arm 482 of the actuator 464 of this embodiment is not substantially longer than the upper arm 484. Instead the contact surface 410 of the hinge plates 128 with the upper arm 484 and the contact surface 408 of the hinge plates with the lower arm 482 are either in registration with one another on opposite sides of the hinge plates or nearly in registration with one another. The actuator 464 in this embodiment is operable to complete opening movement of the rings upon pivoting movement of the actuator through a relatively larger angle A2. In one embodiment, the actuator 464 is operable to complete opening movement of the rings 104 upon pivoting movement of the actuator through an angle A2 of at least about 26 degrees. In another embodiment, the actuator 464 is operable to complete opening movement of the rings 104 upon pivoting movement of the actuator through an angle A2 in the range of about 26 degrees to about 35 degrees. In this embodiment, the housing 102 does define a stop 220 that is engaged by the actuator 464 upon arrival of the actuator at its terminal position (FIG. 17) in substantially the same way described above, except that the actuator is rotated through the larger angle A2 to move from its initial position (FIG. 15) to its terminal position than the actuator 164 described above.

Figure 18:
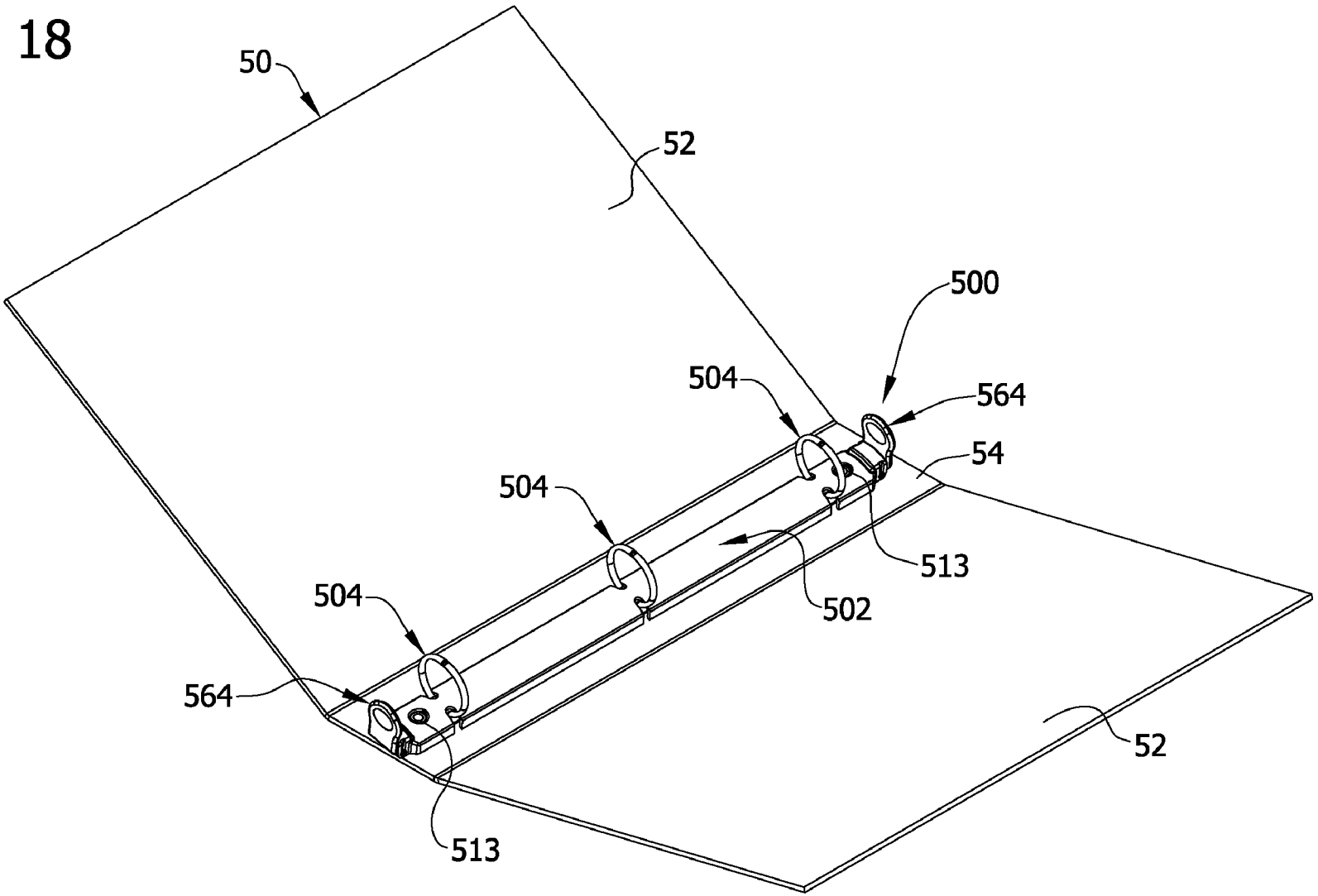
FIG. 18 is a perspective of a fourth embodiment of a ring binder mechanism secured to a notebook.

Referring to the drawings, FIGS. 18-34 illustrate a fourth embodiment of a ring binder mechanism, generally indicated at 500. In FIG. 18, the mechanism 500 is seen mounted on a notebook, which is designated generally at 50. The notebook 50 has a back cover 52, a spine 54, and a front cover 56. The front and back covers 56, 52 of the notebook 50 are hingedly connected to the spine 54 and are selectively moveable to cover or expose loose-leaf pages (not shown) retained by the ring binder mechanism 500. In the illustrated embodiment, the ring binder mechanism 500 is shown mounted on the spine 54 of the notebook 50 using rivets 513. It is contemplated that the ring binder mechanism 500 can be mounted on other parts of the notebook 50 (e.g., on the back cover 52), using different types of fasteners (i.e., prong fasteners, screws), or on surfaces other than a notebook (e.g., a file) without departing from the scope of this invention. It is also contemplated that the ring binder mechanism 500 can be unmounted and be within the scope of the invention.

Figure 19:
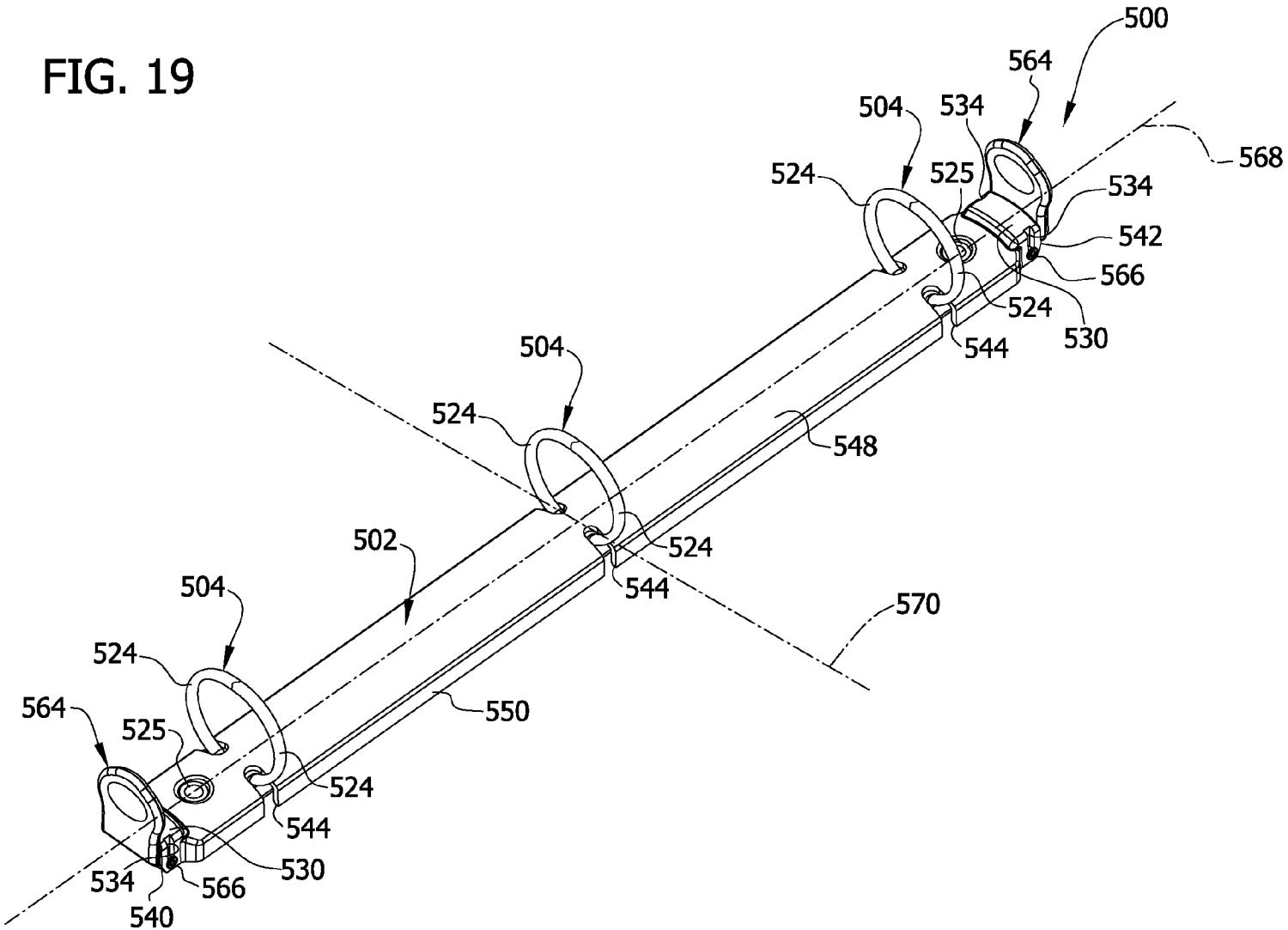
FIG. 19 is a perspective of the ring binder mechanism removed from the notebook.
Figure 20:
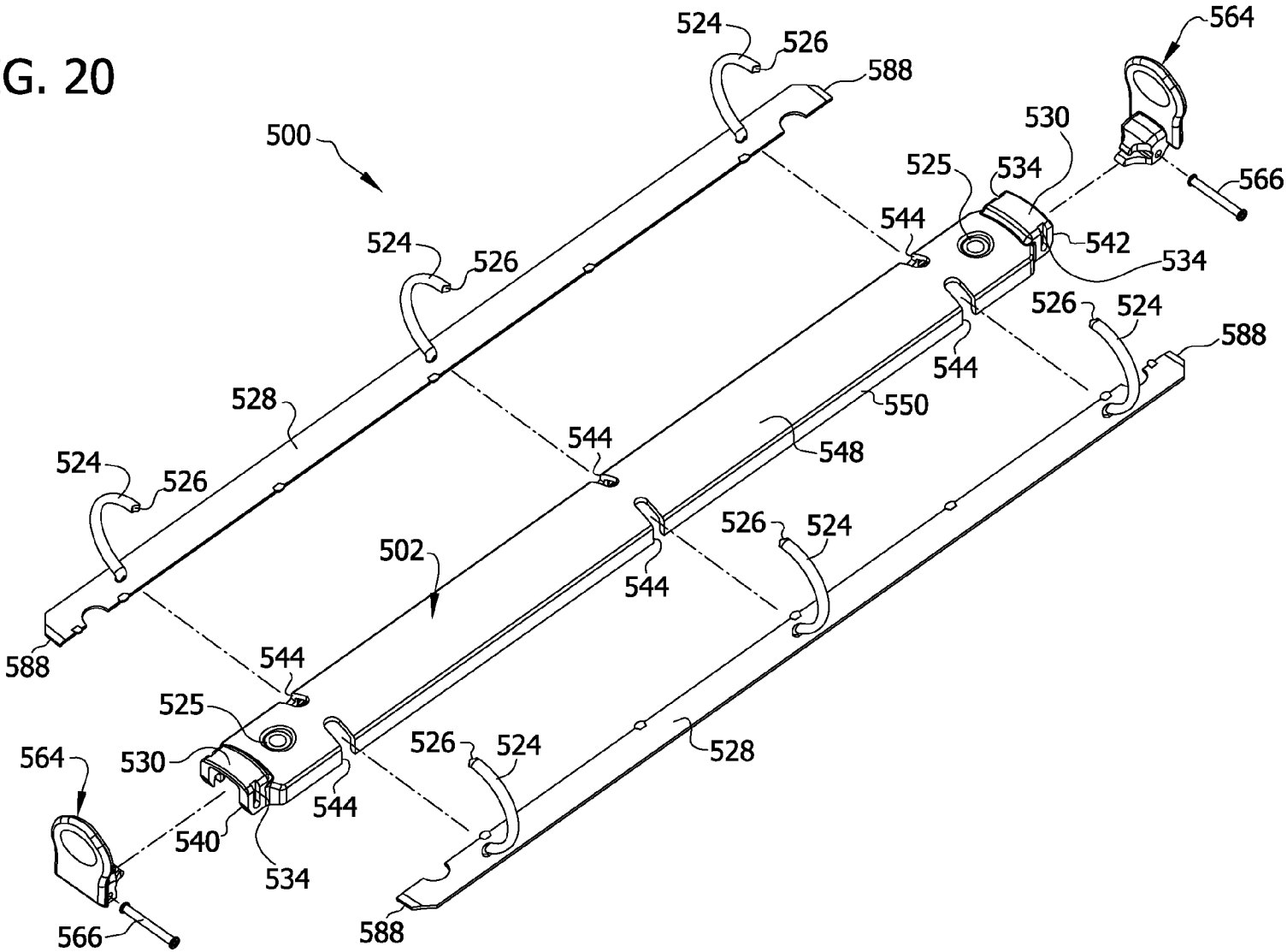
FIG. 20 is an exploded perspective of the ring binder mechanism.
Figure 21:
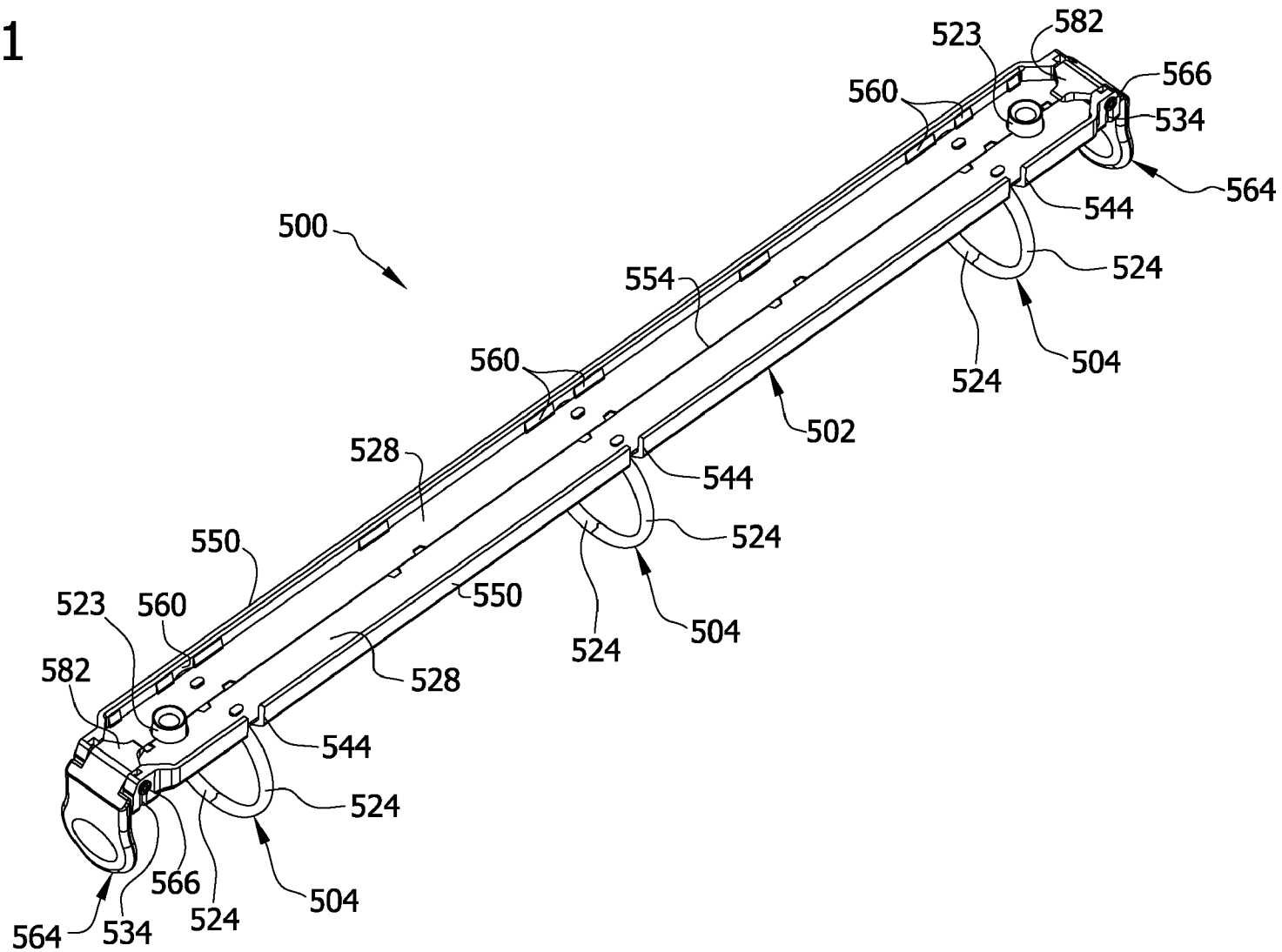
FIG. 21 is a bottom side perspective of the ring binder mechanism.
Figure 25:
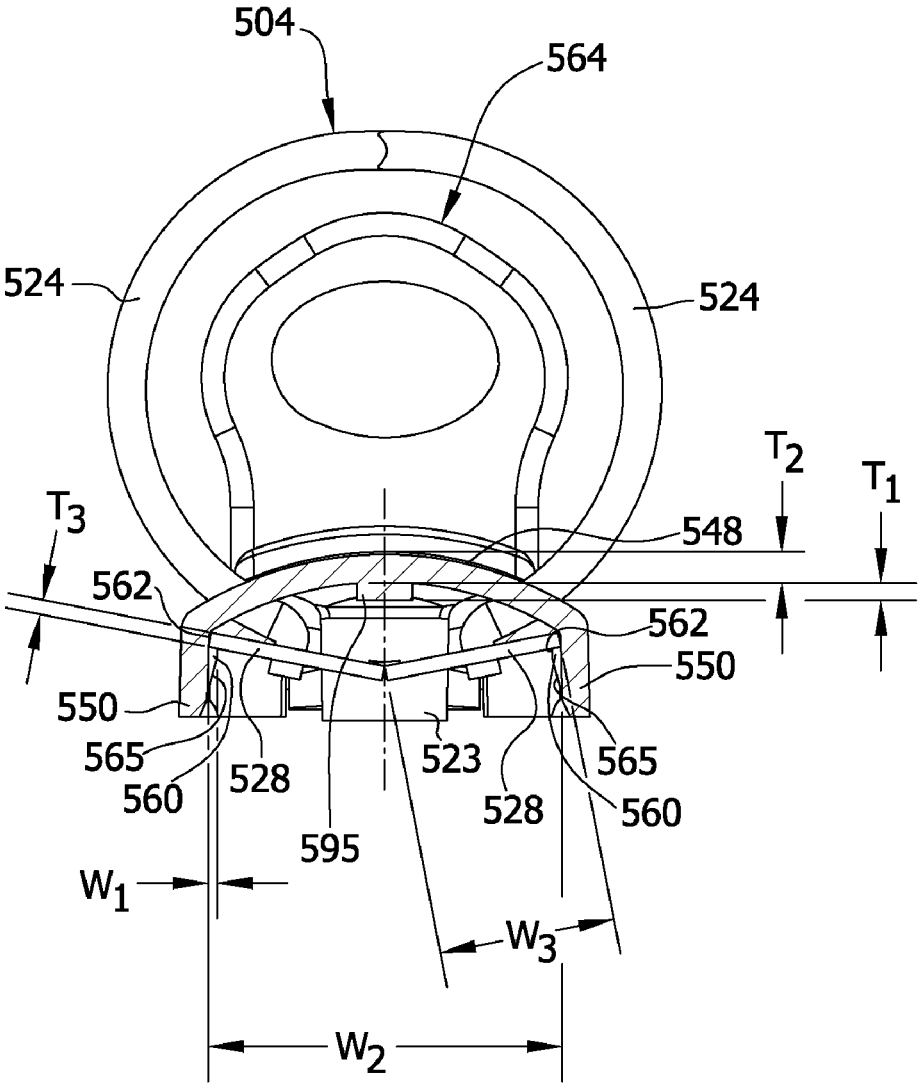
FIG. 25 is a cross section of the ring binder mechanism taken along line 25-25 on FIG. 23.
Figure 26:
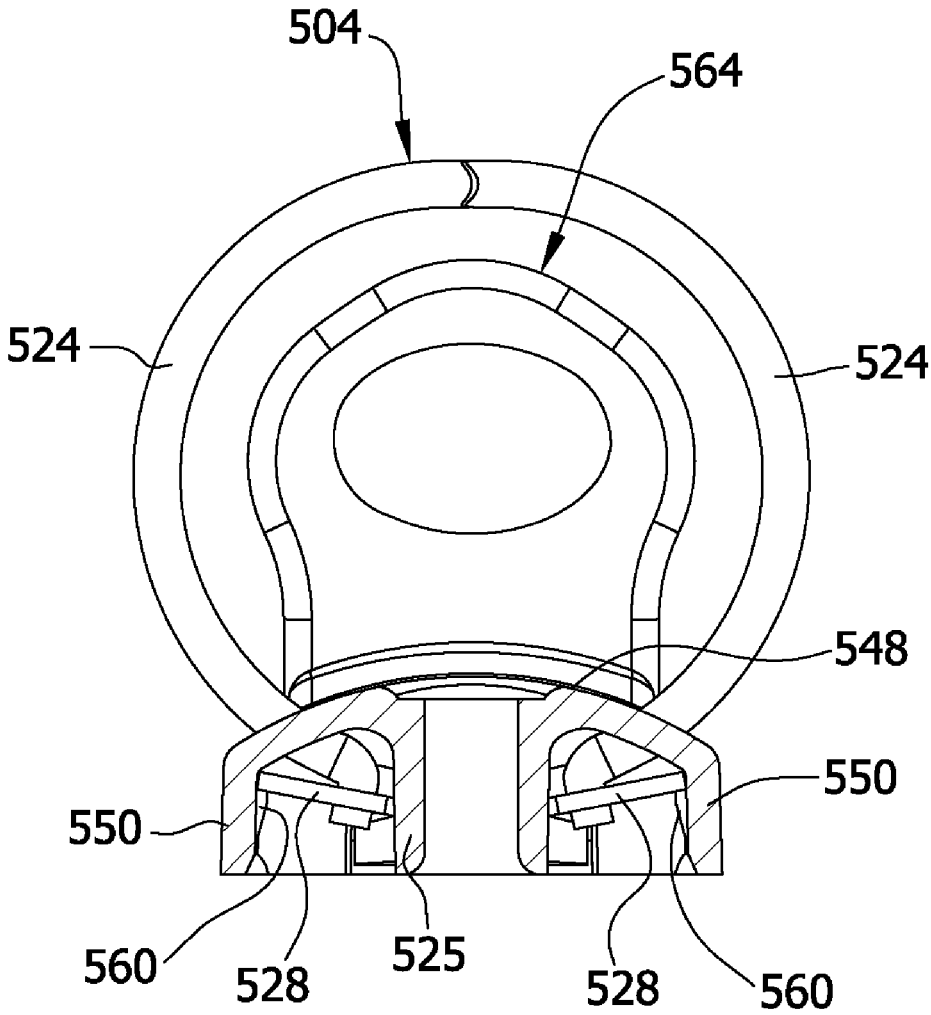
FIG. 26 is a cross section of the ring binder mechanism taken along line 26-26 on FIG. 23.

With reference to FIGS. 19-21, the ring binder mechanism 500 has a housing, indicated generally at 502, a pair of hinge plates 528 (broadly, "a ring support") supported by the housing, and three rings, each of which is designated generally at 504, mounted on the hinge plates. The housing 502 is elongate and comprises a central portion 548 and lateral sides 550 extending downward in generally vertical planes along either side of the central portion between opposite longitudinal ends 540, 542. The arrangement of the central portion 548 and lateral sides 550 results in the housing having a generally arch-shaped (e.g., U-shaped) cross-section between the longitudinal ends 540, 542 as illustrated in FIG. 25.

The housing 502, as illustrated in FIG. 21, includes two mounting posts 525 for mounting the ring binder mechanism 500 on, for example, the notebook 50 of FIG. 18. Each of the mounting posts 525 is tubular having a generally cylindrical wall and a passage therein for allowing a fastener, such as the rivets 513 of FIG. 18, to pass through the housing 502. In the illustrated embodiment, one of the mounting posts 525 is positioned generally adjacent one of the longitudinal ends 540 of the housing 502 and the other mounting post is positioned generally adjacent the other longitudinal end 542. It is understood that the housing 502 can have more than two mounting posts 525 or that the housing can be mounted on a surface in a different way (i.e., using prong fasteners).

Referring now to FIG. 20, the housing 502 also includes a mount 530 at each of its longitudinal ends 540, 542 for mounting a respective actuator 564 as described in more detail below. Each of the mounts 530 includes a pair of outward facing grooves 534 and an opening (not shown) associated with each of the grooves. The housing 502 further includes a plurality of openings 544 (e.g., slots, holes, or the like) spaced along the length of the housing for allowing the rings 504 to pass through the housing. In the illustrated embodiment, the housing 502 includes six openings 544 with three of the openings located along one of its lateral sides 550 and three located along the opposite lateral side. The openings 544 along one of the lateral sides (the right side of the housing as viewed in FIG. 20) are slots and the openings along the opposite lateral side are holes. It is understood, however, the housing 502 could have more or fewer openings 544 depending on the number of rings 504 and that the openings could all be formed the same (e.g., all slots, all holes).

Figure 31:
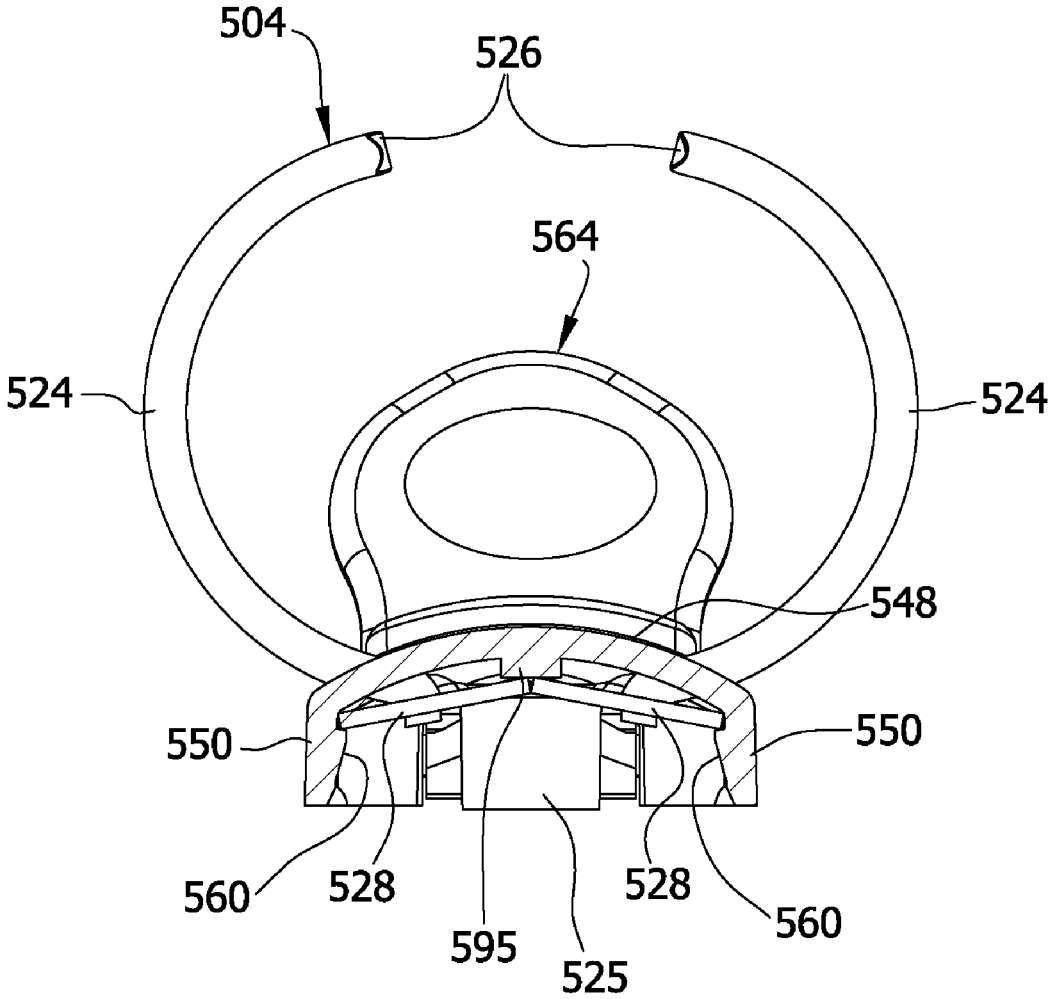
FIG. 31 is a cross section of the ring binder mechanism taken along line 31-31 on FIG. 29.
Figure 32:
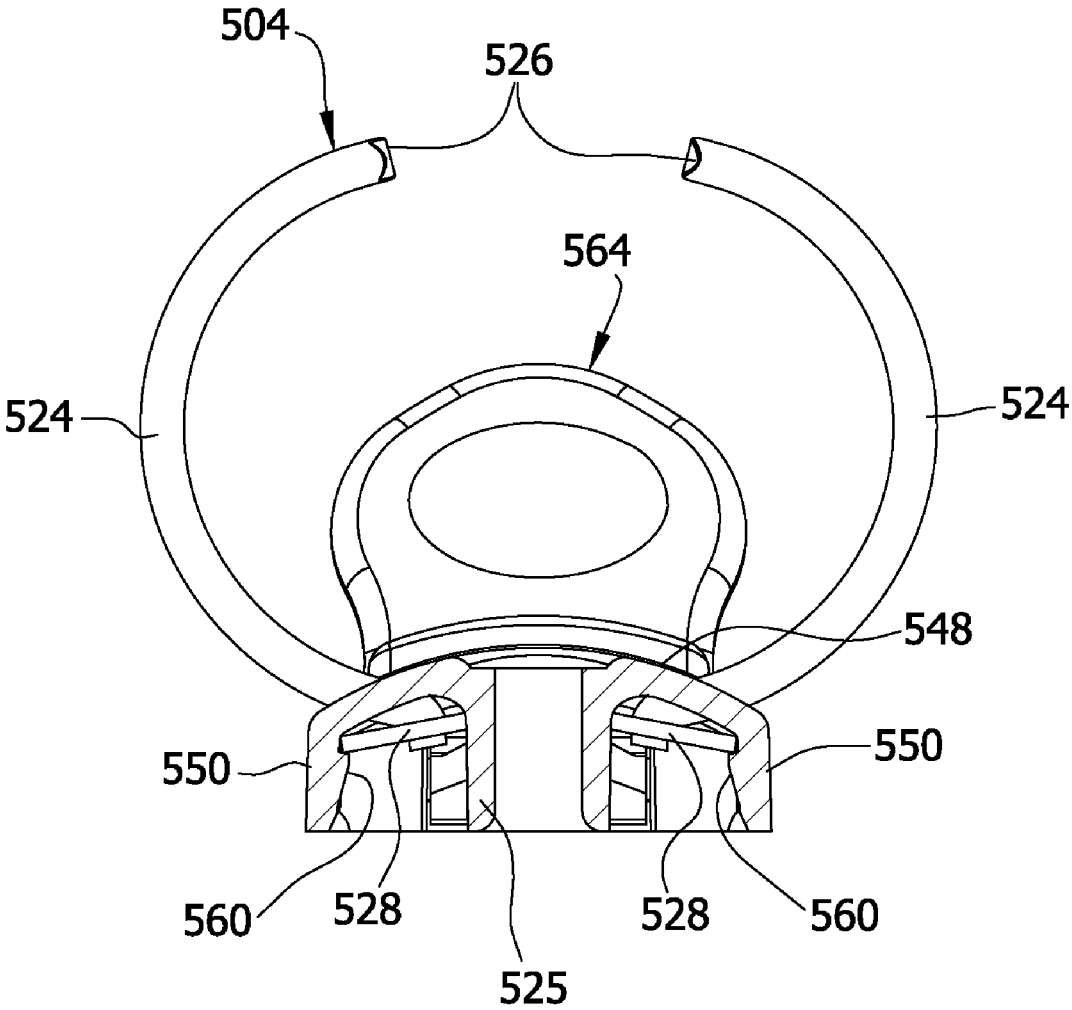
FIG. 32 is a cross section of the ring binder mechanism taken along line 32-32 on FIG. 29.

As seen in FIG. 21, the housing 502 has a plurality of hinge plate supports 560 on each of its lateral sides 550 for securing the hinge plates 528 within the housing. Each of the hinge plate supports 560, as best seen in FIG. 25, is generally a wedge-shaped tab that includes a sloped wall 561 and a shoulder 562 for engaging and supporting one of the hinge plates 528. In one suitable embodiment, the shoulder 562 has a width W1 between about 0.2 mm and about 1.5 mm. In the illustrated embodiment, for example, the shoulder 562 has a width W1 of about 0.5 mm. As also seen in FIG. 25, the housing 502 includes at least one blocking member 595 extending downward from its central portion 548. The blocking member 595, as illustrated in FIG. 31, is contacted by the hinge plates 528 when the hinge plates are pivoted upward to thereby limit the upward pivotal movement of the hinge plates. In one suitable embodiment, the blocking member 595 has a thickness T1 between about 0.5 mm and about 4 mm. In the illustrated embodiment, for example, the thickness T1 of the blocking member 595 is about 1 mm.

The housing 502 is designed to resiliently deform such that the spacing between the lateral sides 550 thereof increases when the hinge plates 528 pass through a coplanar position, which applies an outwardly directed force to the lateral sides of the housing. In one suitable embodiment, the spacing or width W2 between the lateral sides 550 of the housing 502 in a relaxed state is between about 13 mm and about 47.9 mm. In the illustrated embodiment, for example, the width W2 between the lateral sides 550 of the housing 502 is about 19.3 mm. The housing 502 is designed so the width W2 between the lateral sides 550 increases an amount in the range of about 2 percent to about 8 percent when the hinge plates 528 pass through the coplanar position. It is understood that the width W2 between the lateral sides 550 can increase in amounts different than those provided without departing from the scope of this invention.

In one suitable embodiment, the central portion 548 and lateral sides 550 of the housing 502 have an average wall thickness T2 between about 0.8 mm to about 3 mm (FIG. 25). In the illustrated embodiment, for example, the thickness T2 of the housing 502 is about 1.7 mm. The average wall thickness T2 of the central portion 548 and the lateral sides 550 are suitably about the same but it is understood that they can be different. That is, the thickness of the central portion 548 of the housing 502 can be greater than or less than the thickness of the lateral sides 550.

In one suitable embodiment, the housing 502 is constructed of a resilient polymeric material. For example, acrylonitrile butadiene styrene (ABS) has been found to be particularly resistant to fatigue type failure and capable of retaining its spring force over numerous cycles of operation. In one embodiment, the polymeric material has an impact strength of at least about 5 kJ/m2. Because the housing 502 is constructed of a polymeric material, it can be readily fabricated in a variety of different colors, which is useful for color-coding notebooks. Additionally, printed text (either raised or imprinted) may be molded into or otherwise formed on the housing 502. Further, the polymeric material does not require nickel plating (as is usually the case with metal housings for ring binder mechanism) and is therefore agreeable to people who are sensitive to nickel.

In the illustrated embodiment, the entire housing 502 is molded as one-piece. However, the housing can be manufactured in different ways, including by being constructed in multiple pieces that are later joined together to make the housing, without departing from the scope of the invention. The housing 502 can also be made from non-polymeric (e.g., metallic) materials and be within the scope of some aspects of this invention.

As illustrated in FIG. 20, the hinge plates 528 are each generally elongate, flat, and rectangular in shape, and are shorter in length than the housing 502 so that they fit within the housing. In other words, ends 588 of each of the hinge plates 528 terminate within the housing 502. The hinge plates 528 are interconnected in side-by-side arrangement along their inner longitudinal margins, forming a central hinge 554 for pivoting movement of the hinge plates relative to one another (FIG. 21). The interconnected hinge plates 528 are disposed between the lateral sides 550 of the housing 502 such that outer edge margins of the hinge plates engage the lateral sides above the shoulders 562 of the hinge plate supports 560, which retain the interconnected hinge plates 528 in the housing. Pivoting movement of the hinge plates 528 in the housing 502 is accompanied by movement of the central hinge 554 upward and downward relative to the housing as well as pivoting movement of outer edge margins of the hinge plates relative to lateral sides 550 of the housing. In one suitable embodiment, each of the hinge plates 528 has a thickness T3 between about 0.4 mm and about 2 mm, and a width W3 between about 7 mm and about 24 mm. In the illustrated embodiment, for example, the hinge plates 528 have a thickness T3 of about 0.8 mm and a width W3 of about 9.6 mm.

Each of the rings 504 are adapted to retain loose-leaf pages (not shown) on the ring binder mechanism 500 in the notebook 50. The three rings 504 of the illustrated ring binder mechanism 500 are substantially similar and are each generally circular in shape (FIG. 19). As seen in FIG. 20, each ring 504 includes two generally semi-circular ring members 524 formed from a conventional, cylindrical rod of a suitable material (e.g., steel). The ring members 524 include free ends 526 that are formed to secure the ring members against misalignment when they are closed together. The rings could be D-shaped as is known in the art, or shaped otherwise within the scope of this invention. Ring binder mechanisms with ring members formed of different material or having different cross-sectional shapes, for example, oval shapes, do not depart from the scope of this invention. Likewise the number of rings supported by the housing can also vary within the scope of the invention.

With reference to FIG. 20, one ring member 524 of each ring 504 is mounted on one of the interconnected hinge plates 528, while the other ring member of that ring is mounted on the opposite hinge plate. The ring members 524 extend through the openings 544 in the housing 502 and are arranged so their free ends 526 face toward one another above the housing 502 (FIG. 19). The ring members 524 are moveable between an opened position (FIG. 27) in which loose-leaf pages can be added to and/or removed front the ring binder mechanism 500 and a closed position (FIGS. 18 and 19) in which the free ends 526 of corresponding ring members 524 are joined to retain any loose-leaf pages on the rings 504 in the ring binder mechanism. In the illustrated ring binder mechanism 500 both ring members 524 of each ring 504 moves with the pivoting movement of the respective hinge plate 528. It is understood, however, that the ring binder mechanism 500 can have one movable ring member 524 and one fixed ring member without departing from the scope of this invention (e.g., a mechanism in which only one of the ring members of each ring is mounted on a hinge plate with the other ring member mounted, for example, on the housing).

The housing 502 is suitably deformed in the opened and closed positions of the rings 504 so that the housing continuously applies a spring force to the hinge plates 528 for holding the rings in either their opened position or their closed position. Other constructions for biasing the hinge plates 528 or otherwise holding the rings 504 in their opened and/or closed positions may be used within the scope of the present invention.

The ring binder mechanism 500 includes two actuators, indicated generally at 564, operable to move the rings 504 from their closed position to their opened position and from their opened position back to their closed position. The actuators 564 are mounted at respective ends 540, 542 of the housing 502 for pivotal movement of the actuator relative to the housing about a pivot pin 566. More specifically, in the illustrated embodiment, each of the actuators 564 are mounted to the housing 502 at respective mounts 530 and the pivot pins 566 are aligned with the respective pair of outward facing grooves 534 and extend through the openings (not shown) associated with each of the grooves. As illustrated in FIG. 19, the pivot pins 566, which define the pivot axis of the actuators, are substantially perpendicular to a longitudinal axis 568 of the housing 502 and substantially parallel to a lateral axis 570 of the housing (e.g., an axis that is orthogonal to the longitudinal axis and oriented so it extends through each of the lateral sides 550 of the housing).

Figure 22:
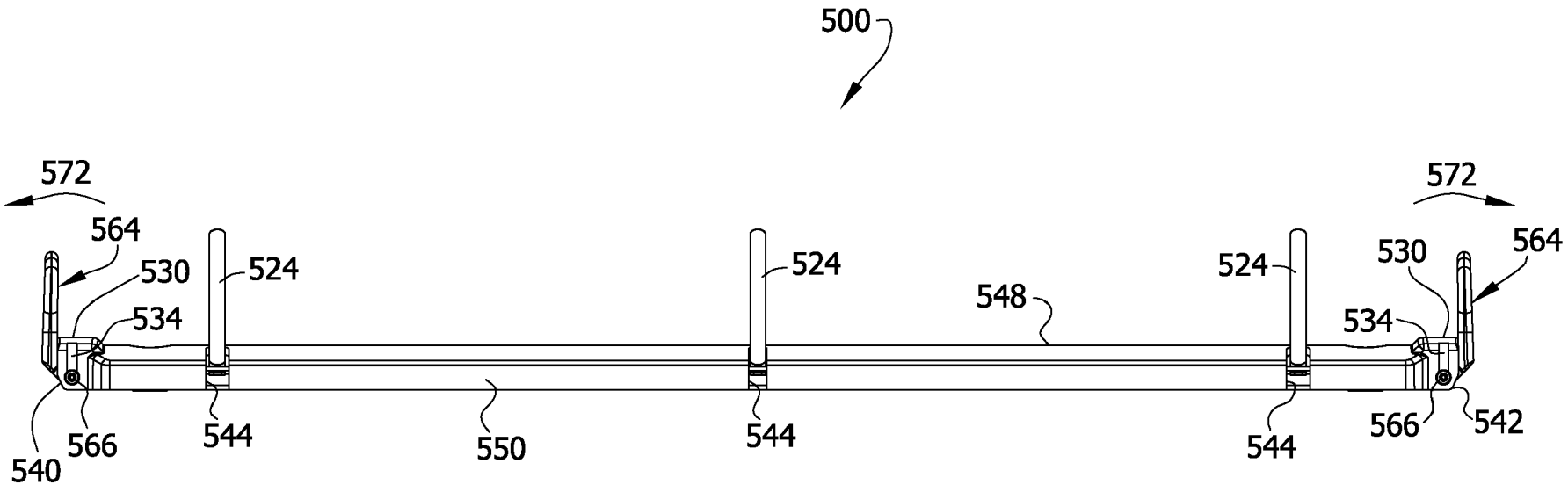
FIG. 22 is a side elevation of the ring binder mechanism.
Figure 23:
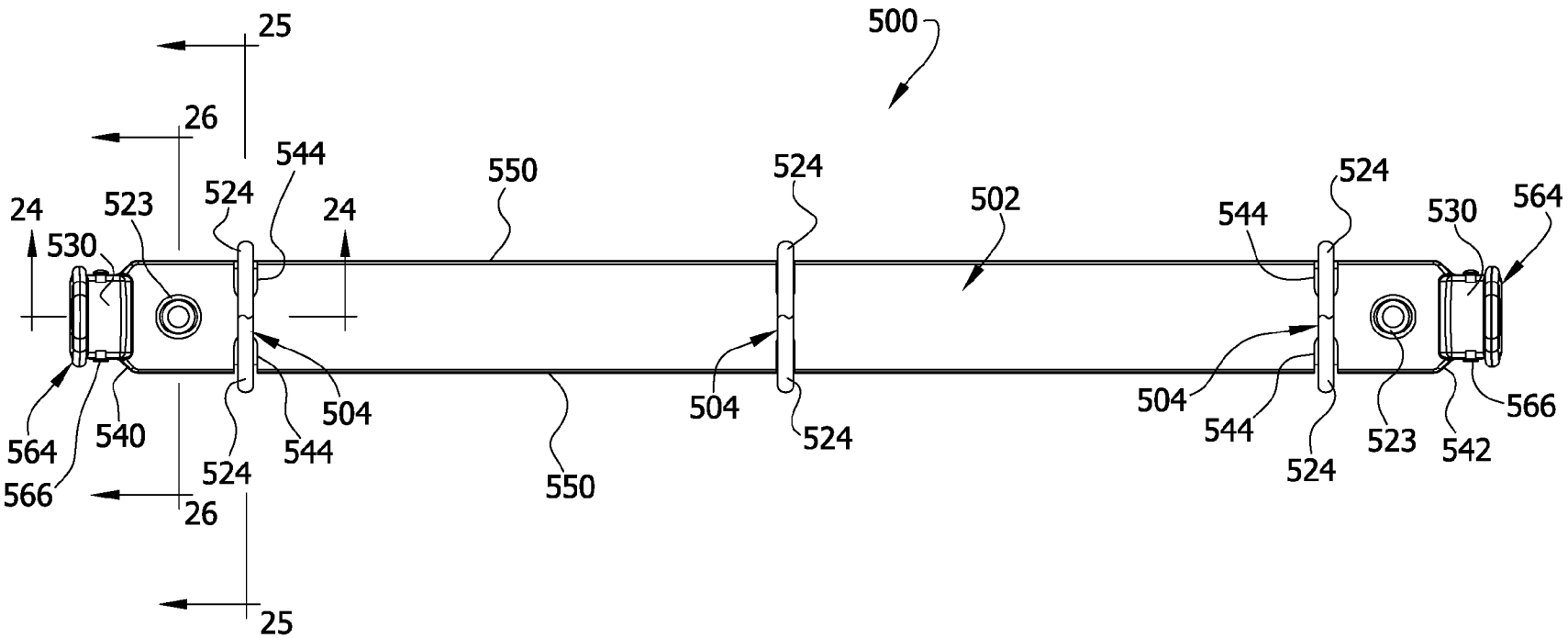
FIG. 23 is a top plan view of the ring binder mechanism.

The actuators 564 are positioned and arranged so that pivoting movement of the actuators about the respective pivot pins 566 in the directions of arrows 572 shown on FIG. 22 causes the actuators to engage the hinge plates 528 and move the central hinge 554 of the hinge plates upward in the housing 502. Upward movement of the hinge plates 528 causes the rings 504 to move from their closed position to their opened position. The hinge plates 528 are illustrated in an upward position in FIGS. 31 and 32. In the illustrated embodiment, the actuators 564 are also positioned and arranged so that pivoting movement of the actuator on the pivot axis in the reverse direction (indicated by the arrow 574 on FIG. 27) when the rings 504 are open causes the actuator to engage the hinge plates 528 and move the central hinge 554 downward in the housing 502, thereby pivoting the hinge plates downward and causing the rings to move from their open position to their closed position. The hinge plates 528 are illustrated in a downward position in FIGS. 25 and 26.

It is understood that the ring binder mechanism 500 can be formed with a single actuator instead of the two seen in the accompanying drawings. It is also understood that while two actuators 564 are provided on the illustrated ring binder mechanism 500 only one may be needed to move the hinge plates 528 between their downward and upward positions. That is, the rings 504 can be moved between the opened and closed positions using either one of the two actuators 564. In the illustrated embodiment, however, both actuators 564 have to be pivoted simultaneously to pivot the hinge plates 528 and thereby move the rings 504 between their opened and closed positions. It is further understood that the rings 504 can be moved between their opened and closed position by manually pulling the rings apart or pushing the rings together.

Figure 33:
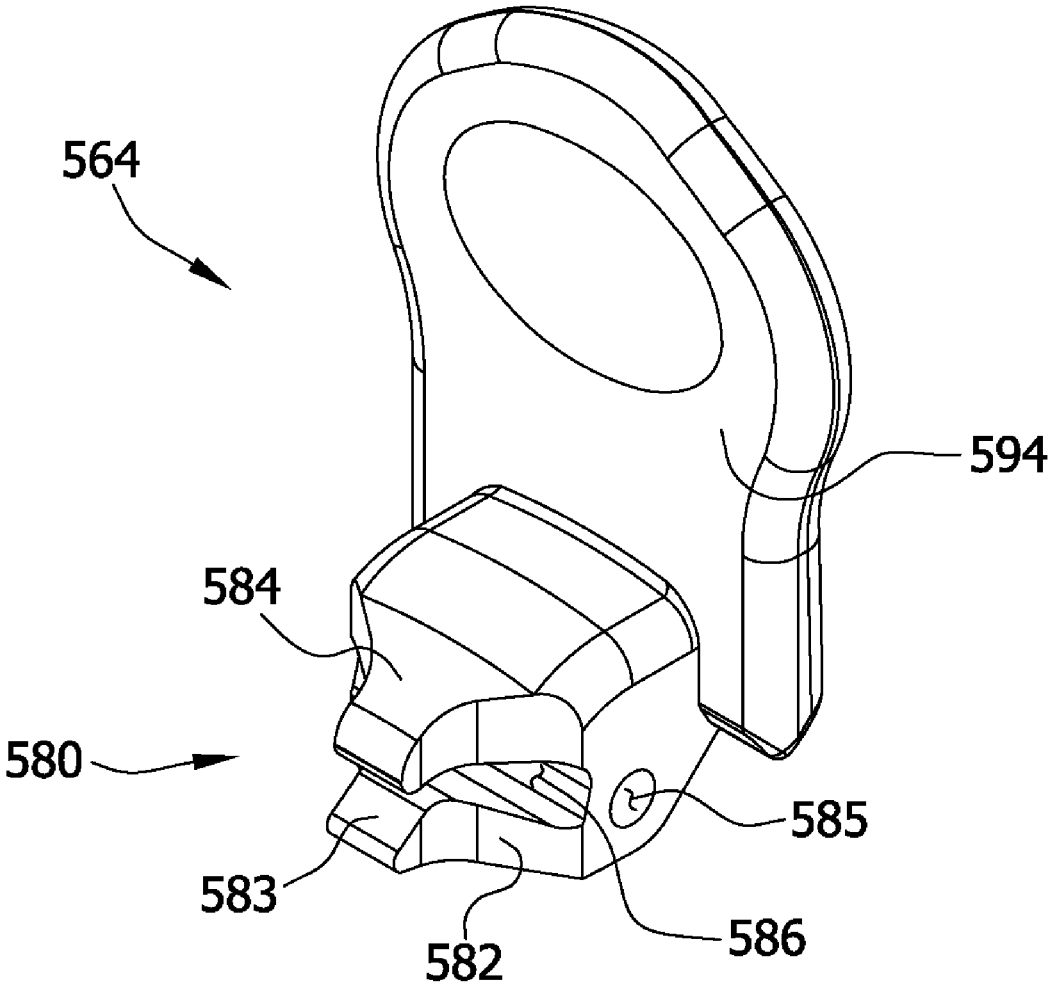
FIG. 33 is an enlarged perspective of an actuator of the ring binder mechanism.
Figure 34:
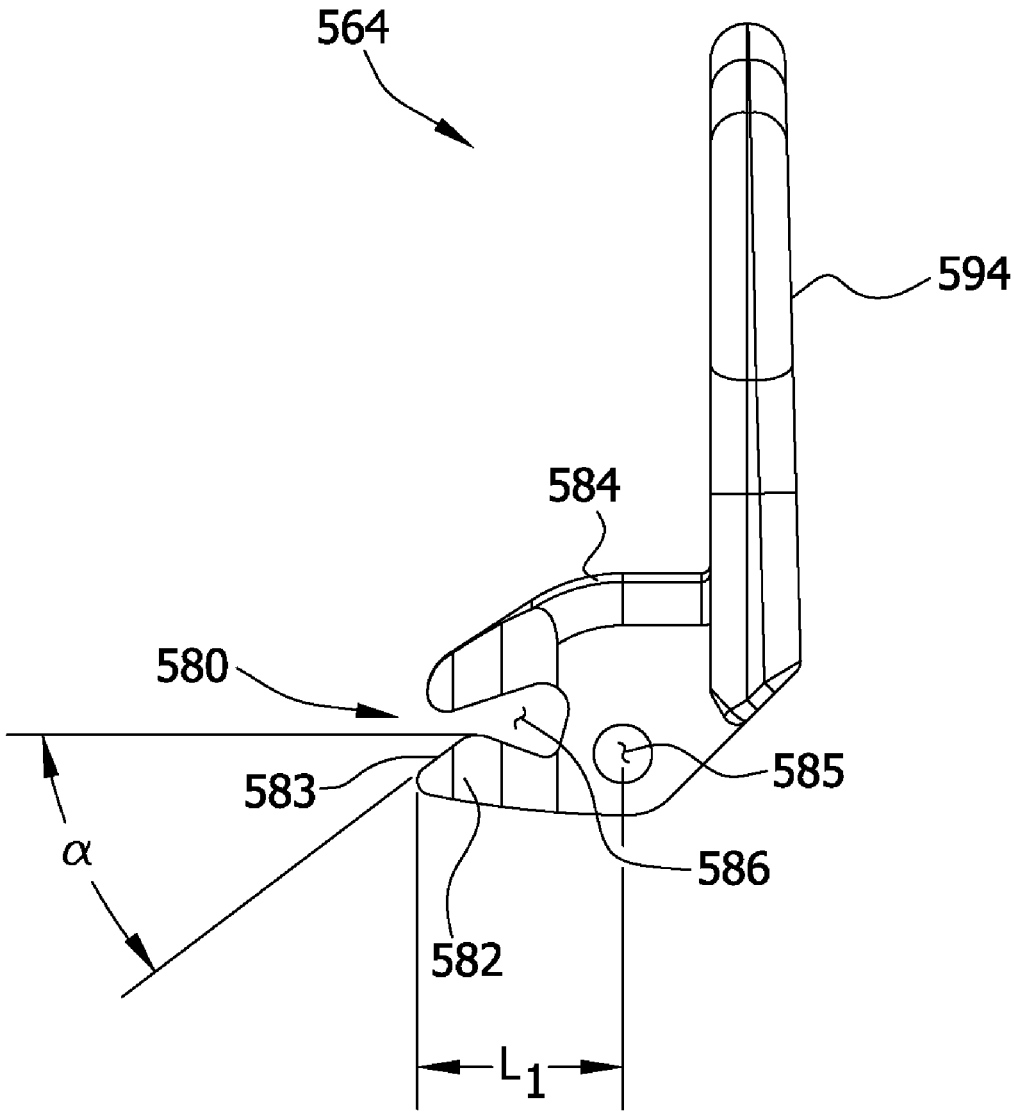
FIG. 34 is a side elevation of the actuator.
Figure 35:
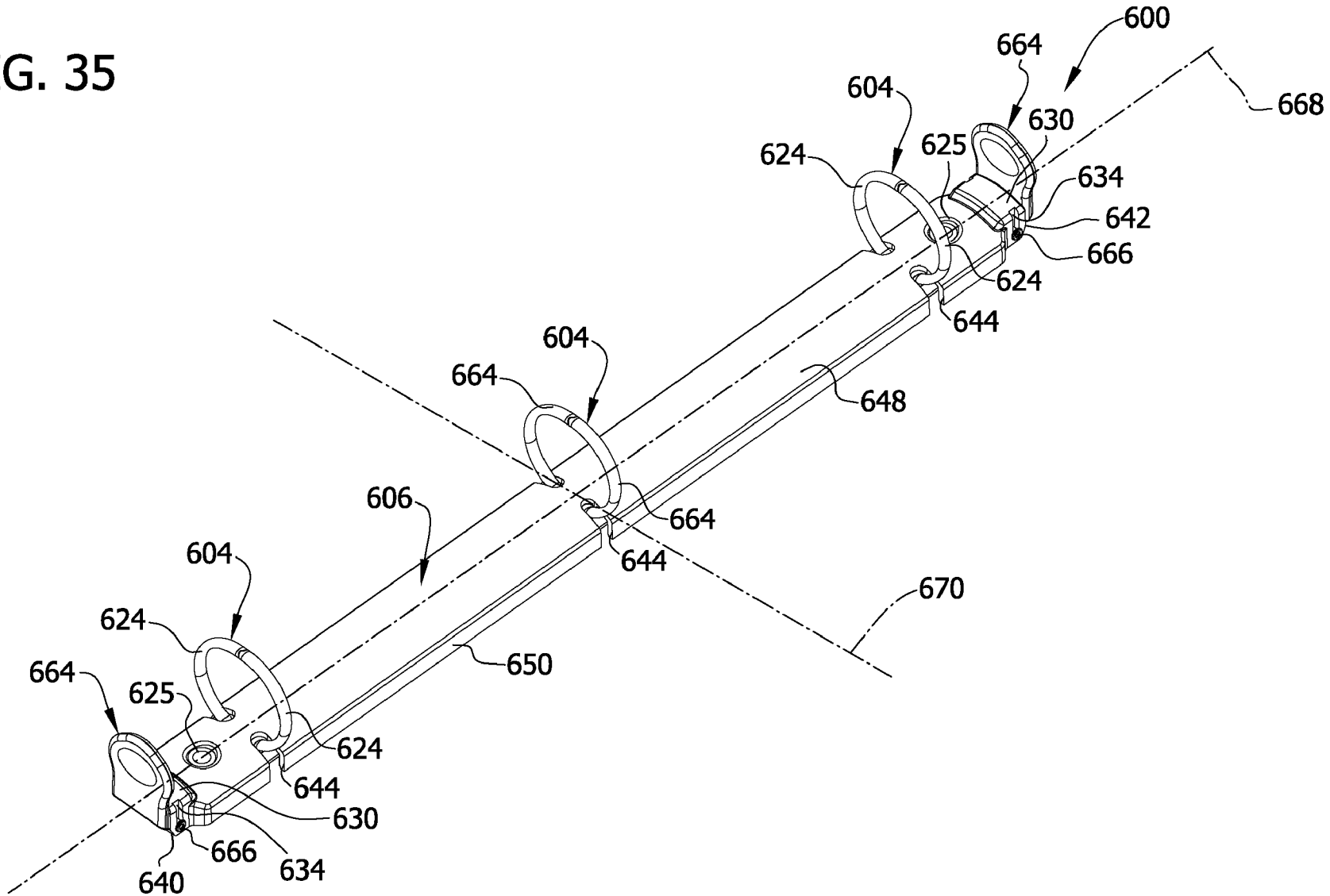
FIG. 35 is a perspective of a fifth embodiment of a ring binder mechanism.
Figure 36:
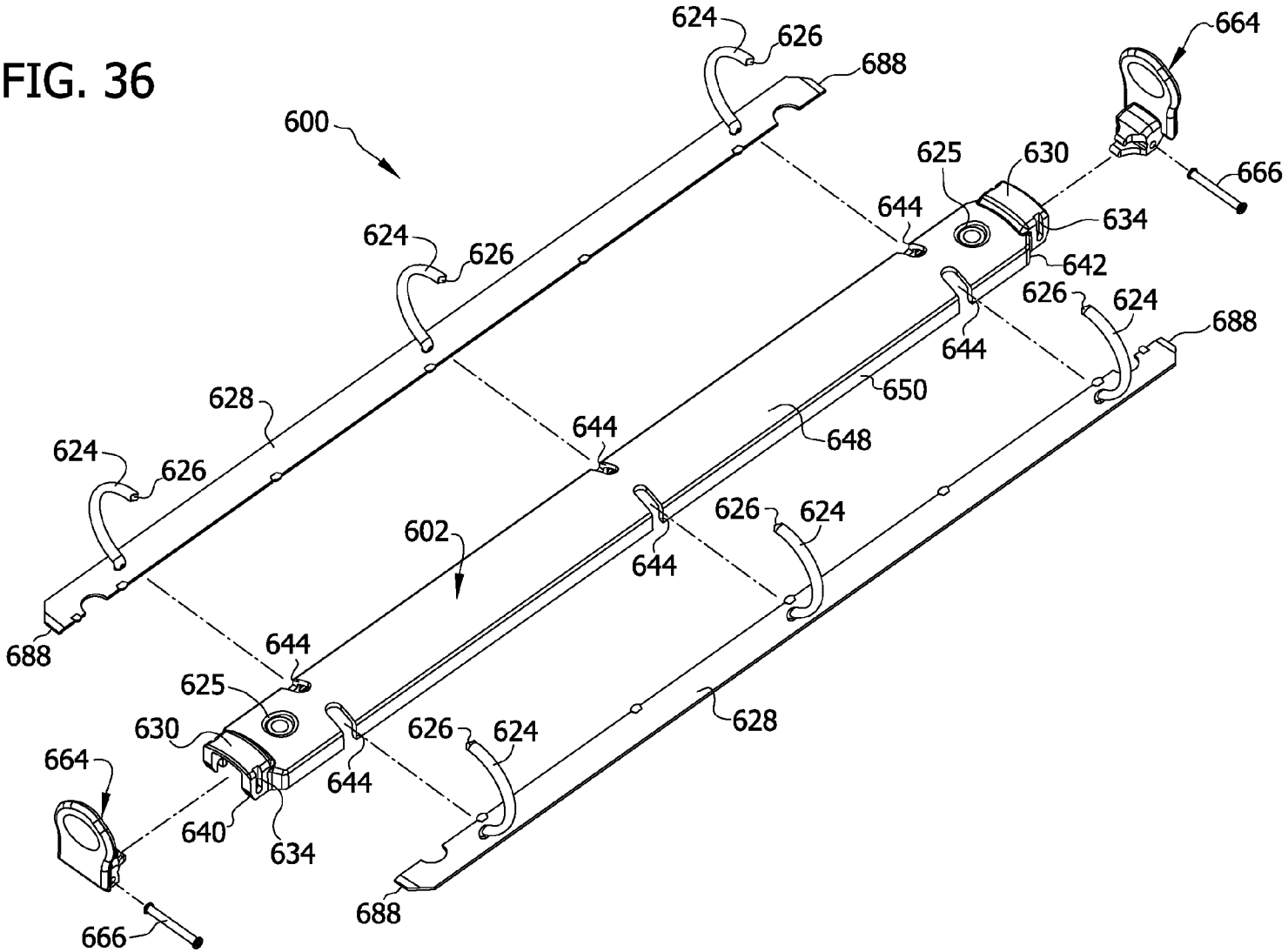
FIG. 36 is an exploded perspective of the ring binder mechanism of FIG. 35.
Figure 37:
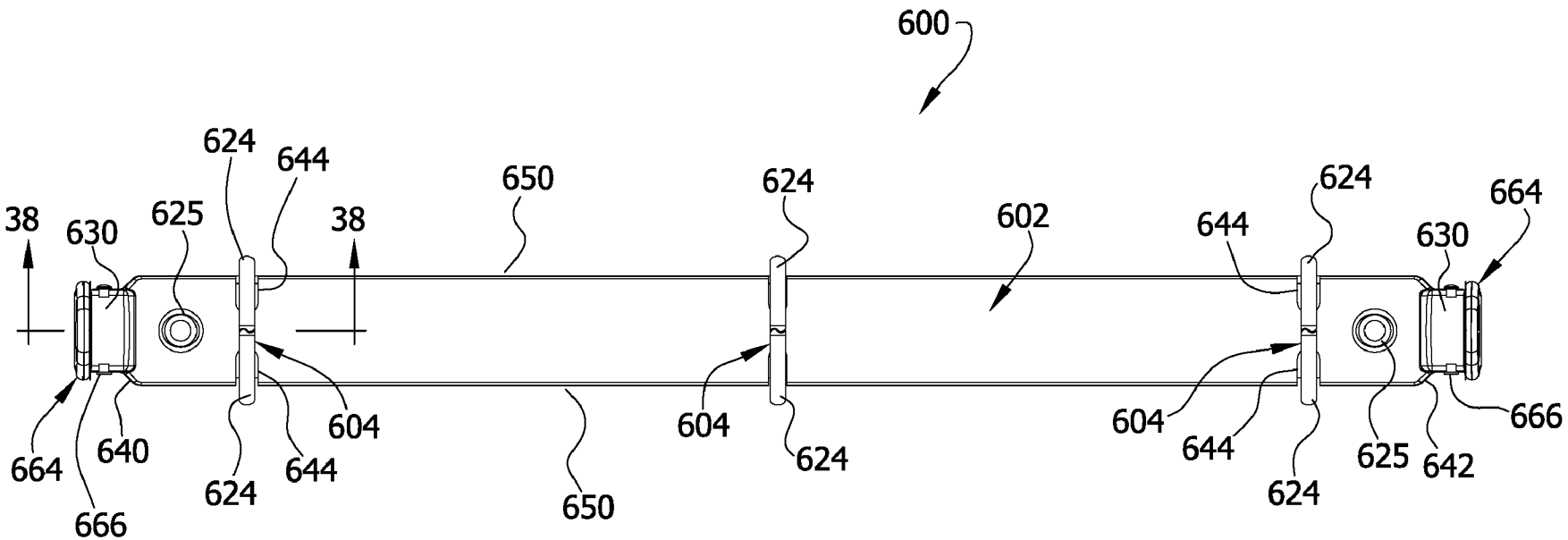
FIG. 37 is a top plan view of the ring binder mechanism.
Figure 38:
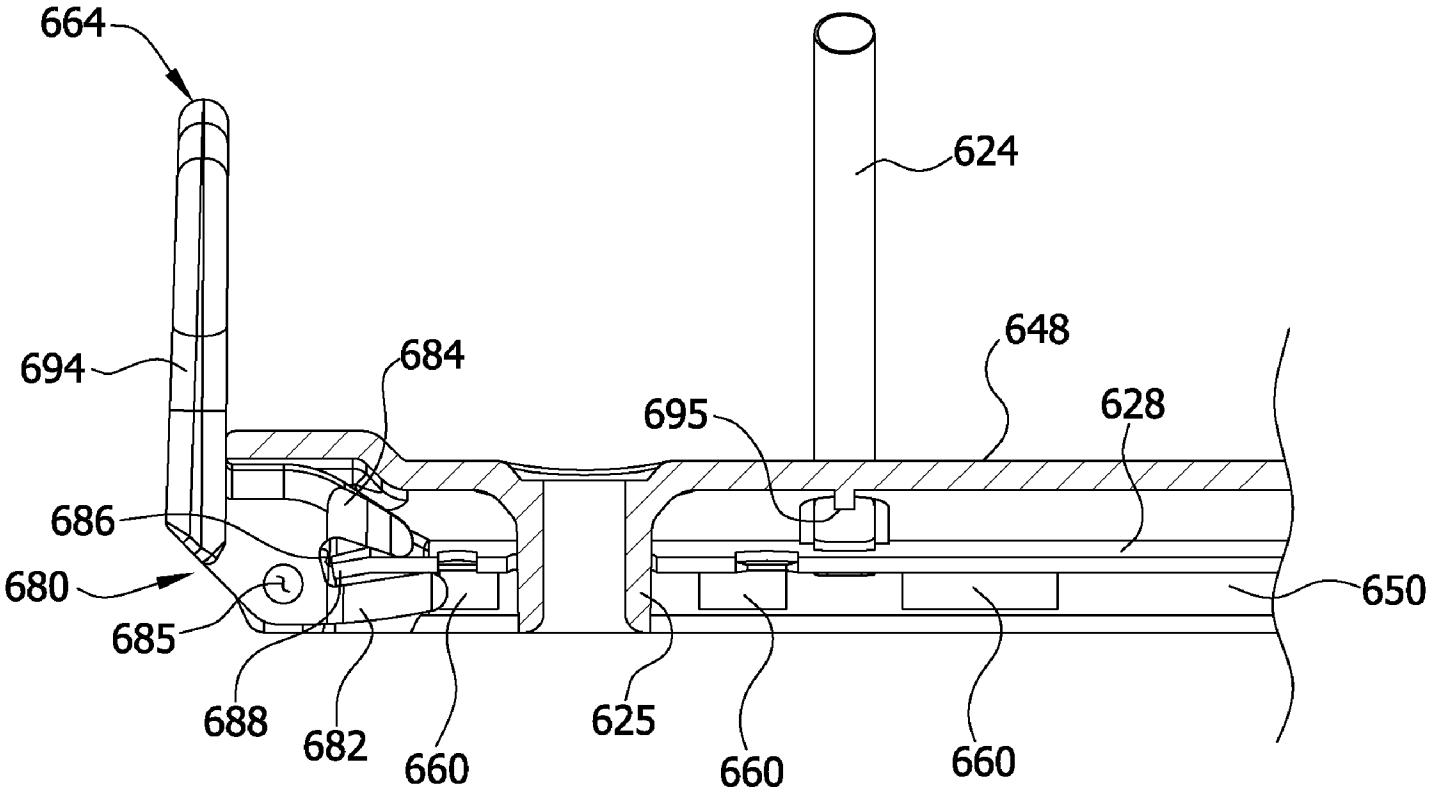
FIG. 38 is a fragmentary cross section of the ring binder mechanism taken along line 38-38 on FIG. 37.
Figure 39:
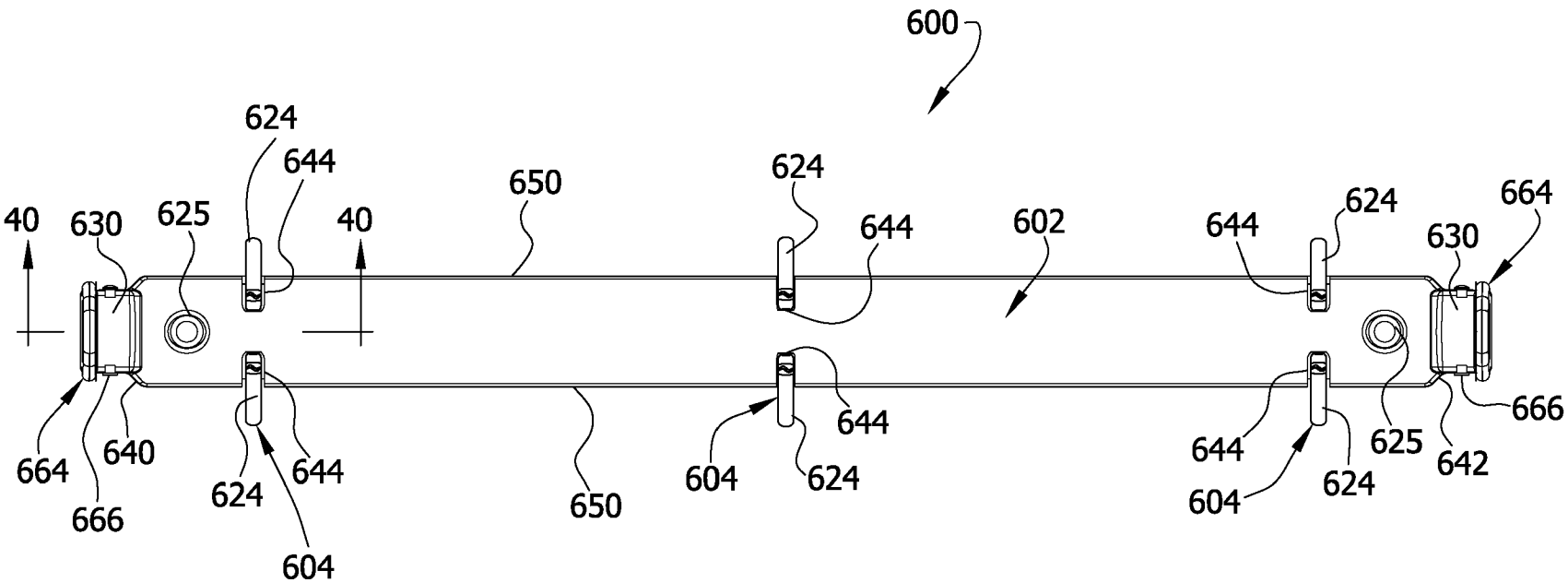
FIG. 39 is a top plan view of the ring binder mechanism with rings thereof in an opened position.

Referring to FIGS. 33 and 34, each of the actuators 564 in the illustrated embodiment of the ring binder mechanism 500 has a yoke portion 580 including a lower arm 582 and an upper arm 584. The upper and lower arms 582, 584 together define a notch 586. The lower arm 582 of the yoke portion 580 of the actuator 564 has a beveled outer edge 583 (broadly, "a contact surface") that is configured for engagement with the lower surface of the hinge plates 528. The yoke portion 580 further includes a passage 585 for allowing the pivot pin 566 to pass through the respective actuator 564. In one suitable embodiment, the lower arm 582 has a length L1 measured from the center of the passage 585 to the distal end of the lower arm in the range of about 4.5 mm to about 12.5 mm. In the illustrated embodiment, for example, the length L1 of the lower arm 582 is approximately 7 mm. In addition, the beveled outer edge 583 defines an angle $\alpha$ between its outer surface and a horizontal plane as illustrated in FIG. 34. In one suitable embodiment, the angle $\alpha$ is between about 16 degrees and about 55 degrees. In the illustrated embodiment, for example, the angle $\alpha$ is approximately 37 degrees. The actuator 564 also includes a lever arm 594 extending from the pivot pin 566 to a location exterior of the housing 502 for use in gripping and pivoting of the actuator by a user.

The yoke portion 580 of the actuator 564 comprises a unitary body forming the upper and lower arms 582, 584. The unitary body also includes at least a portion of the lever arm 594, which may also include an elastomeric cover or grip portion (not shown) within the scope of the invention. In the illustrated embodiment, the actuators 564 are formed from the same material (e.g., acrylonitrile butadiene styrene (ABS)) as the housing 502. It is understood, however, that the actuators 564 and the housing 502 can be formed from different materials.

Figure 24:
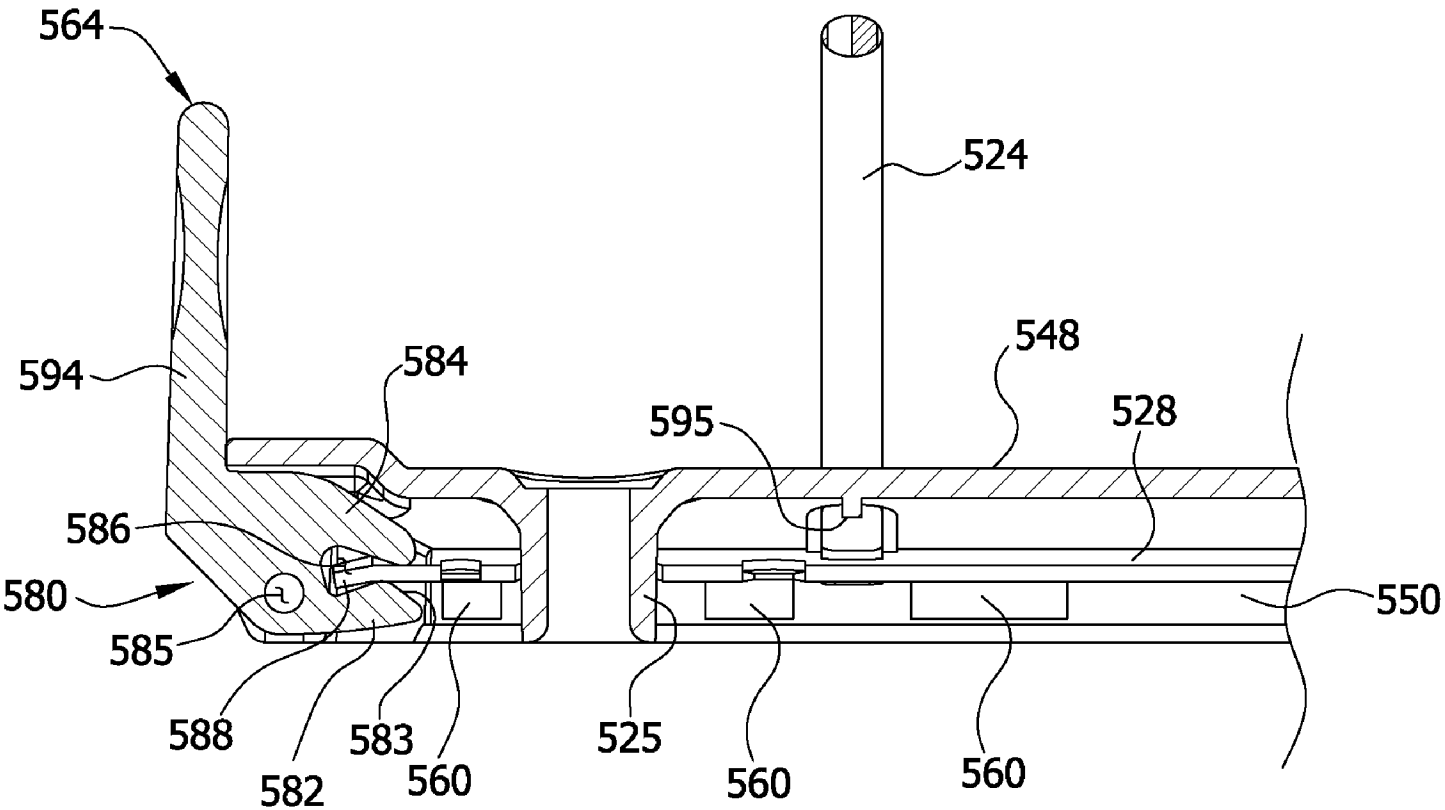
FIG. 24 is a fragmented cross section of the ring binder mechanism taken along line 24-24 on FIG. 23.
Figure 28:
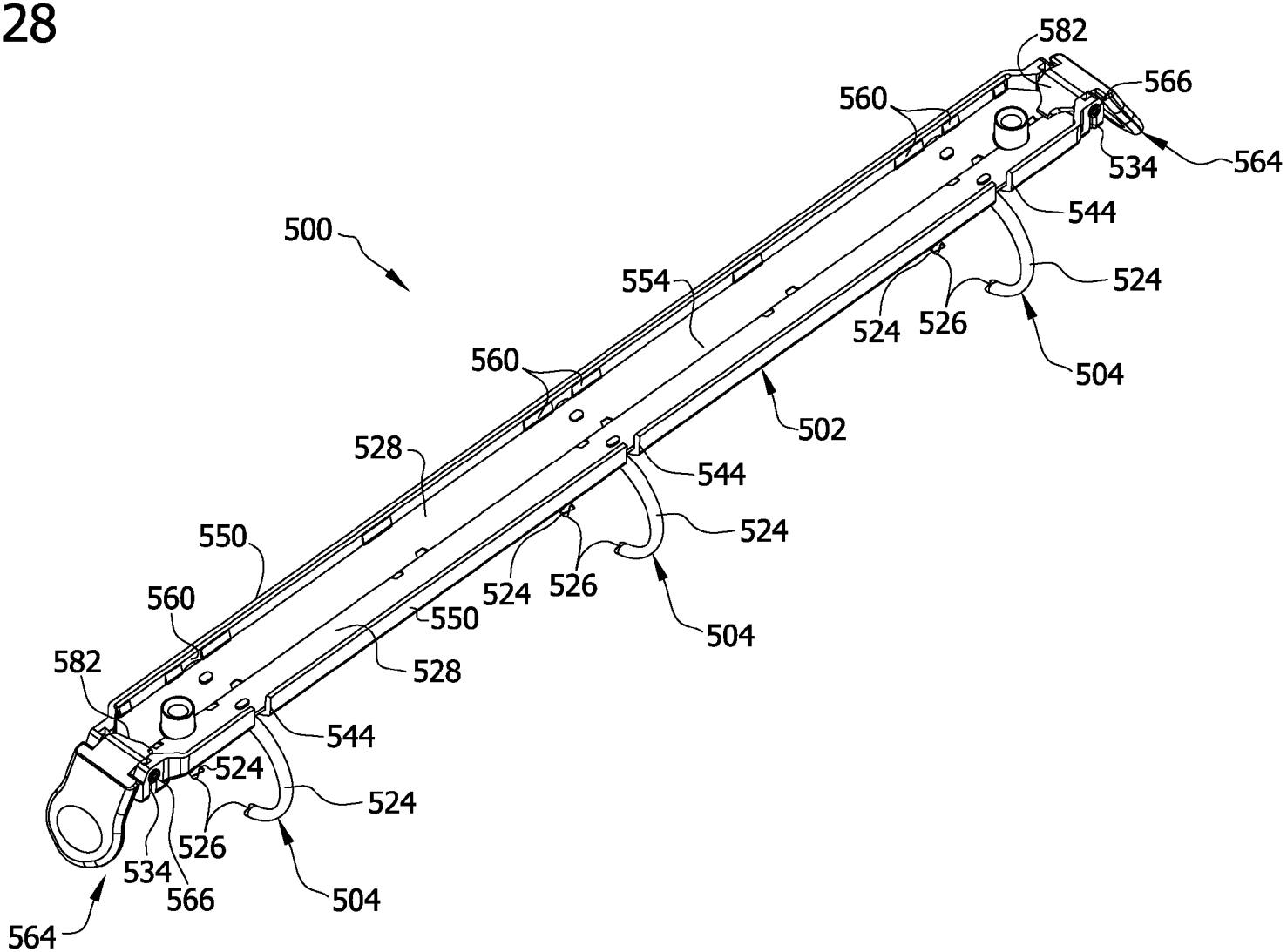
FIG. 28 is a bottom side perspective of the ring binder mechanism with the rings in their opened position.
Figure 29:
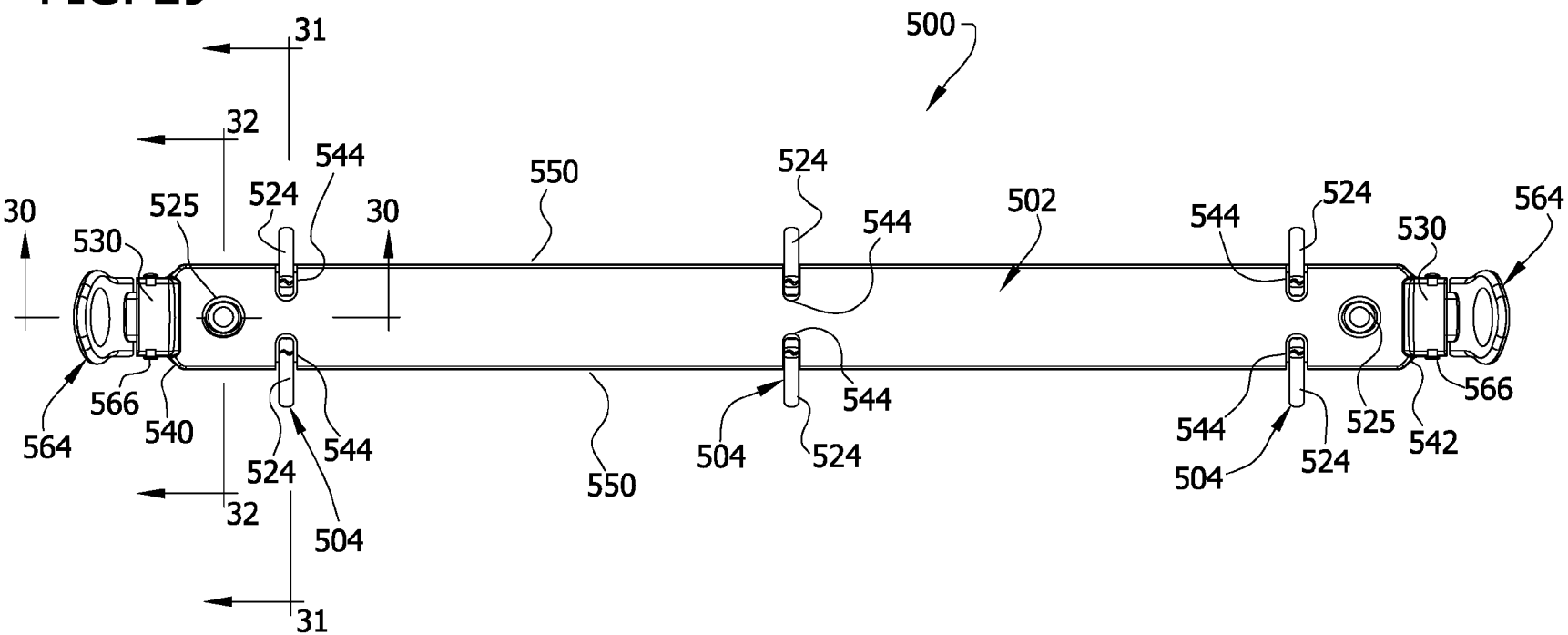
FIG. 29 is a top plan view of the ring binder mechanism with the rings in their opened position.
Figure 30:
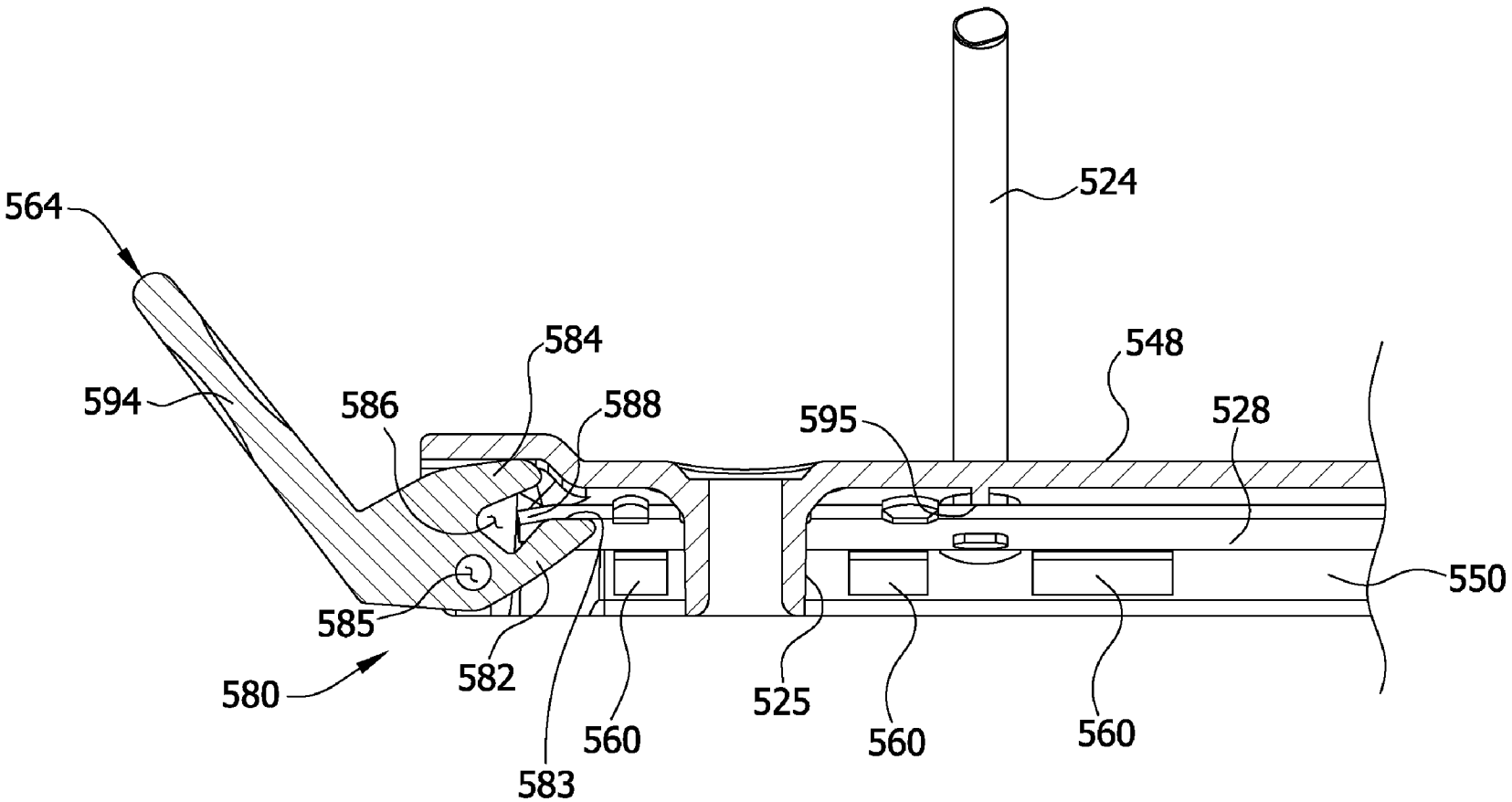
FIG. 30 is a fragmented cross section of the ring binder mechanism taken along line 30-30 on FIG. 29.

The lower arm 582 of the yoke portion 580 extends from the pivot pin 566 between the lateral sides 550 of the housing 502 to a location adjacent the hinge plates 528 and on a side of the hinge plates opposite the central portion 548 of the housing for engaging a bottom surface of the hinge plates during pivoting movement of the respective actuators 564 to open the rings 504 (FIGS. 21 and 28). Particularly, as the actuators 564 are pivoted to open the rings 504, the beveled outer edge 583 of the respective lower arm 582 rotates from a position with little or no engagement with the lower surface of the hinge plates 528 (FIG. 24) to a position in engagement with the lower surface of the hinge plates 528 (FIG. 30). The upper arm 584 of the yoke portion 580 extends from the pivot axis 566 between the lateral sides 550 of the housing 502 to a location adjacent the upper surface of the hinge plates 528 (FIG. 24). That is, the upper arm 584 is located on a side of the hinge plates opposite the lower arm 582. As illustrated in FIGS. 24 and 30, the ends 588 of each of the hinge plates 528 are received in the notches 586 of the yoke portions 580 of the respective actuator 564.

When a user wants to open the rings 504, he or she can grasp the lever arms 594 of the actuators 564 and pivot both of the actuators in the direction of the arrow 572 shown in FIG. 22. This causes the lower arms 582 of the yoke portions 580 of the actuators 564 to engage the lower surface of the hinge plates 528. As the user continues to pivot the actuators 564, the lower arm 582 pushes the central hinge 554 of the hinge plates 528 upward in the housing 502, thereby causing the hinge plates to pivot relative to one another and the housing. The ring members 524 pivot with the respective hinge plate 528, thereby moving the rings 504 from their closed position to their opened position. As the actuators 564 are pivoted to open the rings 504, the yoke portion 580 (and in particular the upper arm 584 of the yoke portion) is received within the mount 530 of the housing 502 (FIG. 30). The beveled outer edge 583 of the respective lower arms 582 rotates from a position with little or no engagement with the lower surface of the hinge plates 528 (FIG. 24) to a position in engagement with the lower surface of the hinge plates 528 (FIG. 30). The positive engagement between the lower surface of the hinge plates 528 and the beveled outer edge 583 of the lower arm 582 inhibits the respective actuators 564 from disengaging from the hinge plates. The beveled outer edge 583 increases the amount of surface area of the actuator 564 that contacts the hinge plates 528 when the hinge plates are pivoted upward to open the rings 504.

Figure 27:
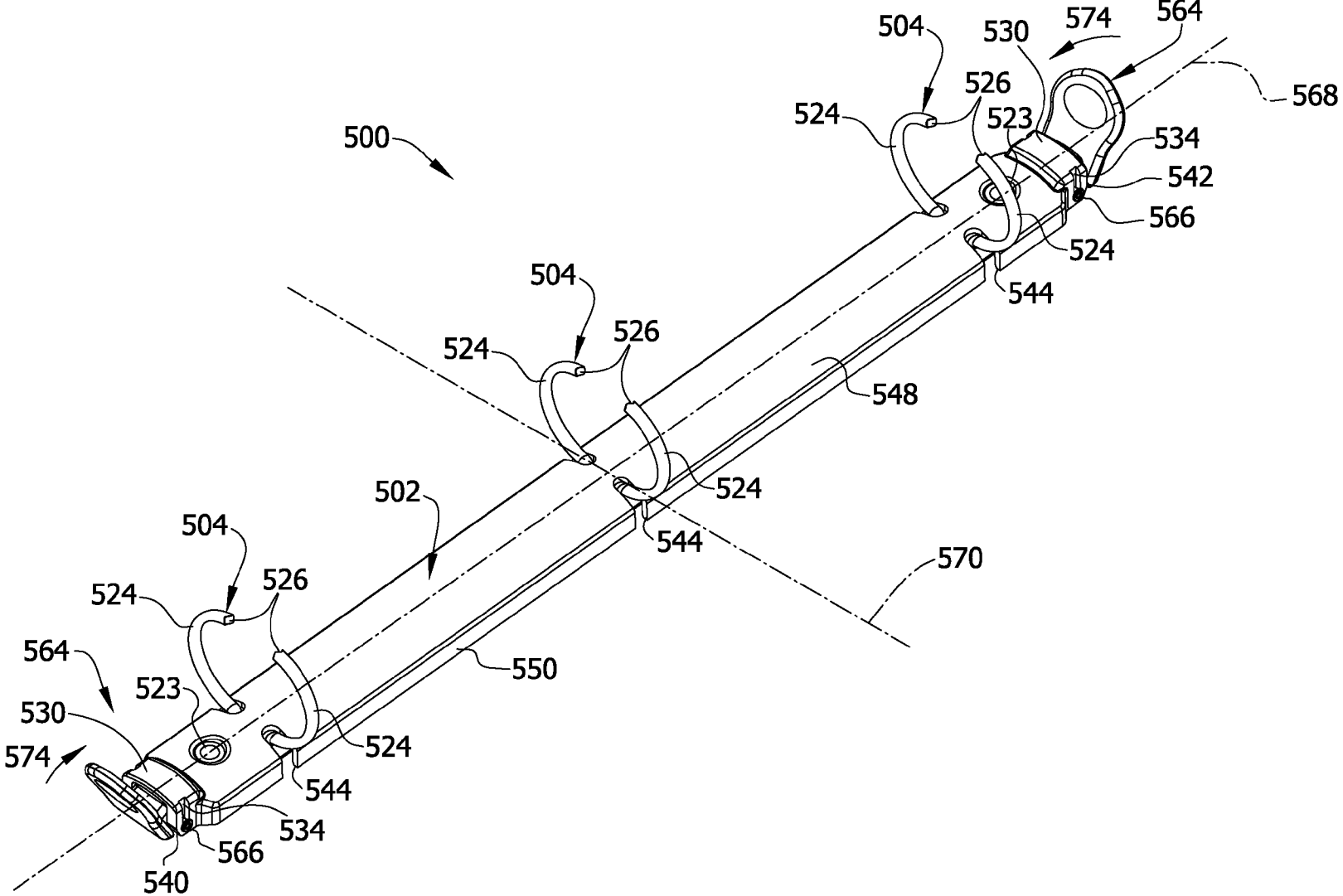
FIG. 27 is a perspective of the ring binder mechanism showing rings thereof in an opened position.

When the user wants to close the rings 504, he or she can grasp the lever arm 594 and use it to pivot the actuators 564 in the direction of the arrow 574 (FIG. 27). This causes the upper arm 584 of the actuator 564 to engage the upper surface of the hinge plates 528. As the user continues to pivot the actuators 564 in the direction of the arrow 574, the upper arm 584 pushes the central hinge 554 of the hinge plates 528 downward in the housing 502, causing the hinge plates to pivot relative to one another and the housing. The ring members 524 pivot with the hinge plates 528 thereby moving the rings 504 to their closed position.

Figure 40:
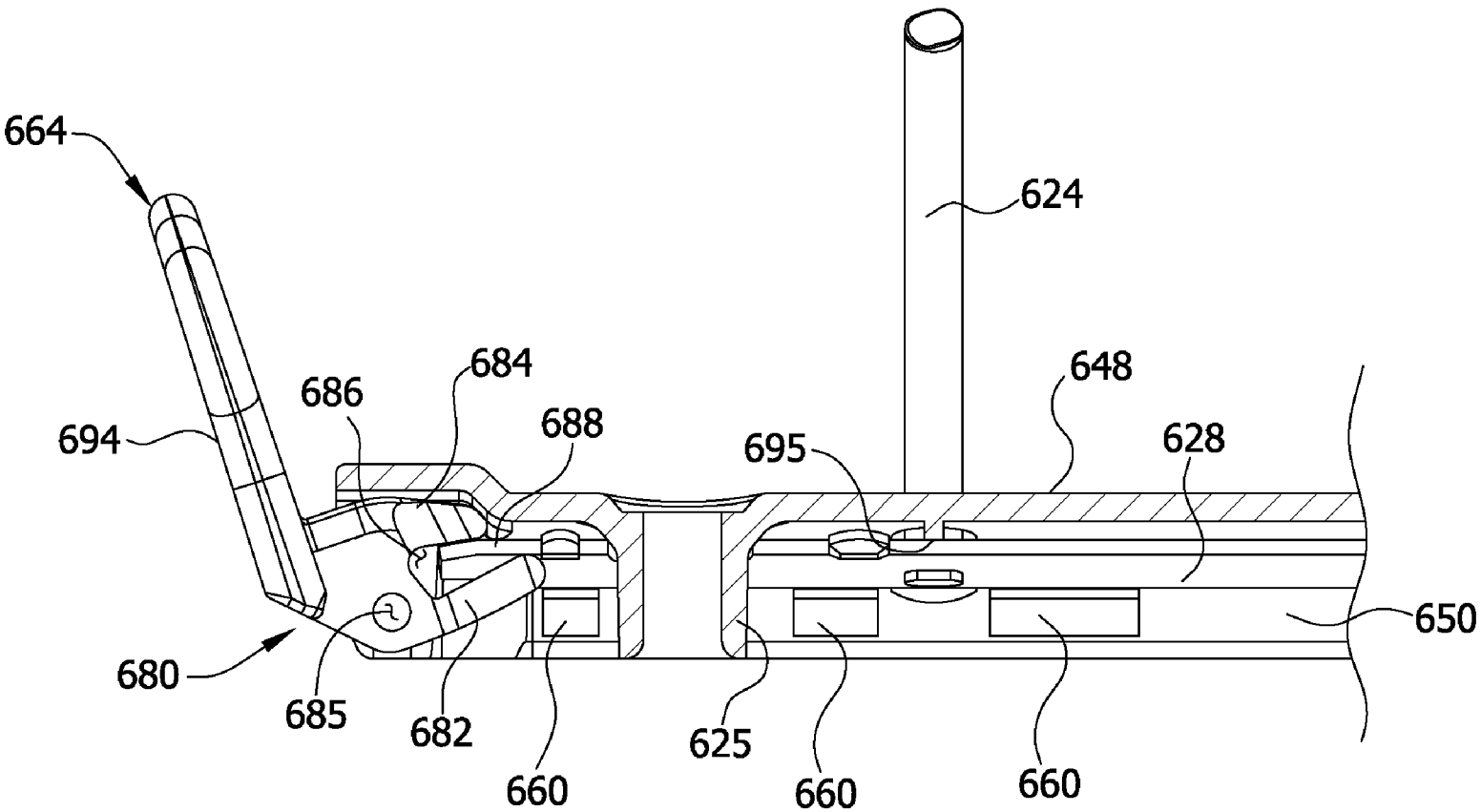
FIG. 40 is a fragmentary cross section of the ring binder mechanism taken along line 40-40 on FIG. 39.
Figure 41:
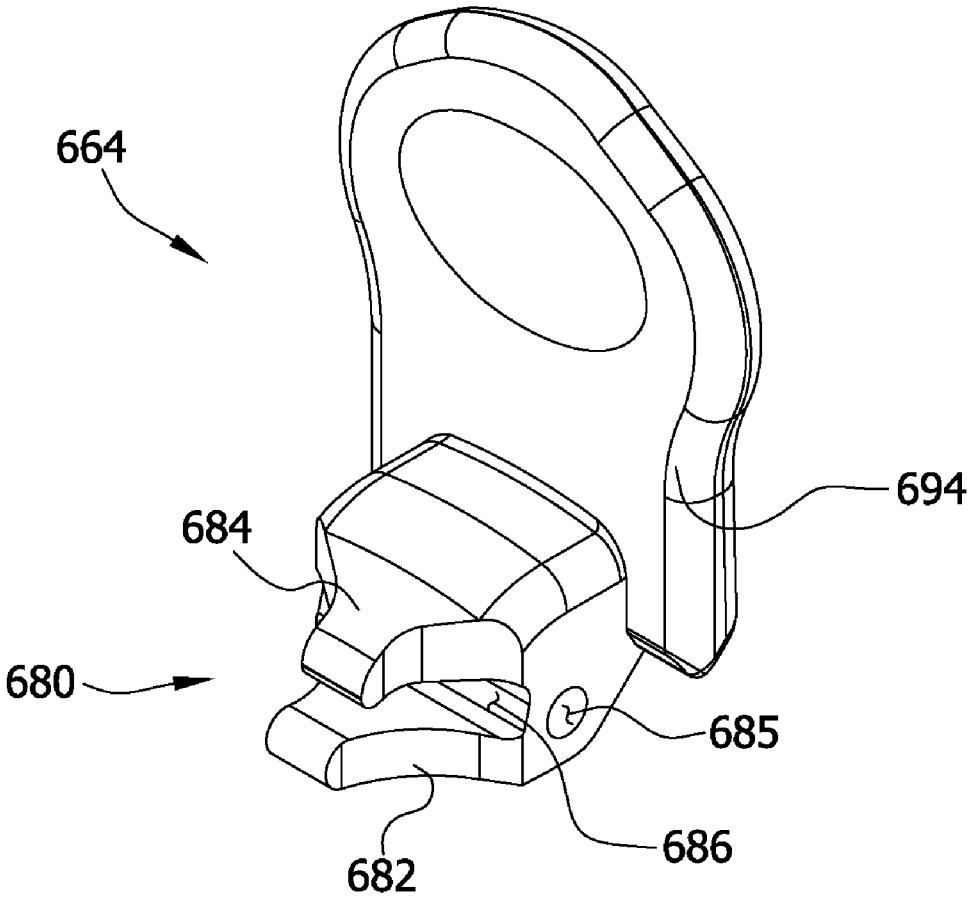
FIG. 41 is an enlarged perspective of an actuator of the ring binder mechanism.
Figure 42:
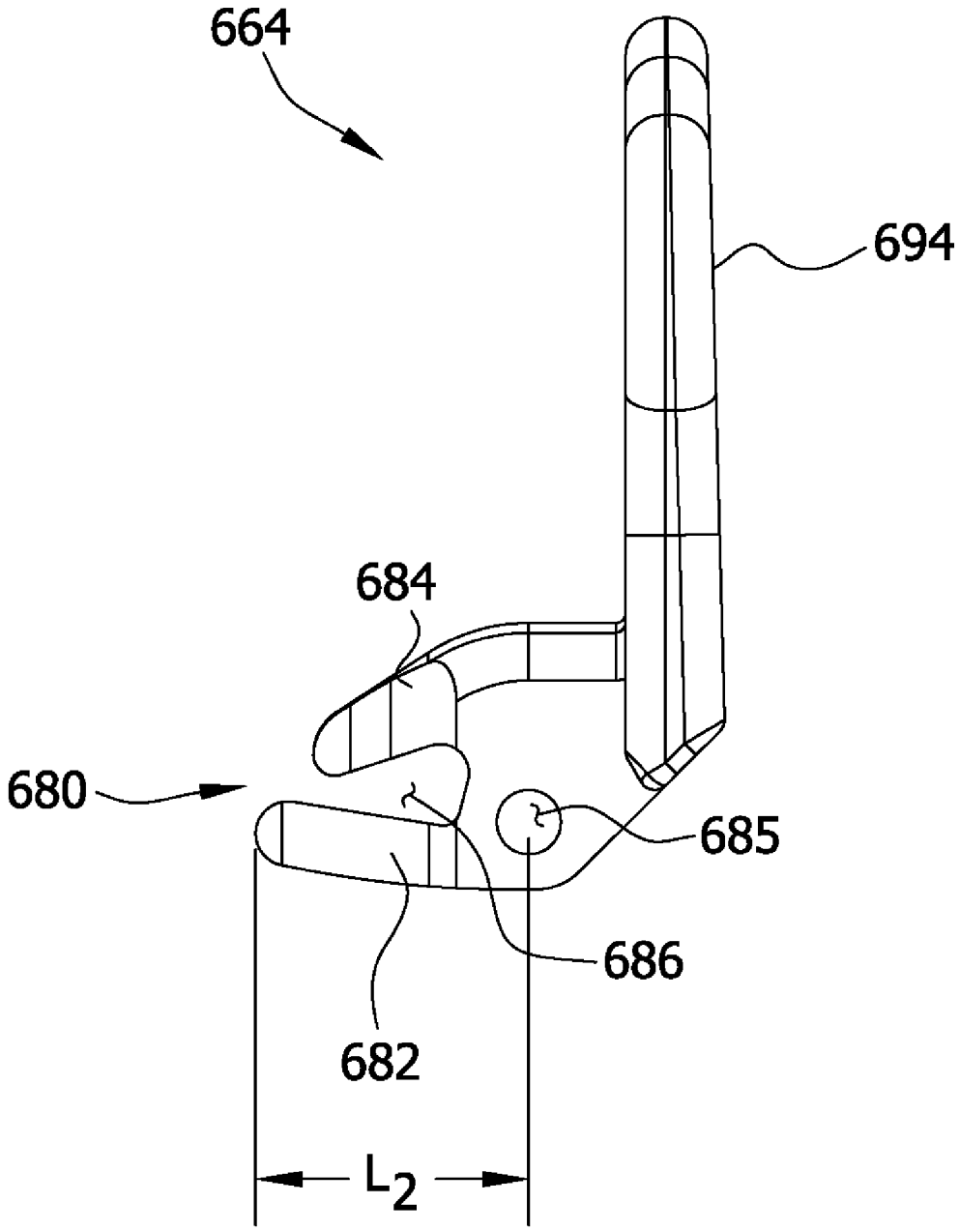
FIG. 42 is a side elevation of the actuator.
Figure 43:
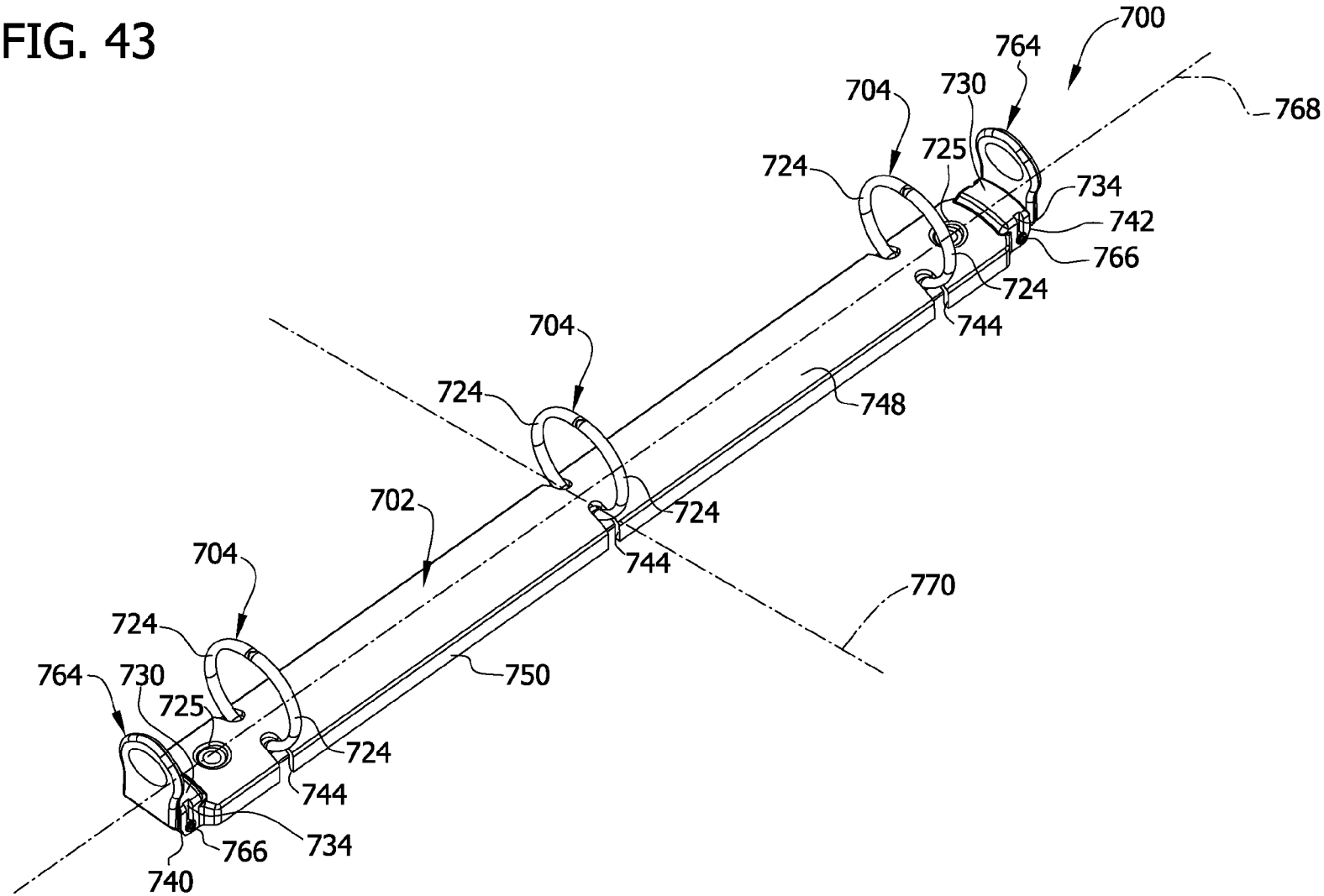
FIG. 43 is a perspective of a sixth embodiment of a ring binder mechanism.
Figure 44:
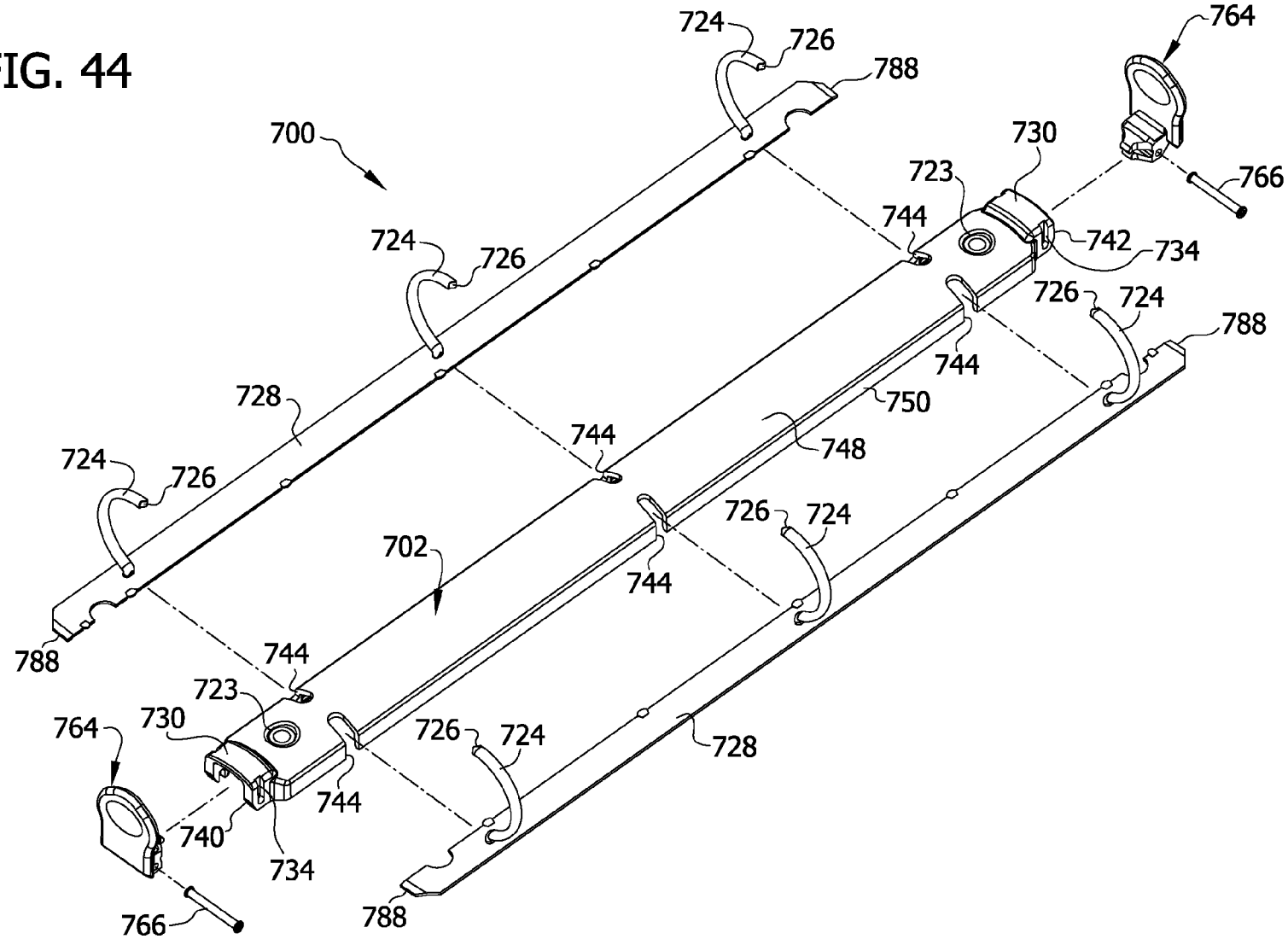
FIG. 44 is an exploded perspective of the ring binder mechanism of FIG. 43.
Figure 45:
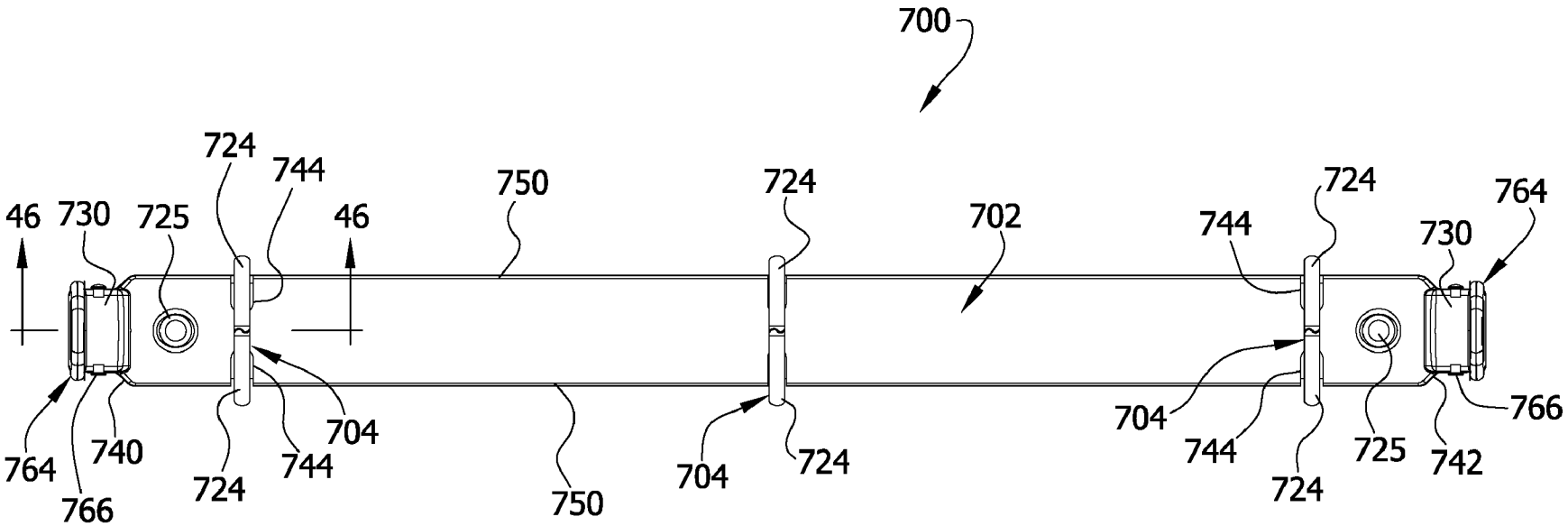
FIG. 45 is a top plan view of the ring binder mechanism.

FIGS. 35-42 illustrate a fifth embodiment of a ring binder mechanism, generally designated 600. Except as noted, this embodiment of the ring binder mechanism 600 is constructed and operated in substantially the same way as the ring binder mechanism 500 described above. As best illustrated in FIGS. 41 and 42, each actuator 664 has a lower arm 682 that is relatively longer that the lower arms 582 of the actuators seen in FIGS. 18-34. The lower arm 682 of this embodiment is also significantly longer than an upper arm 684 of the actuator 664. In one suitable embodiment, the lower arm 682 of each of the actuators 664 has a length L2 measured from a passage 685 in the actuator to a distal end of the lower arm between about 4.5 mm and about 12.5 mm. In the illustrated embodiment, for example, the length L2 of the lower arm 682 is about 8.5 mm. With reference now to FIG. 40, the relatively long lower arm 682 extends a substantially distance beneath the lower surface of the hinge plates 628 even when the hinge plates are pivoted upward to move the rings 604 to their opened position. In fact, the distance in which the lower arm 682 extends beneath the lower surface of the hinge plates 628 is approximately the same regardless if the hinge plates 628 are pivoted upward or pivoted downward. As a result, the length of the lower arm 682 inhibits the respective actuator 664 from disengaging from the hinge plates 628 during use.

Figure 46:
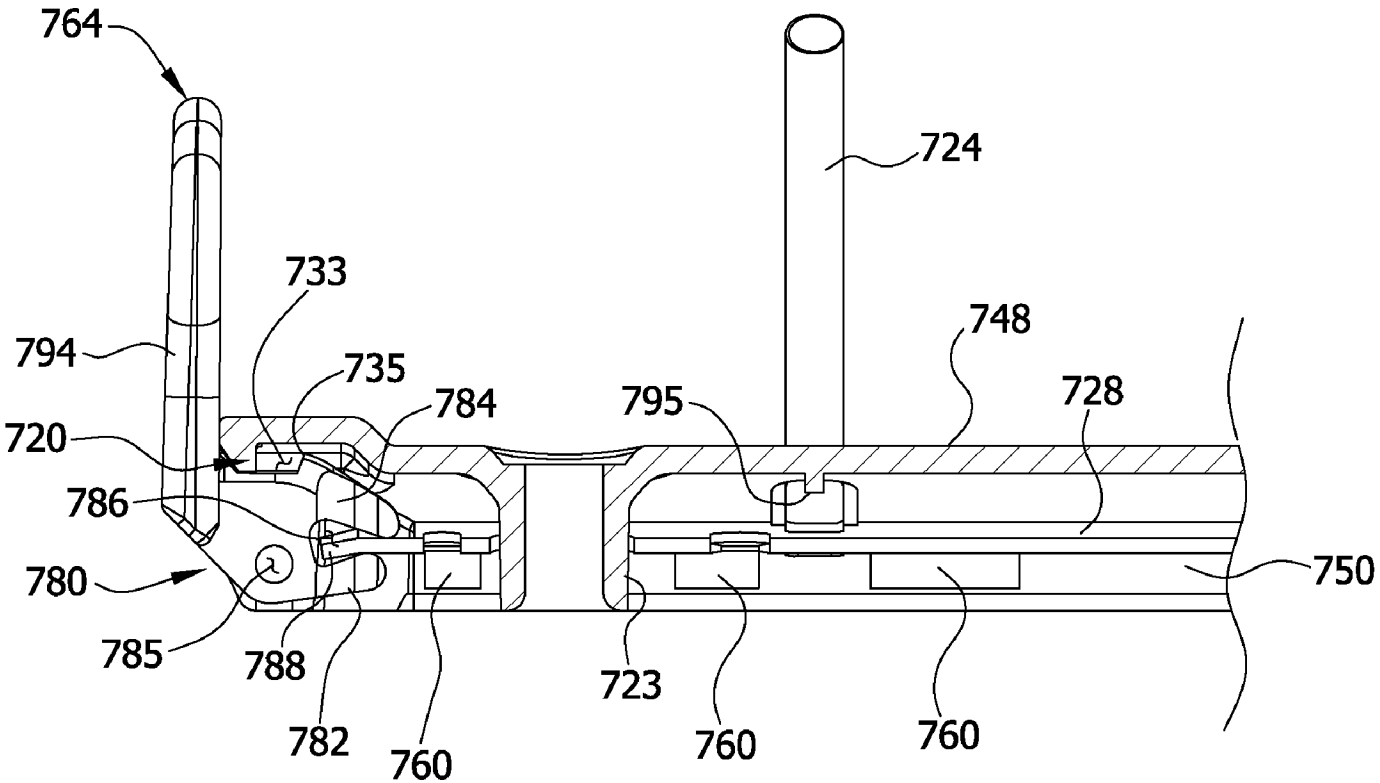
FIG. 46 is a fragmentary cross section of the ring binder mechanism taken along line 46-46 on FIG. 45.
Figure 47:
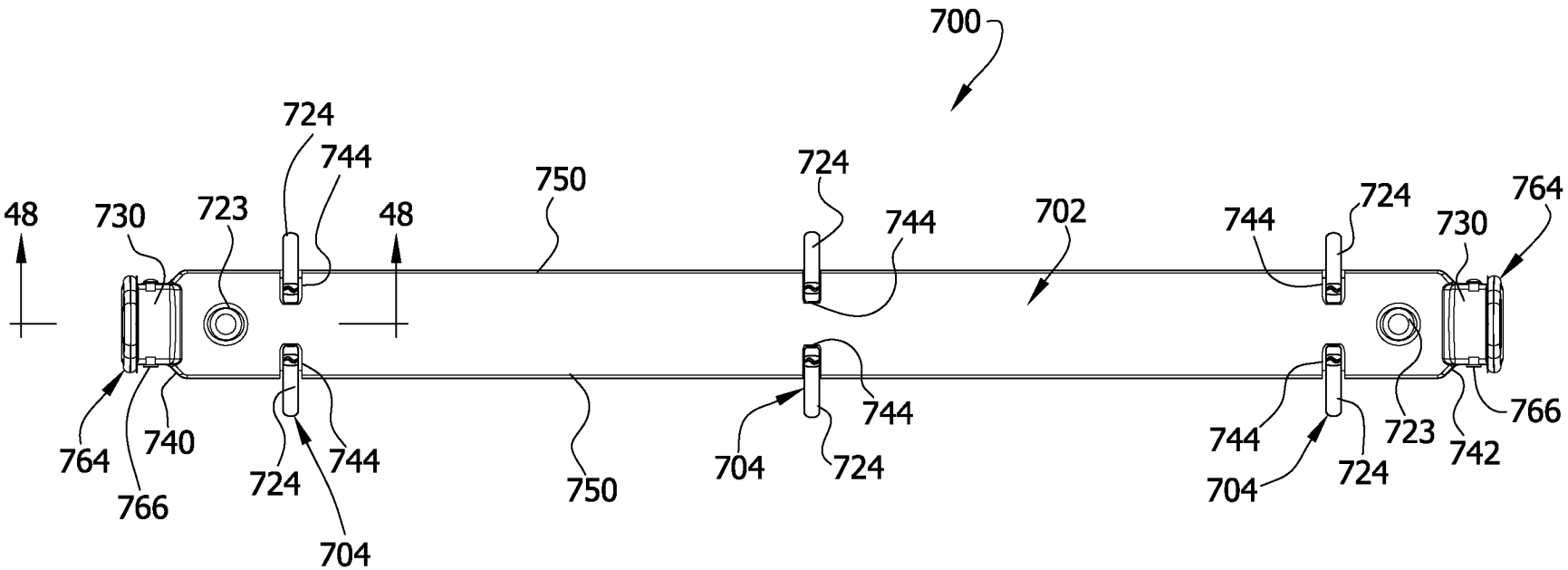
FIG. 47 is a top plan view of the ring binder mechanism with rings thereof in an opened position.
Figure 48:
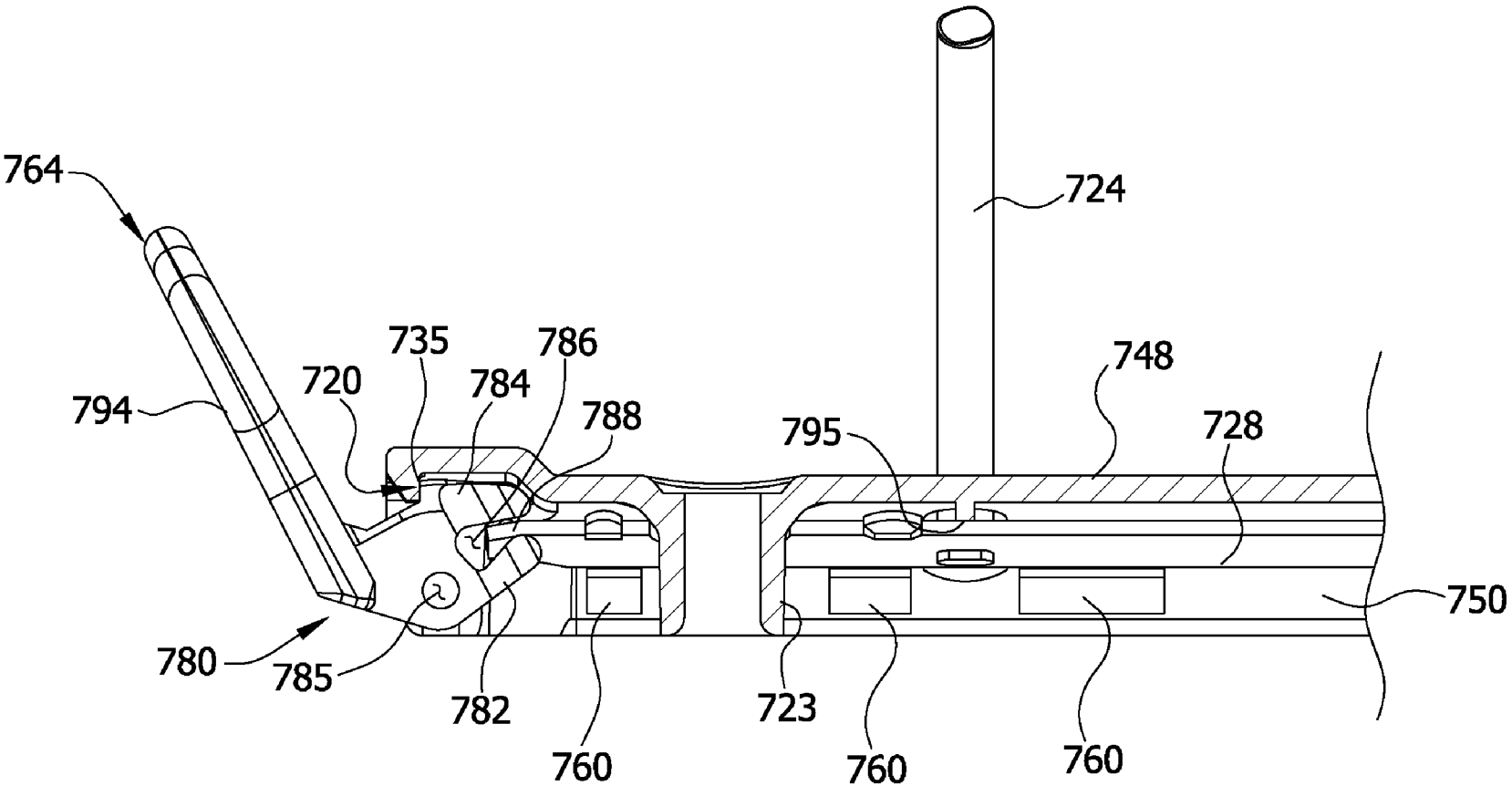
FIG. 48 is a cross section of the ring binder mechanism taken along line 47-47 on FIG. 47.
Figure 49:
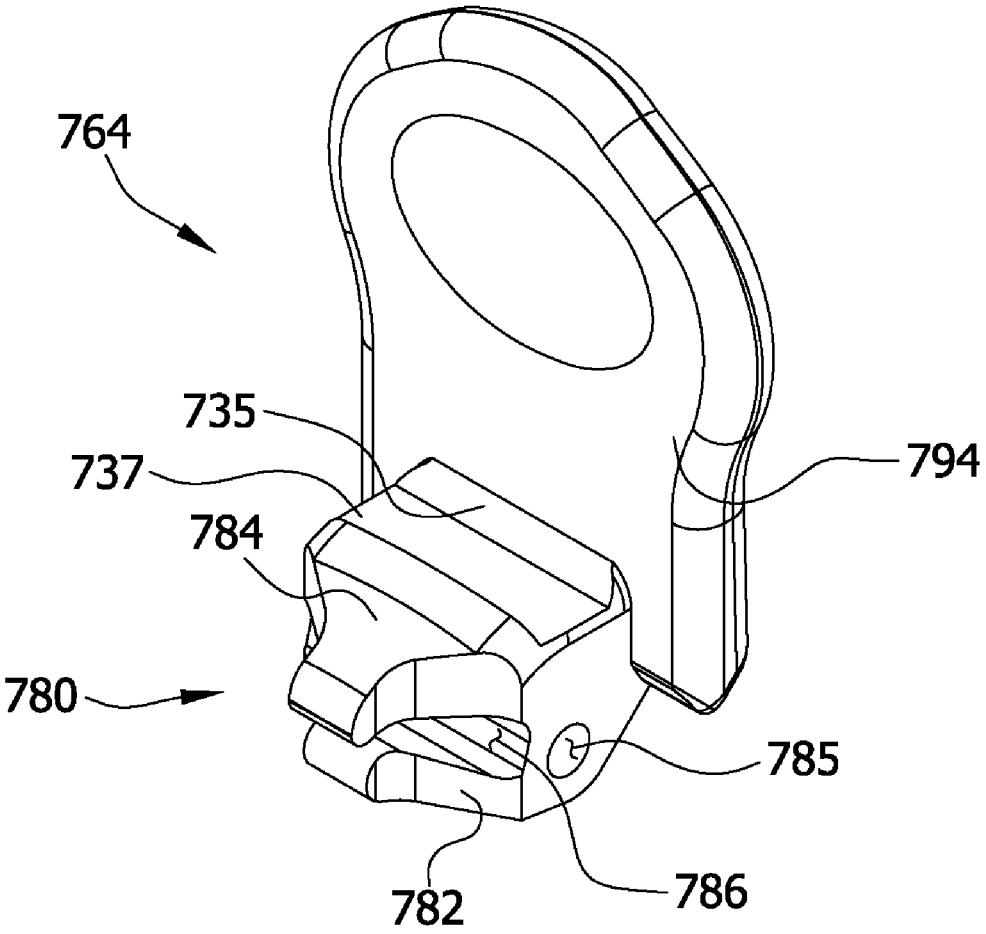
FIG. 49 is an enlarged perspective of an actuator of the ring binder mechanism.
Figure 50:
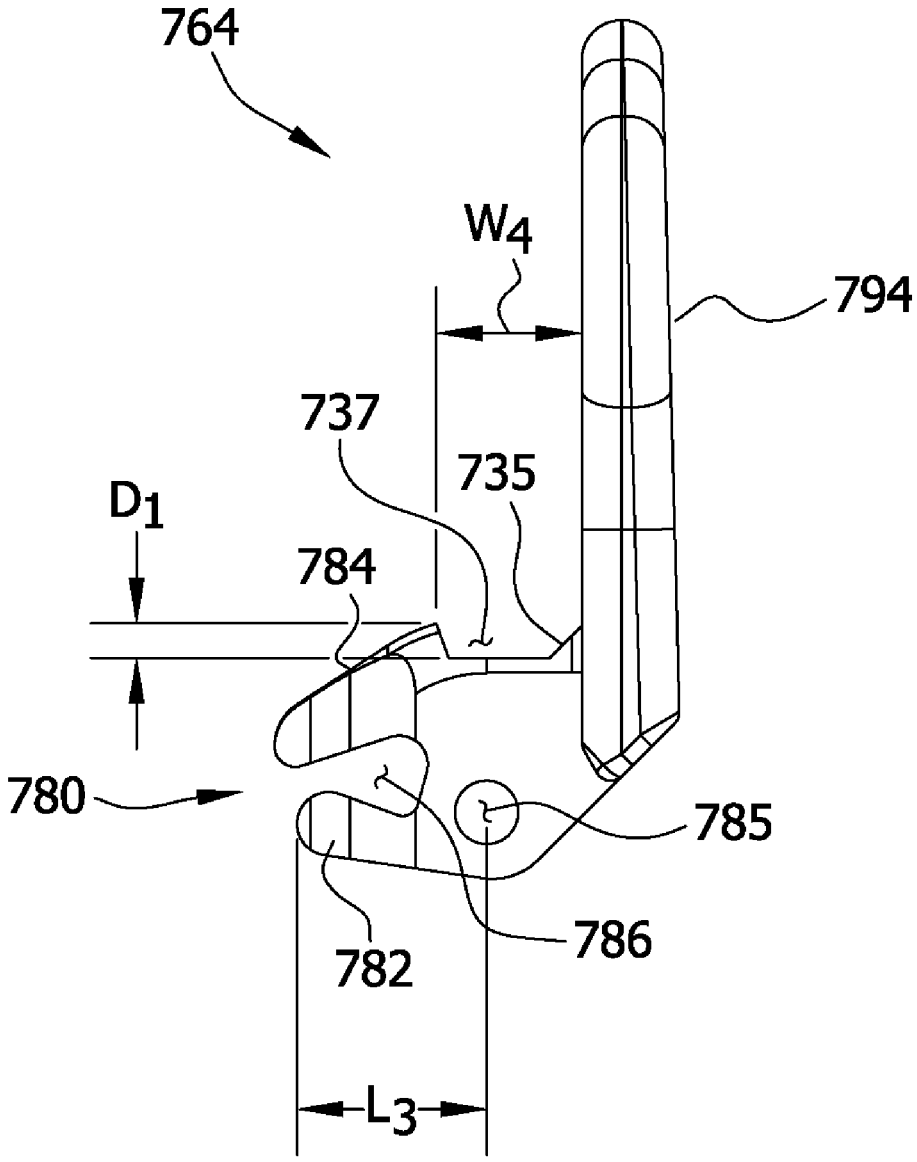
FIG. 50 is a side elevation of the actuator.
Figure 51:
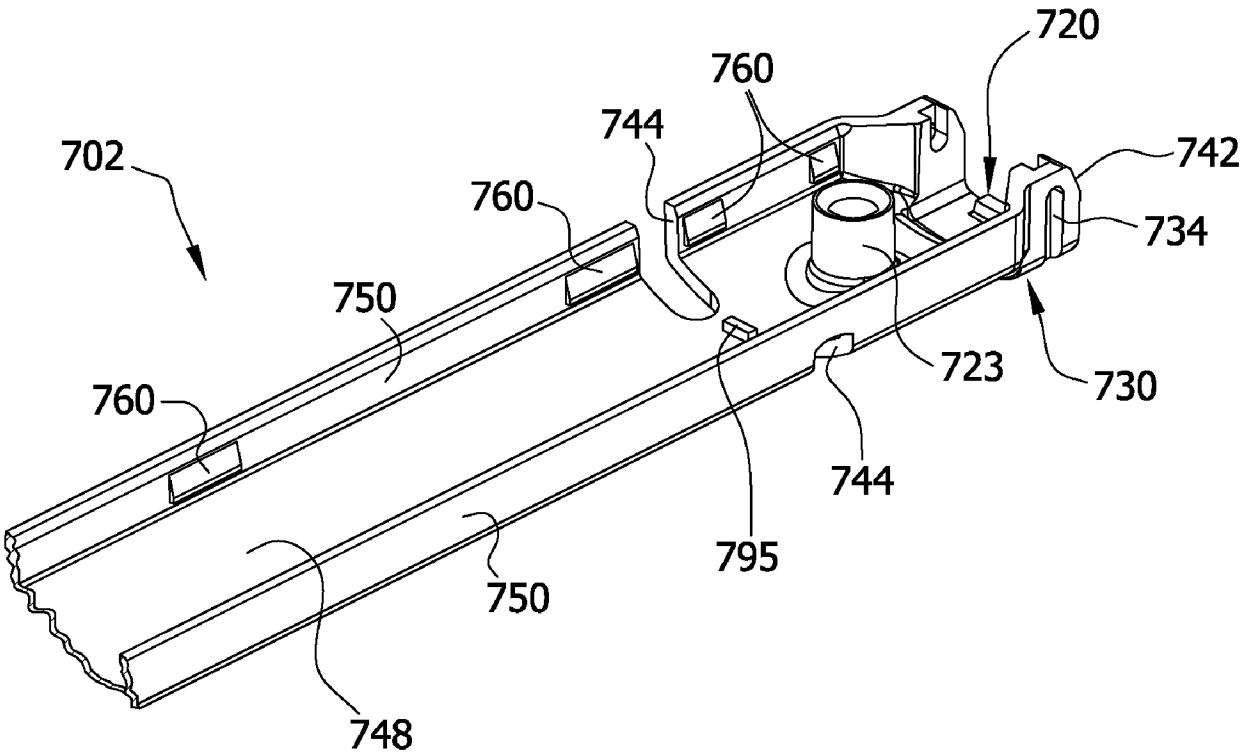
FIG. 51 is an enlarged, fragmentary bottom side perspective of a housing of the ring binder mechanism showing a stop located on an interior surface of the housing.

FIGS. 43-51 illustrate a sixth embodiment of a ring binder mechanism, generally designated 700. Except as noted, this embodiment of the ring binder mechanism 700 is constructed and operated in substantially the same way as the ring binder mechanism 500 described above. In this embodiment, a housing 702 includes a stop 720 (FIG. 51) disposed adjacent each of its longitudinal ends 740, 742. As illustrated in FIGS. 46, 48, and 51, the stops 720 extend down from an interior surface of a central portion 748 of the housing 702. The stops 720 of the illustrated ring binder mechanism 700 are formed (e.g., molded) with the rest of the housing 702 but can be made separate from the other parts of the housing and secured to the housing within the scope of the invention.

With reference to FIGS. 49 and 50, each actuator 764 has a notch 737 that defines an engagement surface 735 positioned and arranged to engage the stop 720 after the respective actuator has pivoted relative to the housing 702 in the direction that causes rings 704 of the ring binder mechanism 700 to open. The engagement between engagement surface 735 of the actuator 764 and the stop 720 of the housing 702 limits pivoting movement of the actuator relative to the housing in the direction that opens the rings 704. That is, the actuator engagement surface 735 and housing stop 720 cooperatively inhibit the actuator (i.e., a lower arm 782 of the actuator) from disengaging from the hinge plates 728. The stop 720 remains in the notch 737 of the actuator 764 during movement of the actuator to open and close the rings 704.

In one suitable embodiment, the lower arm 782 of each of the actuators 764 has a length L3 (FIG. 50) measured from a passage 785 in the actuator to a distal end of the lower arm between about 4.5 mm and about 12.5 mm. In the illustrated embodiment, for example, the length L3 of the lower arm 782 is about 6 mm. The notch 737, in one suitable embodiment, has a depth D1 between about 0.5 mm and about 3 mm and a width W4 between about 2.5 mm and about 7.5 mm. In the illustrated embodiment, for example, the notch 737 has a depth D1 of about 1 mm and a width W4 of about 4.8 mm.

When introducing elements of the present invention or the preferred embodiments thereof, the articles "a", "an", "the" and "said" are intended to mean that there are one or more of the elements. The terms "comprising", "including," and "having" are intended to be inclusive and mean that there may be additional elements other than those listed.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A ring binder mechanism for holding loose-leaf pages, the mechanism comprising:

a housing;

a ring support supported by the housing for movement relative to the housing, the ring support having an upper surface and a lower surface;

a plurality of rings for holding the loose-leaf pages, each ring including a first ring member and a second ring member, the first ring member being mounted on the ring support for movement with the ring support relative to the housing between a closed position and an opened position, in the closed position the first and second ring members cooperatively forming a substantially continuous, closed loop for allowing loose-leaf pages retained by the rings to be moved along the rings from one ring member to the other, and in the opened position the first and second ring members forming a discontinuous, open loop for adding or removing loose-leaf pages from the rings; and an actuator mounted on the housing for pivotal movement relative to the housing for moving the rings from their closed position to their opened position, the actuator including a lower arm having a contact surface engageable with the lower surface of the ring support and a beveled edge at the outer end of the contact surface on the lower arm, the beveled edge defining an angle between its outer surface and a horizontal plane between about 16 degrees and about 55 degrees when the rings are closed.

2. The ring binder mechanism as set forth in claim 1 wherein the angle is approximately 37 degrees.

3. The ring binder mechanism as set forth in claim 1 wherein the lower arm has a length between about 4.5 mm and about 12.5 mm.

4. The ring binder mechanism as set forth in claim 3 wherein the length of the lower arm is about 7 mm.

5. The ring binder mechanism as set forth in claim 1 wherein the housing is constructed at least in part of a polymeric material.

6. The ring binder mechanism as set forth in claim 1 wherein the ring support comprises a pair of hinge plates in generally side-by-side relation and hingedly connected to one another for pivoting movement relative to each other.

7. The ring binder mechanism as set forth in claim 1 wherein the mechanism has two actuators, each actuator being mounted on a respective longitudinal end of the housing.

8. The ring binder mechanism as set forth in claim 1 in combination with a cover, the ring binder mechanism being mounted on the cover and the cover being hinged for movement to selectively cover and expose any loose leaf pages held by the ring binder mechanism.

9. A ring binder mechanism for holding loose-leaf pages, the mechanism comprising:

a housing having longitudinal ends and a stop located adjacent at least one of its ends;

a ring support supported by the housing for movement relative to the housing, the ring support having an upper surface and a lower surface;

a plurality of rings for holding the loose-leaf pages, each ring including a first ring member and a second ring member, the first ring member being mounted on the ring support for movement with the ring support relative to the housing between a closed position and an opened position, in the closed position the first and second ring members cooperatively forming a substantially continuous, closed loop for allowing loose-leaf pages retained by the rings to be moved along the rings from one ring member to the other, and in the opened position the first and second ring members forming a discontinuous, open loop for adding or removing loose-leaf pages from the rings; and an actuator mounted on the housing for pivotal movement relative to the housing, the actuator being engageable with the ring support for moving the rings from their closed position to their opened position during pivotal movement of the actuator, the actuator having an engagement surface positioned and arranged to engage the stop during pivotal movement of the actuator to inhibit pivoting movement of the actuator relative to the housing in the direction that opens the rings.

10. The ring binder mechanism as set forth in claim 9 wherein the engagement surface of the actuator is defined by a notch formed in the actuator.

11. The ring binder mechanism as set forth in claim 10 wherein the stop of the housing is received in the notch formed in the actuator.

12. The ring binder mechanism as set forth in claim 11 wherein the notch has a depth between about 0.5 mm and about 3 mm.

13. The ring binder mechanism as set forth in claim 12 wherein the depth of the notch is about 1 mm.

14. The ring binder mechanism as set forth in claim 11 wherein the notch has a width between about 2.5 mm and about 7.5 mm.

15. The ring binder mechanism as set forth in claim 14 wherein the width of the notch is about 4.8 mm.

16. The ring binder mechanism as set forth in claim 9 wherein the actuator comprises a lower arm engageable with the lower surface of the ring support for moving the rings from their closed position to their opened position during pivotal movement of the actuator.

17. The ring binder mechanism as set forth in claim 16 wherein the lower arm has a length between about 4.5 mm and about 12.5 mm.

18. The ring binder mechanism as set forth in claim 17 wherein the length of the lower arm is about 6 mm.

19. The ring binder mechanism as set forth in claim 9 wherein the housing is constructed at least in part of a polymeric material.

20. The ring binder mechanism as set forth in claim 9 wherein the ring support comprises a pair of hinge plates in generally side-by-side relation and hingedly connected to one another for pivoting movement relative to each other.

21. The ring binder mechanism as set forth in claim 9 wherein the mechanism has two actuators.

22. The ring binder mechanism as set forth in claim 9 in combination with a cover, the ring binder mechanism being mounted on the cover and the cover being hinged for movement to selectively cover and expose any loose leaf pages held by the ring binder mechanism.

* * * * *